US010561249B2

(12) United States Patent
Doolan et al.

(10) Patent No.: US 10,561,249 B2
(45) Date of Patent: Feb. 18, 2020

(54) PORTABLE CHAIR AND CUP HOLDER ASSEMBLY

(71) Applicant: YETI Coolers, LLC, Austin, TX (US)

(72) Inventors: William S. Doolan, Dripping Springs, TX (US); Steve C. Nichols, Austin, TX (US); Andrew J. Winterhalter, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 15/698,403

(22) Filed: Sep. 7, 2017

(65) Prior Publication Data

US 2018/0338622 A1 Nov. 29, 2018

Related U.S. Application Data

(63) Continuation-in-part of application No. 15/602,841, filed on May 23, 2017.

(51) Int. Cl.

| | |
|---|---|
| ***A47C 7/62*** | (2006.01) |
| ***A47G 23/02*** | (2006.01) |
| ***A47C 7/70*** | (2006.01) |

(52) U.S. Cl.
CPC ..... *A47C 7/70* (2013.01)

(58) Field of Classification Search
CPC ..... A47C 7/282; A47C 31/023; A47C 7/40; A47C 7/62; A47C 7/68; A47C 7/70;
(Continued)

(56) References Cited

U.S. PATENT DOCUMENTS 2,638,970 A 5/1953 Harber
2,995,333 A 8/1961 Pazzano
(Continued)

FOREIGN PATENT DOCUMENTS

CN 3463190 7/2005
CN 301324411 8/2010
(Continued)

OTHER PUBLICATIONS

Website: Scootaround, Inc., "Nitro Rollator Cup Holder Attachment," visited Jan. 5, 2017,<https://www.scootaroundsales.com/Nitro-Rollator-Cup-Holder-Attachment_p_396.html>.
(Continued)

*Primary Examiner* — Shin H Kim
(74) *Attorney, Agent, or Firm* — Banner & Witcoff, Ltd.

(57) ABSTRACT

A portable chair may include a first front leg and a second front leg connected by a front sled and a first back leg and a second back leg connected by a back sled. The front sled may include a first front foot and a second front foot and the back sled may include a first back foot and a second back foot. Each of the feet attached to the front and back sleds may include retention feature holes configured to allow water to drain from the sled/foot interface. The portable chair may further include a seat including a seat frame border including a plurality of protrusions. The seat frame border may be rigidly attached to the seat via an injection molding process. In addition, the portable chair may have a cup holder assembly that can detachably attach to either of the front legs of the chair. The cup holder assembly may have a cup holder portion that can rotate relative to the clamp member to be able to mount to either leg. The cup holder can also rotate around either of the legs without being removed when the chair is in a folded configuration to make it easier to carry the chair.

17 Claims, 29 Drawing Sheets

(58) Field of Classification Search
CPC ..... A47C 5/10; A47G 23/0225; B60N 3/103; B62B 2202/023
See application file for complete search history.

(56) References Cited

U.S. PATENT DOCUMENTS 3,021,106 A 2/1962 Kramer
3,317,171 A 5/1967 Kramer
D220,908 S 6/1971 Smith
3,695,702 A 10/1972 Ingellis
3,698,675 A 10/1972 Lerew et al.
3,719,389 A 3/1973 Burton et al.
3,815,233 A 6/1974 Carroll
3,881,677 A 5/1975 Ihlenfeld
4,063,701 A 12/1977 Wray
4,119,286 A 10/1978 Barril
4,191,350 A 3/1980 Ormond
4,234,226 A 11/1980 Colby
4,270,724 A 6/1981 McMullen
4,382,648 A 5/1983 Propst et al.
4,469,377 A 9/1984 O'Rourke
4,513,347 A 4/1985 Wilcox et al.
4,535,923 A 8/1985 Manke
4,560,128 A 12/1985 Willeby et al.
4,613,185 A 9/1986 Marchesini
4,652,050 A 3/1987 Stevens
4,685,255 A 8/1987 Kelley
4,697,780 A 10/1987 Wenkman et al.
4,728,147 A 3/1988 Dutton
4,767,092 A 8/1988 Weatherly
4,795,211 A 1/1989 Stern et al.
4,832,152 A 5/1989 Schuelke et al.
4,842,335 A 6/1989 Wunderlich
4,878,642 A 11/1989 Kirby, Jr.
4,887,784 A 12/1989 Kayali
4,914,873 A 4/1990 Newhouse
4,997,156 A 3/1991 Allen
5,035,464 A * 7/1991 Spallholtz ..... A47C 7/62 297/144
5,058,347 A 10/1991 Schuelke et al.
5,129,202 A 7/1992 Payne et al.
5,142,734 A 9/1992 Looman et al.
5,174,086 A 12/1992 Payne et al.
D333,387 S 2/1993 Guay
5,203,022 A 4/1993 Finch et al.
5,211,687 A 5/1993 Loser
5,356,107 A 10/1994 Sinohuiz
D353,840 S 12/1994 Dietterich et al.
5,423,151 A 6/1995 Caro et al.
D373,935 S 9/1996 Cole et al.
5,564,779 A 10/1996 Tolbert et al.
D378,476 S 3/1997 Spaeth
5,628,485 A 5/1997 Ray
5,655,805 A 8/1997 Shaddy
5,666,888 A 9/1997 Dame et al.
5,678,890 A 10/1997 Tenbroeck
5,688,023 A 11/1997 Blocker, Jr.
5,695,162 A 12/1997 DiCastro
5,711,575 A 1/1998 Hand et al.
5,762,403 A 6/1998 Robinson
5,813,646 A 9/1998 Bartholomae
5,842,671 A 12/1998 Gibbs
D404,975 S 2/1999 Fegan
5,865,124 A 2/1999 Wroe
5,865,412 A 2/1999 Mason
5,911,478 A 6/1999 Goodman
D417,561 S 12/1999 Liu
5,996,957 A 12/1999 Kurtz
6,000,752 A 12/1999 Shyr
6,029,938 A 2/2000 Fava
6,035,901 A 3/2000 Stumpf et al.
6,059,368 A 5/2000 Stumpf et al.
6,062,648 A 5/2000 Adler
D429,969 S 8/2000 Frankel
6,125,521 A 10/2000 Stumpf et al.
6,167,665 B1 1/2001 Dame et al.
6,226,849 B1 5/2001 Beck et al.
6,227,511 B1 5/2001 De Costa
6,293,624 B1 9/2001 Gaylord et al.
6,295,764 B1 10/2001 Berridge et al.
6,315,153 B1 11/2001 Osborn
6,338,419 B1 1/2002 Penney
6,364,409 B1 4/2002 Saul et al.
6,375,257 B1 4/2002 Blooding et al.
6,386,634 B1 5/2002 Stumpf et al.
6,439,659 B1 8/2002 Neubauer, Jr.
6,439,665 B1 8/2002 Cvek
D463,219 S 9/2002 Tsai
6,502,902 B1 1/2003 Romero
D470,727 S 2/2003 Bartley
6,540,950 B1 4/2003 Coffield
6,543,637 B1 4/2003 Osborn
6,550,855 B2 4/2003 Liu
6,581,260 B2 6/2003 Kinney
D476,860 S 7/2003 Groendyke
6,588,836 B1 7/2003 Lo
6,588,842 B2 7/2003 Stumpf et al.
6,591,541 B1 7/2003 Cummings
6,601,813 B1 8/2003 Kager et al.
6,648,290 B1 11/2003 Aleman
6,663,068 B2 * 12/2003 Huang ..... A47G 23/0225 224/926
6,702,390 B2 3/2004 Stumpf et al.
6,718,717 B2 4/2004 Henderson et al.
6,722,741 B2 4/2004 Stumpf et al.
6,726,285 B2 4/2004 Caruso et al.
6,726,286 B2 4/2004 Stumpf et al.
D490,251 S 5/2004 Lin
6,733,080 B2 5/2004 Stumpf et al.
6,764,132 B1 7/2004 Gaertner
6,766,912 B1 * 7/2004 Gibbs ..... A47G 23/0225 211/74
D494,769 S 8/2004 Vigneaud
6,890,030 B2 5/2005 Wilkerson et al.
6,896,231 B1 * 5/2005 Sullivan, Sr. ..... A47G 23/0225 248/276.1
D507,424 S 7/2005 Rogasis
6,942,300 B2 9/2005 Numa et al.
6,955,402 B2 10/2005 VanDeRiet et al.
D511,439 S 11/2005 Roybal
6,966,604 B2 11/2005 Stumpf et al.
D517,822 S 3/2006 Grosfillex
D519,292 S 4/2006 Ashby
7,052,081 B2 5/2006 Leng
7,059,682 B2 6/2006 Caruso et al.
7,066,550 B1 6/2006 Su
7,090,183 B2 8/2006 Heybl et al.
7,249,802 B2 7/2007 Schmitz et al.
7,275,729 B2 * 10/2007 Sherman ..... A47G 25/08 224/148.7
7,284,737 B2 10/2007 Kane
D555,371 S 11/2007 Le Gal
D559,000 S 1/2008 Vanderminden, Sr.
D571,115 S 6/2008 Cohen
D580,689 S 11/2008 Su
7,455,365 B2 11/2008 Caruso et al.
D581,708 S 12/2008 Su
7,472,962 B2 1/2009 Caruso et al.
7,510,345 B2 3/2009 Kosh et al.
7,537,453 B2 5/2009 Morgan et al.
D599,127 S 9/2009 Smith
D600,077 S 9/2009 Barnes, Jr.
7,594,700 B2 9/2009 Stumpf et al.
D604,564 S 11/2009 Walter
7,654,616 B2 2/2010 Kinoshita et al.
7,654,617 B2 2/2010 Farnsworth
7,677,407 B2 3/2010 Davis
7,765,663 B2 8/2010 Liu
7,793,904 B2 9/2010 Scarton et al.
7,794,022 B2 9/2010 Caruso et al.
7,841,666 B2 11/2010 Schmitz et al.
D633,311 S 3/2011 Peguero
D639,577 S 6/2011 Tseng
7,959,121 B1 6/2011 Barnes, Jr.

(56) References Cited

U.S. PATENT DOCUMENTS 8,029,066 B2 10/2011 Su
8,033,518 B2 10/2011 Schuchman
8,033,598 B2 10/2011 Smith et al.
D648,554 S 11/2011 Smith
D648,962 S 11/2011 Brodbeck
8,066,148 B2 11/2011 Garahan
D651,010 S 12/2011 Cohen
D654,322 S 2/2012 Duncan
8,109,576 B2 2/2012 Lin
D660,612 S 5/2012 Smith
8,172,332 B2 5/2012 Masunaga et al.
8,240,771 B2 8/2012 Diffrient
8,257,286 B2 9/2012 Meyer et al.
8,267,469 B1 9/2012 Adan
8,282,172 B2 10/2012 Schmitz et al.
D672,161 S 12/2012 McDowell
D673,816 S 1/2013 Phillips
D679,146 S 4/2013 Rincon
8,430,366 B2 4/2013 Tincher
8,449,037 B2 5/2013 Behar et al.
8,500,076 B2 8/2013 Lai
8,616,655 B2 12/2013 Jung
8,636,319 B1 1/2014 Parker, Jr.
8,657,521 B2 2/2014 Reeves
8,668,257 B2 * 3/2014 Wu ..... A47C 7/70 248/446
8,701,320 B2 4/2014 Gold et al.
8,801,102 B2 8/2014 Broome et al.
8,851,561 B2 10/2014 Huang
8,905,471 B2 12/2014 Tang
8,979,190 B2 * 3/2015 Madrigal ..... A47B 83/02 297/161
D727,110 S 4/2015 Henry et al.
D727,111 S 4/2015 Henry et al.
9,003,635 B2 4/2015 Parker et al.
9,004,433 B2 4/2015 Krieger
9,033,410 B2 5/2015 Roani et al.
9,033,421 B2 5/2015 Wilkinson et al.
9,161,629 B2 10/2015 Huang
9,211,014 B2 12/2015 Schmitz et al.
9,259,092 B2 2/2016 Choi
9,345,353 B2 5/2016 Forbes et al.
9,414,673 B2 8/2016 Behar et al.
9,428,093 B2 8/2016 Kupina
9,428,207 B2 8/2016 Hartenstine et al.
9,462,891 B2 10/2016 Kikuchi et al.
9,468,297 B2 10/2016 Grace
D771,400 S 11/2016 DoVale
9,492,014 B1 11/2016 Smith et al.
9,527,456 B2 12/2016 Ackeret et al.
9,532,559 B1 * 1/2017 Hemmerlin ..... A01K 97/10
9,532,654 B1 1/2017 Adams, IV et al.
9,642,485 B2 5/2017 Kuznicki, Jr.
9,657,890 B2 5/2017 Botello et al.
9,668,580 B2 6/2017 Schmitz et al.
9,677,594 B1 * 6/2017 Hemmerlin ..... F16B 35/005
9,877,587 B2 1/2018 Grace
D811,143 S 2/2018 Chavarria
10,012,133 B1 7/2018 Martin et al.
D837,614 S * 1/2019 Nichols ..... D7/620
10,278,527 B2 5/2019 Hayward
10,300,826 B2 5/2019 Denbo et al.
2001/0032915 A1 10/2001 Clifford
2001/0033100 A1 10/2001 Haney
2002/0070324 A1 * 6/2002 Huang ..... A47G 23/0225 248/311.2
2002/0142904 A1 10/2002 Zumbiel
2003/0071509 A1 4/2003 Neil et al.
2004/0129852 A1 7/2004 Giampavolo
2004/0144904 A1 * 7/2004 Carnevali ..... B60N 3/101 248/278.1
2004/0251718 A1 12/2004 Degen et al.
2005/0051690 A1 3/2005 Phillips et al.
2005/0184264 A1 8/2005 Tesluk et al.
2005/0207837 A1 9/2005 Kosh et al.
2006/0081750 A1 * 4/2006 Kazyaka ..... A47G 23/0225 248/311.2
2006/0138849 A1 6/2006 Wilkerson et al.
2006/0163934 A1 7/2006 Chen
2006/0170255 A1 8/2006 Huang
2007/0074917 A1 4/2007 Jaenke et al.
2007/0170756 A1 7/2007 Kang
2008/0001329 A1 1/2008 Vannimwegen et al.
2008/0006965 A1 1/2008 Hsien
2008/0077063 A1 3/2008 Meyer et al.
2008/0238169 A1 10/2008 Hicks et al.
2008/0272640 A1 11/2008 Boyle et al.
2008/0302938 A1 * 12/2008 Goodwin ..... A61G 5/10 248/288.51
2009/0014611 A1 1/2009 Hampton
2009/0050766 A1 * 2/2009 Scarton ..... A47G 23/0225 248/311.2
2009/0100587 A1 4/2009 Smith
2009/0261644 A1 10/2009 Piretti
2010/0084531 A1 * 4/2010 Schuchman ..... A47G 23/0225 248/311.2
2010/0096521 A1 4/2010 White et al.
2010/0275821 A1 * 11/2010 Lebel ..... A47B 3/00 108/28
2011/0121619 A1 5/2011 Chappell
2012/0149263 A1 6/2012 Cvek
2013/0069414 A1 3/2013 Ko
2013/0149031 A1 6/2013 Changsrivong et al.
2014/0110977 A1 * 4/2014 Madrigal ..... A47C 7/70 297/173
2014/0175139 A1 6/2014 Pereira
2014/0246550 A1 9/2014 Thier et al.
2014/0361583 A1 12/2014 Martus et al.
2015/0173514 A1 6/2015 Kikuchi et al.
2015/0308171 A1 10/2015 Shadley
2015/0367765 A1 12/2015 Kupina
2016/0045048 A1 2/2016 Katz
2016/0186925 A1 6/2016 Bettin
2018/0202496 A1 * 7/2018 Yang ..... F16D 1/04
2018/0338622 A1 11/2018 Doolan et al.
2018/0338623 A1 11/2018 Winterhalter et al.

FOREIGN PATENT DOCUMENTS

CN 301377966 11/2010
CN 303501418 12/2015
DE 202006007366 U1 9/2006
EP 002735472-0004 7/2015
JP 2002-142904 A 5/2002
WO 12053989 A2 4/2012

OTHER PUBLICATIONS

Website: Nordstrom, Inc., "Liquid Holster Self Leveling Cup Holder for City Select® Stroller," visited Jan. 5, 2017, (http://shop.nordstrom.com/s/baby-jogger-liquid-holster-self-leveling-cup-holder-for-city-select-stroller/4465499?origin=category-personalizedsort&fashioncolor=black>.
Website: Toys"R"Us, "Quinny Stroller Cupholder," visited Jan. 5, 2017, <https://t.toysrus.com/product?productId=17078546>.
Website: Cheeky Rascals, Image/jpg of "Mima Accessory Cup Holder," visited Jan. 5, 2017, (http://images.cheekyrascals.co.uk/images/product_shots/mima/mima_accessory_cup_holder.jpg>.
Website: 93y.ru., "Surf Silver Cross," visited Jan. 5, 2017, <http://93y.ru/233101-podstakannik-surf-silver-cross.html>.
Website: Linio, "Portavasos de Bicicleta, Motocicleta y Carreolas," visited Jan. 5, 2017, (https://www.linio.com.mx/p/portavasos-de-bicicleta-motocicleta-y-carreolas-tmqk8f>.
Website: Adverts, "Bugaboo Cup Holder," visited Jan. 5, 2017, <http://www.adverts.ie/buggies/bugaboo-cup-holder/9897502>.
Website: Babyhome, "Cup Holder," visited Jan. 5, 2017, <http://babyhome.es/qa/en/products/cup-holder>.
Aug. 3, 2018—ISR and WO—App. No. PCT/US18/34040.
Website: 93y.ru., "Surf Silver Cross," visited Jan. 5, 2017, <http://93y.ru/223101-podstakannik-surf-silver-cross.html>.

(56) References Cited

OTHER PUBLICATIONS

Website: Overstock, "Caravan Canopy Blue Suspension Folding Chair," visited Jan. 31, 2018, <https://www.overstock.com/Sports-Toys/Caravan-Canopy-Blue-Suspension-Folding-Chair/8789499/product.html>.
Website: Verified Designs, "Mesh Patio Chairs with Folding Chairs Ideas and Metal Chairs Materials," visited Jan. 31, 2018, <http://verifieddesigns.com/spectacular-mesh-patio-chair-design-which-is-more-embellishing-your-home-space/mesh-patio-chairs-with-folding-chairs-ideas-and-metal-chairs-materials/>.
Website: Jet, "Westfield Outdoor S13-S998T FS Tan FLD Sling Chair," visited Jan. 31, 2018, <https://jet.com/product/Westheld-Outdoor-S13-S998T-FS-Tan-FLD-Sling-Chair/0fbe30d483a248478b79e3bce8d22928>.
Website: Sun Prairie Blues Fest, "Reclining Patio Chair with Pull Out Ottoman," visited Jan. 31, 2018, http://family.spbluesfest.com/foldable-rectining-patio-chair-lounge/reclining-patio-chair-with-pull-out-ottoman/.
Apr. 12, 2019—(WO) Partial ISR and Provisional Written Opinion—App. No. PCT/US19/18980.

* cited by examiner

PORTABLE CHAIR AND CUP HOLDER ASSEMBLY

CROSS-REFERENCE TO RELATED APPLICATIONS

This application is a continuation-in-part of U.S. application Ser. No. 15/602,841 filed on May 23, 2017. This above referenced application is incorporated by reference in its entirety.

FIELD

Aspects described herein generally relate to portable chairs and a cup holder assembly for use with portable chairs. More specifically, aspects relate to portable and collapsible chairs.

BACKGROUND

Portable chairs are commonly used during events and activities where seating is desirable, but not always provided, such as tailgating, camping, and outdoor barbeques. In most cases, however, such chairs are made with cheap, low-end materials that provide for an uncomfortable seating experience, poor durability, minimal long-term viability, and susceptibility to accelerated deterioration under exposure to environmental phenomena. Accordingly, overall user satisfaction with low-end portable chairs is low and the frequency of replacement is high.

In other cases in which higher quality materials are used in the manufacture of portable chairs, extended longevity may be achievable as compared to low-end offerings. However, such high-end chairs exhibit marginal improvements in comfortability, resistance to weather-induced deterioration, and overall durability, while being offered at a substantially higher price point.

Accordingly, there exists a need for high quality, comfortable, and durable portable chairs.

BRIEF SUMMARY

The following presents a simplified summary of various aspects described herein. This summary is not an extensive overview, and is not intended to identify key or critical elements or to delineate the scope of the claims. The following summary merely presents some concepts in a simplified form as an introductory prelude to the more detailed description provided below.

To overcome limitations in the prior art described above, and to overcome other limitations that will be apparent upon reading and understanding the present specification, aspects described herein are directed to a portable chair and methods of forming a portable chair.

In accordance with one or more embodiments, a portable chair may include a first front leg and a second front leg connected by a front sled and a first back leg and a second back leg connected by a back sled. The front sled may include a first front foot and a second front foot and the back sled may include a first back foot and a second back foot. Each of the feet attached to the front and back sleds may include retention feature holes configured to allow water to drain from the sled/foot interface. The portable chair may further include a seat of a highly-permeable, weave-type construction which may include a seat frame border. The seat frame border may be a rigid thermoplastic over-mold including a plurality of protrusions on an underside portion.

The seat frame border may be rigidly attached to the seat via an injection molding process which may form the plurality of protrusions. The portable chair may also include a seat frame including a first terminal end, a second terminal end, a first seat attachment rail, and a second seat attachment rail. The plurality of protrusions on the underside portion of the seat frame border may be configured to removably engage with the first seat attachment rail and the second seat attachment rail. Additionally, the seat frame may include a carrying handle.

In some embodiments, in a state in which the seat frame border of the seat is removably engaged with the first seat attachment rail and the second seat attachment rail, the seat may be configured to slope downward at a front end portion.

In some embodiments, the portable chair may further include a first front leg joinery interface including a tubular protrusion onto which the first front leg may be configured to be inserted and fastened onto via a structural adhesive. The portable chair may also include a first back leg joinery interface including a tubular protrusion onto which the first back leg may be configured to be inserted and fastened onto via a structural adhesive.

In some embodiments, the portable chair may further include a first arm rest that may be configured to be rotatably fastened to the first front leg joinery interface and the first back leg joinery interface via a first front pin.

In some embodiments, the portable table chair may further include a second front leg joinery interface including a tubular protrusion onto which the second front leg may be configured to be inserted and fastened onto via a structural adhesive. The portable chair may also include a second back leg joinery interface including a tubular protrusion onto which the second back leg may be configured to be inserted and fastened onto via a structural adhesive.

In some embodiments, the portable chair may further include a second arm rest that may be configured to be rotatably fastened to the second front leg joinery interface and the second back leg joinery interface via a second front pin.

In some embodiments, the portable chair may further include a back of a highly-permeable, weave-type construction which may include a back frame border. The back frame border may be a rigid thermoplastic over-mold including a plurality of protrusions on a backside portion. The back frame border may be rigidly attached to the back via an injection molding process which may form the plurality of protrusions. The portable chair may also include a back frame including a first terminal end, a second terminal end, a first back attachment rail, and a second back attachment rail. The plurality of protrusions on the backside portion of the back frame border may be configured to removably engage with the first back attachment rail and the second back attachment rail.

In some embodiments, the portable chair may further include a first back joinery interface. The first back joinery interface may include a tubular protrusion onto which the first terminal end of the back frame may be configured to be inserted and fastened onto via structural adhesive. The portable chair may also include a second back joinery interface. The second back joinery interface may include a tubular protrusion onto which the second terminal end of the back frame may be configured to be inserted and fastened onto via structural adhesive.

In some embodiments, the portable chair may further include a first seat joinery interface. The first seat joinery interface may include a tubular protrusion onto which the first terminal end of the seat frame may be configured to be inserted and fastened onto via structural adhesive. The portable chair may also include a second seat joinery interface. The second seat joinery interface may include a tubular protrusion onto which the second terminal end of the seat frame may be configured to be inserted and fastened onto via structural adhesive.

In some embodiments, each of the first front leg, second front leg, front sled, first back leg, second back leg, back sled, seat frame, and back frame may be composed of hydroformed aluminum.

Additional aspects of this disclosure may relate to a cup holder assembly comprising a cup holder having a bottom interior surface, a lip, a substantially cylindrical wall positioned between the bottom surface and the lip, and an engaging member extending from the substantially cylindrical wall. The cup holder assembly may also have a collar with a first side that releasably secures to the engaging member of the cup holder and a second side secured to a clamp member with a substantially C-shaped member, where the collar can rotate relative to the clamp member. The collar may have a plurality of flex fingers that engage a corresponding plurality of flex fingers on the engaging member of the cup holder to releasably secure the cup holder to the collar. The plurality of flex fingers on the collar may comprise an upper flex finger positioned on a top portion of the collar and a lower flex finger positioned on a bottom portion of the collar, where the upper flex finger and the lower flex finger are spaced from each other. The collar may further comprise an alignment member positioned between the upper flex finger and the lower flex finger, where the alignment member has a radially extending flange that contacts a portion of at least one of the plurality of flex fingers on the engaging member of the cup holder to prevent rotation of the cup holder relative to the collar. In addition, the lower flex finger may be larger than the upper flex finger to prevent the cup holder from improper installation on the collar. Lastly, the collar may rotate relative to the clamp member in two positions.

Still even other aspects of this disclosure may relate to a portable chair and cup holder system comprising a portable chair that includes a first front leg and a second front leg connected by a front sled, a first back leg and a second back leg connected by a back sled, a seat comprising a weave-type construction, and a cup holder assembly that includes a cup holder having a bottom interior surface, a lip, and a substantially cylindrical wall positioned between the bottom interior surface and the lip, and an engaging member extending from the substantially cylindrical wall of the cup holder. The engaging member may releasably connect to a collar that may be secured to a clamp member having a substantially C-shaped member, where the C-shaped member may releasably connects to either the first front leg or the second front leg. The cup holder can rotate from an outboard position to an inboard position while still being connected to the portable chair. The C-shaped member may have a portion of an upper surface and a portion of a lower surface with a rounded edge such that the rounded edge contacts a bushing extending inwardly from either the first front leg or the second front leg of the portable chair. The cup holder may further rotate relative to the clamp member. The engaging member on the cup holder may include a plurality of flex fingers that engage a plurality of flex fingers on a collar, where the collar may be slidably connected to an engaging member extending from the C-shaped member of the clamp member. The collar and the engaging member of the clamp member may each have rotation inhibiting features.

Other aspects of this disclosure may relate to a cup holder assembly comprising a cup holder comprising a bottom surface, a lip, a substantially cylindrical wall positioned between the bottom surface and the lip, and an engaging member extending from the substantially cylindrical wall, a collar having a first side that releasably secures to the engaging member and a second side secured to a clamp member comprising a substantially C-shaped member, where the collar is slidably engaged with the clamp member. The cup holder assembly may be configured such that if a force exceeding 100 newtons (N) is applied to the cup holder in a vertical direction, the cup holder will release from the collar.

In addition, the collar may further comprise a plurality of rotation inhibiting features that engage a plurality of rotation inhibiting features on the clamp member to prevent inadvertent rotation of the collar relative to the clamp member. The collar can rotate relative to the clamp member, when the plurality of rotation inhibiting features on both the collar and the clamp member are disengaged by slidably moving the collar away from the clamp member. The plurality of rotation inhibiting features on the collar may comprise a plurality of bosses that are rotationally spaced apart, where one of the plurality of bosses has a first length that is greater than a second length a remainder of the bosses. Lastly, the plurality of rotation inhibiting features on the clamp member may comprise a plurality of pockets.

These features, along with many others, are discussed in greater detail below.

BRIEF DESCRIPTION OF THE DRAWINGS

A more complete understanding of aspects described herein and the advantages thereof may be acquired by referring to the following description in consideration of the accompanying drawings, in which like reference numbers indicate like features, and wherein.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "top," "bottom," "front," "back," "side," "rear," "upward," "downward," right, left, and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

Overview of Chair

Figure 1:
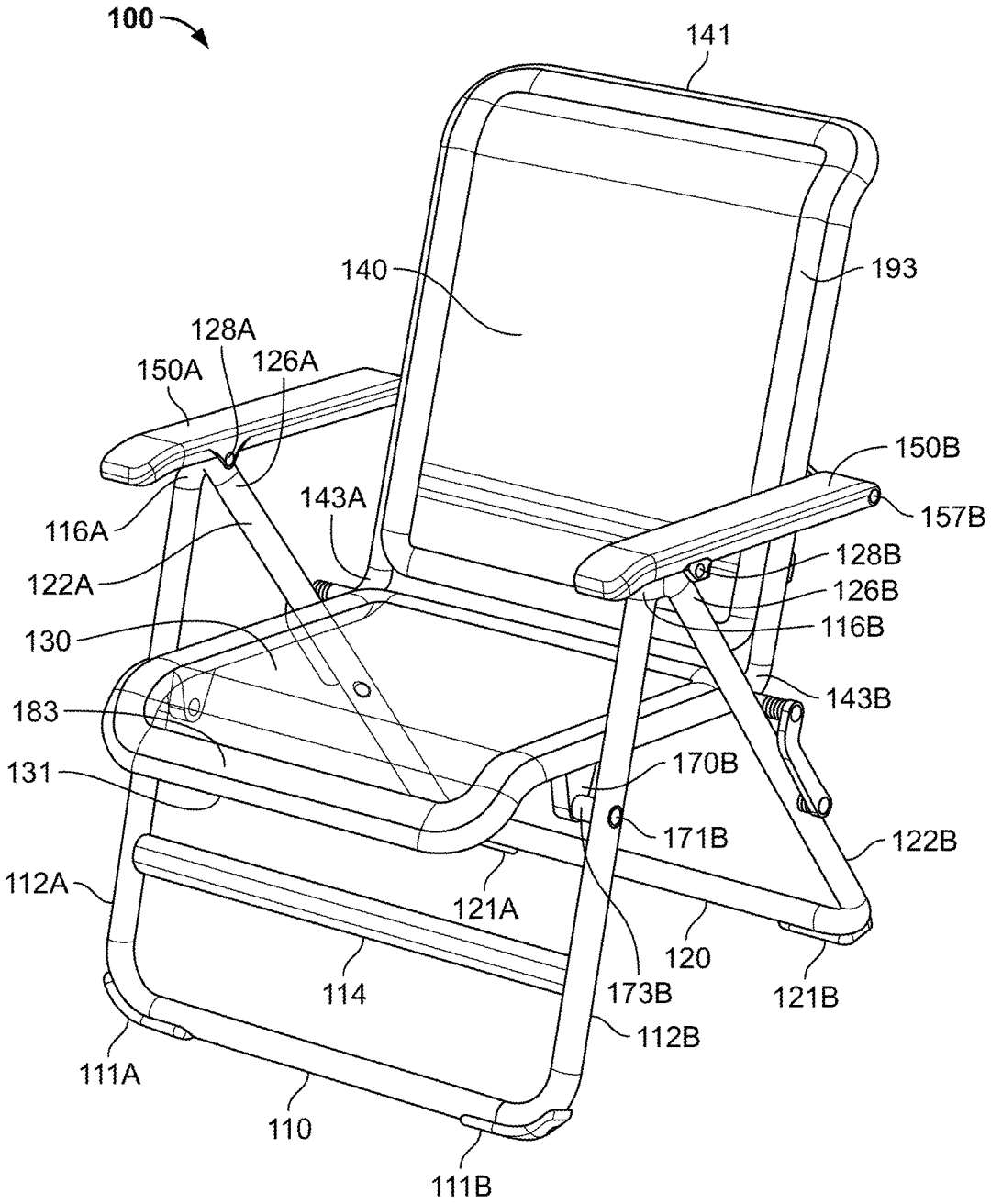
FIG. 1 is a front perspective view of an example of a portable chair according to one or more aspects described herein.

FIG. 1 depicts a front perspective view of an example of a chair 100, which can be a foldable and portable chair. Chair 100 may include a front sled 110 connecting front legs 112A and 112B and a back sled 120 connecting back legs 122A and 122B. The front sled 110 and the back sled 120 may be configured to support the chair 100 on a surface. The front legs 112A and 112B may be further connected and reinforced by front crossbar 114. The chair 100 may also include seat 130 connected to seat frame 131, and a back 140 connected to back frame 141. The chair 100 may include arm rests 150A and 150B. As will be discussed in further detail below, the chair 100 can be configured to fold up into a smaller profile for ease of storage and transportability.

Additionally, chair 100 may be of a symmetric construction wherein components on a left side of chair 100 (e.g., side corresponding to arm rest 150B) are mirrored on a right side (e.g., side corresponding to arm rest 150A). As such, front leg 112B may correspond to front leg 112A, arm rest 150B may correspond to arm rest 150A, and so on. Furthermore, as will be described in further detail below, components of chair 100 such as seat frame 131 and back frame 141, which extend from the left side to the right side of chair 100, may also be of a symmetric construction. For instance, seat frame 131 may include a first seat attachment rail on the left side and second seat attachment rail on the right side, back frame 141 may include a first back attachment rail on the left side and a second back attachment rail on the right side, and so on.

Legs

The portable chair 100 may include two front legs 112A and 112B and two back legs 122A and 122B. The two front legs 112A and 112B and the two back legs 122A and 122B may be cylindrical rods, tubes, and/or shafts and may be made of, for example, aluminum, titanium, stainless steel, scandium, metal alloys, polymers, composites, carbon fiber, and/or wood, such as bamboo. In instances in which aluminum, titanium, stainless steel, scandium, and/or metal alloys are used in the fabrication of the two front legs 112A and 112B and the two back legs 122A and 122B, the metals may be hydroformed and vacuum casted and may be treated through anodizing, plating, painting, powder coating, and/or the application of enamel in order to prevent corrosion induced by environmental conditions such as salt spray. Additionally, the metals and alloys used in the fabrication of legs 112A, 112B, 122A, and 122B may be treated through annealing, case hardening, precipitation strengthening, tempering, normalizing, and/or quenching in order to increase hardness, toughness, and tensile and shear strength.

The front legs 112A and 112B of portable chair 100 may be connected by front crossbar 114. Front crossbar 114 may be made of the same material as that of front legs 112A and 112B (e.g., aluminum, titanium, stainless steel, scandium, metal alloys, carbon fiber, and/or bamboo) or may be made of a different material than that of front legs 112A and 112B. In instances in which front legs 112A and 112B are made of a metal and front crossbar 114 is also made of a metal, front crossbar 114 may be welded to an inner portion of front legs 112A and 112B. Alternatively, front legs 112A and 112B and front crossbar 114 may be fabricated in a single continuous piece in a molding operation. In such instances, the fabrication may be done through hydroforming. Similarly, in instances in which front legs 112A and 112B are made of carbon fiber and front crossbar 114 is also made of carbon fiber, front legs 112A and 112B and front crossbar 114 may be fabricated in a single continuous piece in a molding operation. However, it is also contemplated that front crossbar 114 may be screwed, bolted, clamped, or otherwise fastened to an inner portion of front legs 112A and 112B, for example, in instances in which front legs 112A and 112B are made of a different material than that of front crossbar 114. Front crossbar 114 may be a low flex and low creep member and may able to support up to a 500 lb applied load. While not shown in FIG. 1, in some instances the back legs 120A and 120B of portable chair 100 may be connected by a back crossbar in a manner similar to the arrangement described above regarding front legs 110A and 110B and front crossbar 114.

In some embodiments, combinations of different materials can be used to form the chair 100. For example, front legs 110A and 110B and front crossbar 114 may be made of a different material than that of back legs 120A and 120B. For example, front legs 110A and 110B and front crossbar 114 may be made of carbon fiber and back legs 120A and 120B may be made of metal. Alternatively, front legs 110A and 110B and back legs 120A and 120B may be made of a first material (e.g., metal) and front crossbar 114 may be made of a second material (e.g., carbon fiber).

In arrangements in which a back crossbar is included, similar combinations of different materials as described above may be used to form the chair 100. For example, front legs 110A and 110B and front crossbar 114 may be made of a different material than that of back legs 120A and 120B and the back crossbar. For example, front legs 110A and 110B and front crossbar 114 may be made of carbon fiber and back legs 120A and 120B and the back crossbar may be made of metal. Alternatively, front legs 110A and 110B and back legs 120A and 120B may be made of a first material (e.g., metal) and front crossbar 114 and the back crossbar may be made of a second material (e.g., carbon fiber).

Sleds and Feet

The two front legs 112A and 112B may be joined by front sled 110, which may be a continuous connecting member. As such, the two front legs 112A and 112B and the front sled 110 may be fabricated in a single continuous piece through, for example, any of the manufacturing methods described herein. Similarly, the two back legs 122A and 122B may be joined by back sled 120 and may be fabricated in a single continuous piece. The front sled 110 and the back sled 120 may be treated through anodizing, plating, painting, powder coating, and/or the application of enamel in order to prevent corrosion induced by environmental conditions such as salt spray, as well as through annealing, case hardening, precipitation strengthening, tempering, normalizing, and/or quenching in order to increase hardness, toughness, and tensile and shear strength.

Figure 2A:
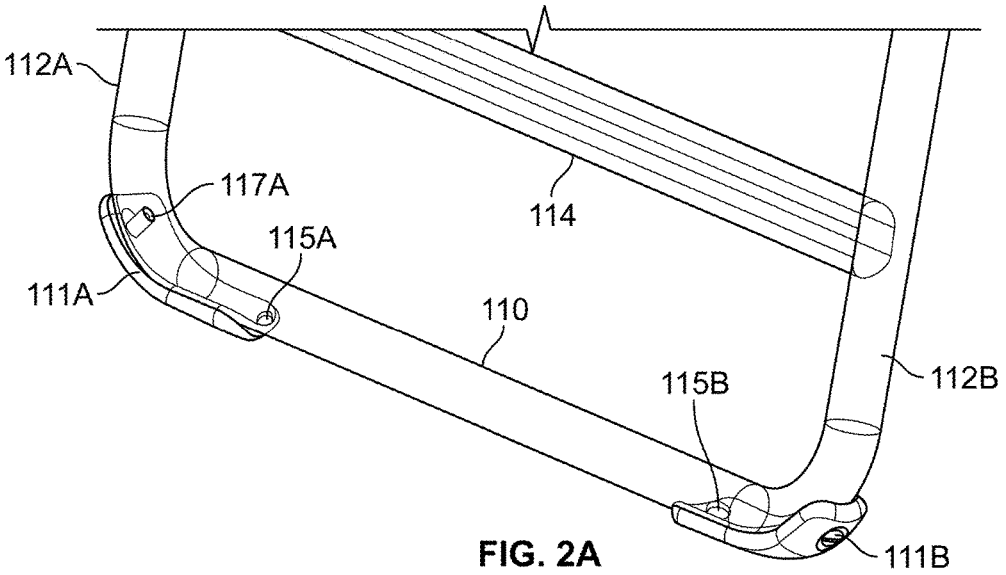
FIGS. 2A, 2B, and 2C respectively illustrate front perspective views of example sections of the example portable chair of FIG. 1 according to one or more aspects described herein.
Figure 2B:
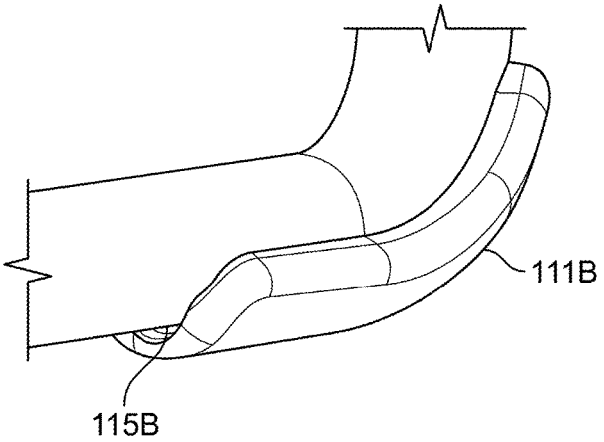
Figure 2C:
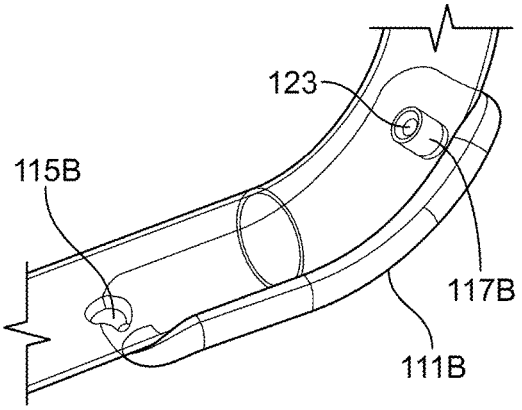

Additionally, the front sled 110 may include front foot 111A and front foot 111B, which may be plastic and/or rubber caps at a lowermost and/or bottommost portion of sled 110 to facilitate or improve the frictional engagement with an adjacent contact surface (e.g., floor, ground, etc.). The front feet can include a suitable material or texture to increase the coefficient of friction between the front feet and the surface which the chair is placed. As shown in FIGS. 2A, 2B, and 2C, front feet 111A and 111B may be configured to engage with a section of front sled 110 proximate to the front legs 112A and 112B. As such, front foot 111A may be configured to engage with a section of front sled 110 proximate to front leg 112A and front foot 111B may be configured to engage with a section of front sled 110 proximate to front leg 112B.

As shown in FIG. 2C, front foot 111B may include engagement plug 117B. In some instances, engagement plug 117B may be a plastic, rubber, and/or metal protrusion extending radially from front foot 111B. Additionally and/or alternatively, engagement plug 117B may be a screw-like structure made of plastic, rubber, and/or metal. The engagement plug 117B may be configured to be inserted into front sled 110. Before, during, or after insertion, a binding agent and/or structural adhesive may be applied to engagement plug 117B to secure front foot 111B to front sled 110. Additionally, front foot 111B may include retention feature hole 115B which may be configured to allow water to drain away from the foot/sled interface. Similar to front foot 111B, front foot 111A may include an engagement plug 117A and a retention feature hole 115A, each of which may be configured to interface with sled 110 and function in the manner described in regard to front foot 111B.

Also the engagement plugs 117A, 117B can each include a series of holes 123, which provide a channel for moisture located in the frame. The series of holes 123 in combination with the retention feature holes 115A, 115B create an outlet for any moisture that collects inside the frame of the chair. In one example, a single hole or a plurality of holes can be included on the end of the engagement plugs 117A, 117B. In other examples, the engagement plugs 117A, 117B can be formed of a porous material that allows water to flow through the engagement plugs 117A, 117B to allow for water to escape through the retention feature holes 115A, 115B. It is also envisioned that separate holes can be included in the frame and in the front feet 111A, 111B to allow for water or moisture to escape out of the frame of the chair.

In other examples, the front feet 111A and 111B may be plastic and/or rubber coatings applied to front sled 110 and may be included in recessed or notched pockets (not shown) proximate to the two front legs 112A and 112B. Alternatively, the plastic and/or rubber coating may be applied along the length of the front sled 110 at a lowermost and/or bottommost portion and the first and second front engagement faces and may form a continuous front engagement face. In other examples, the plastic and/or rubber coating may be applied intermittently in uniform intervals along the length of the front sled 110 at a lowermost and/or bottommost portion. In such examples, the front feet may form an intermittent front engagement face.

Similar to front sled 110, the back sled 120 may include back foot 121A and back foot 121B, which may be plastic and/or rubber caps at a lowermost and/or bottommost portion to facilitate frictional engagement with an adjacent contact surface (e.g., floor, ground, etc.). Back feet 121A and 121B may be configured to engage with a section of back sled 120 proximate to the back legs 122A and 122B. As such, back foot 121A may be configured to engage with a section of back sled 120 proximate to back leg 122A and back foot 121B may be configured to engage with a section of back sled 120 proximate to back leg 122B.

Similar to front feet 111A and 111B, back feet 121A and 121B may each include an engagement plug and a retention feature hole. The engagement plug and retention feature hole of back feet 121A and 121B may be configured to interface with sled 120 and function in the manner described in regard to front feet 111A and 111B. Also the back feet 121A and 121B can be provided with similar draining features discussed above in relation to front feet 111A and 111B.

Again, in other examples, back feet 121A and 121B may be plastic and/or rubber coatings applied to back sled 120 and may be included in recessed pockets proximate to the two back legs 122A and 122B. Alternatively, the plastic and/or rubber coating may be applied along the length of the back sled 120 at a lowermost and/or bottommost portion and the first and second back engagement faces and may form a continuous back engagement face. In other examples, the plastic and/or rubber coating may be applied intermittently in uniform intervals along the length of the back sled 120 at a lowermost and/or bottommost portion. In such examples, the first and second back engagement faces may form an intermittent back engagement face.

Joinery Interfaces

Figure 3:
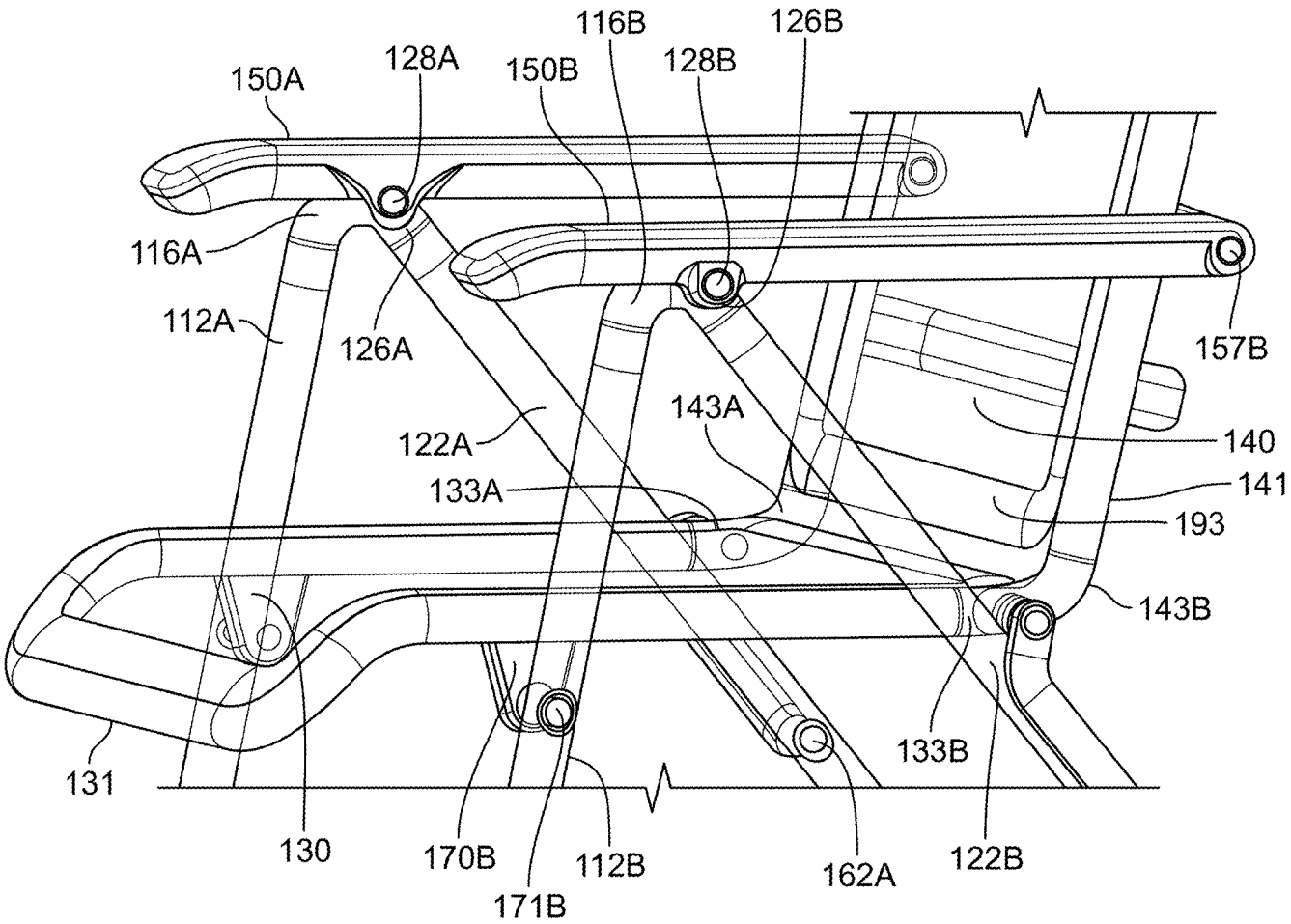
FIG. 3 is a side perspective view of the example portable chair of FIG. 1 according to one or more aspects described herein.

As shown in FIG. 3, at an upper and/or top proximal end portion, front leg 112A may intersect with front leg joinery interface 116A. In particular, front leg joinery interface 116A may include a tubular termination onto which front leg 112A may be configured to be inserted. Before, during, or after insertion, a binding agent and/or structural adhesive may be applied to the tubular termination of front leg joinery interface 116A and/or upper/top proximal end portion of front leg 112A to secure front leg 112A to the front leg joinery interface 116A. Such adhesives may include drying adhesives, pressure sensitive adhesives, contact adhesives, hot adhesives, reactive adhesives, multi-part adhesives, one-part adhesives. The adhesives may be either natural or synthetic and can be based on one or more of thermoplastics, emulsions, or thermosets, including one or more of epoxy, polyurethane, cyanoacrylate, or acrylic polymers. Additionally, and/or alternatively, front leg 112A may be welded onto front leg joinery interface 116A.

Front leg 112B may be configured to engage with front leg joinery interface 116B in the manner described in regard to front leg 112A and front leg joinery interface 116A (e.g., adhered and/or welded).

Similarly, at an upper and/or top proximal end portion, back leg 122A may intersect with back leg joinery interface 126A. In particular, back leg joinery interface 126A may include a tubular termination onto which back leg 122A may be configured to be inserted. Before, during, or after insertion, a binding agent and/or structural adhesive as discussed herein may be applied to the tubular termination of back leg joinery interface 126A and/or upper and/or top proximal end portion of back leg 122A to secure back leg 122A to the back leg joinery interface 126A. Additionally and/or alternatively, back leg 122A may be welded onto back leg joinery interface 126A. Back leg 122B may be configured to engage with back leg joinery interface 126B in the manner described in regard to back leg 122A and back leg joinery interface 126A (e.g., adhered and/or welded). Nevertheless, it is also contemplated that the joints discussed herein could be formed by mechanical fastening techniques, such as, friction fits, threads, ball and sockets, bayonet connections, and the like.

In certain arrangements, at an upper and/or top proximal end portion of front leg 112A, the front leg 112A may be bent in a rearward direction at an obtuse angle and may terminate at front leg joinery interface 116A. In some instances, front leg joinery interface 116A may be a continuous upper and/or top terminal end portion of front leg 110A and may be made of the same material as that of front leg 112A (e.g., aluminum, titanium, scandium, metal alloys, carbon fiber, and/or bamboo).

Back leg 122A may extend linearly to an upper and/or top proximal end portion and may terminate at back leg joinery interface 126A. Back leg joinery interface 126A may be a continuous upper and/or top terminal end portion of back leg 122A and may be made of the same material as that of back leg 122A (e.g., aluminum, titanium, scandium, metal alloys, carbon fiber, and/or bamboo).

Front leg joinery interfaces 116A, 116B may be configured to join, interface, and/or otherwise connect with back leg joinery interfaces 126A, 126B. In one example, the front joinery interfaces 116A, 116B and the back joinery interfaces 126A, 126B are configured to pivot about pins 128A, 128B such that the front legs 112A, 112B are configured to pivot relative to the back legs 122A, 122B.

Seat and Seat Frame

Portable chair 100 may include seat 130, which may be removably attached to seat frame 131. Front legs 112A and 112B may be configured to be rotatably joined and/or fastened to front leg attachment portions 170A and 170B, respectively, of seat frame 131 via pins 171A and 171B. The bushings 173A and 173B may extend between the front leg attachment portions 170A and 170B and the front legs 112A and 112B.

Seat frame 131 may be a cylindrical rod, tube, shaft, and/or extrusion I-beam and may be made of aluminum, titanium, stainless steel, scandium, metal alloys, carbon fiber, and/or bamboo. In instances in which aluminum, titanium, stainless steel, scandium, and/or metal alloys are used in the fabrication of seat frame 131, the material may be hydroformed and vacuum casted and may be treated through anodizing, plating, painting, powder coating, and/or the application of enamel in order to prevent corrosion induced by environmental conditions such as salt spray. Additionally, the metals used in the fabrication of seat frame 131 may be treated through annealing, case hardening, precipitation strengthening, tempering, normalizing, and/or quenching in order to increase hardness, toughness, and tensile and shear strength.

Seat frame 131 may include front leg attachment portions 170A and 170B, which may be configured to facilitate the rotatable attachment of seat frame 131 to front legs 112A and 112B, respectively, by way of pins 171A and 171B. Additionally, seat frame 131 may intersect with seat joinery interfaces 133A and 133B. In particular, seat joinery interfaces 133A and 133B may include tubular terminations onto which seat frame 131 may be configured to be inserted. Before, during, or after insertion, a binding agent and/or structural adhesive as discussed herein may be applied to the tubular terminations of seat joinery interfaces 133A and 133B and/or terminal ends of seat frame 131 to secure the seat frame 131 to the seat joinery interfaces 133A and 133B.

As shown in FIGS. 4B, 5A, 7A, and 7B, seat frame 131 may include carrying handle 172. Carrying handle 172 may be a front over-mold fixing extrusion that extends from an inner face of seat frame 131. The handle 172 may double as a large, easy-grip carry handle for carrying chair 100.

Carrying handle 172 may be positioned on an inner face of a front portion of seat frame 131 and may be made of the same material as that of seat frame 131 (e.g., aluminum, titanium, stainless steel, scandium, metal alloys, carbon fiber, and/or bamboo). As such, carrying handle 172 may be manufactured as a continuous piece of seat frame 131. Thus, in instances in which aluminum, titanium, stainless steel, scandium, and/or metal alloys are used in the fabrication of seat frame 131 and carrying handle 172, the material may be hydroformed and vacuum casted and into seat frame 131 and carrying handle 172 and may be treated through anodizing, plating, painting, powder coating, and/or the application of enamel in order to prevent corrosion induced by environmental conditions such as salt spray. Additionally, the metals used in the fabrication of seat frame 131 and carrying handle 172 may be treated through annealing, case hardening, precipitation strengthening, tempering, normalizing, and/or quenching in order to increase hardness, toughness, and tensile and shear strength.

Alternatively, carrying handle 172 may not form a continuous piece with seat frame 131 and, as such, may be a separate component. In such instances, carrying handle 172 may be made of either the same material as that of seat frame 131, or may be made of a different material. In either event, carrying handle 172 may be attached to seat frame 131 via adhesion, welding, mechanical fastening (e.g., nut and bolt), and the like.

First Embodiment of Seat/Seat Frame Engagement

Figure 4A:
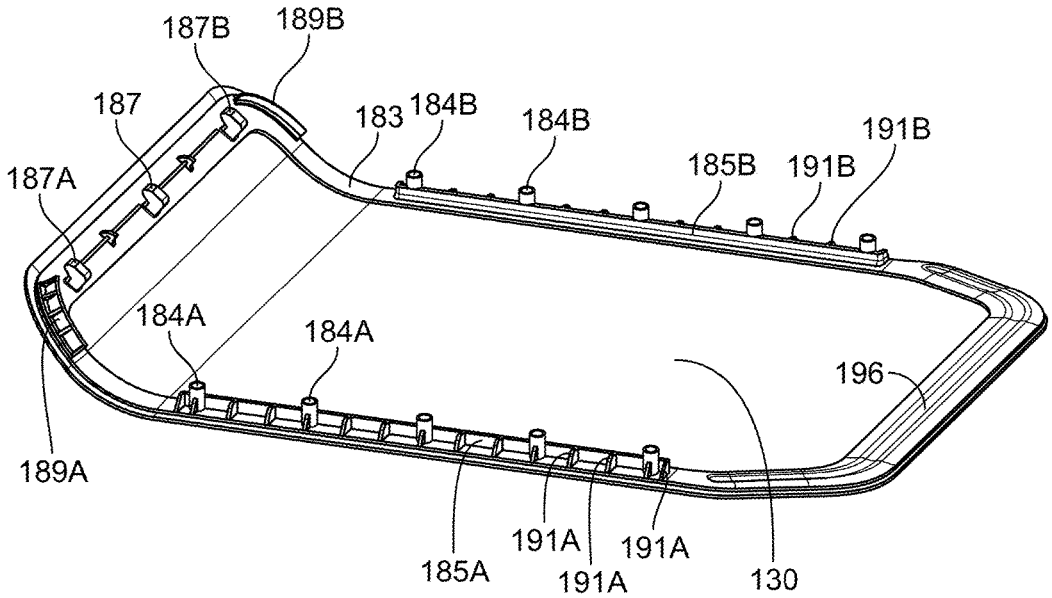
FIGS. 4A, 4B, 4C, and 4D respectively illustrate an underside perspective view of a first example seat, a top perspective view of a first example seat frame, a sectional view of the first example seat engaged with the first example seat frame, and an exploded view of components of the first example seat and the first example seat frame of the example portable chair of FIG. 1 according to one or more aspects described herein.
Figure 4B:
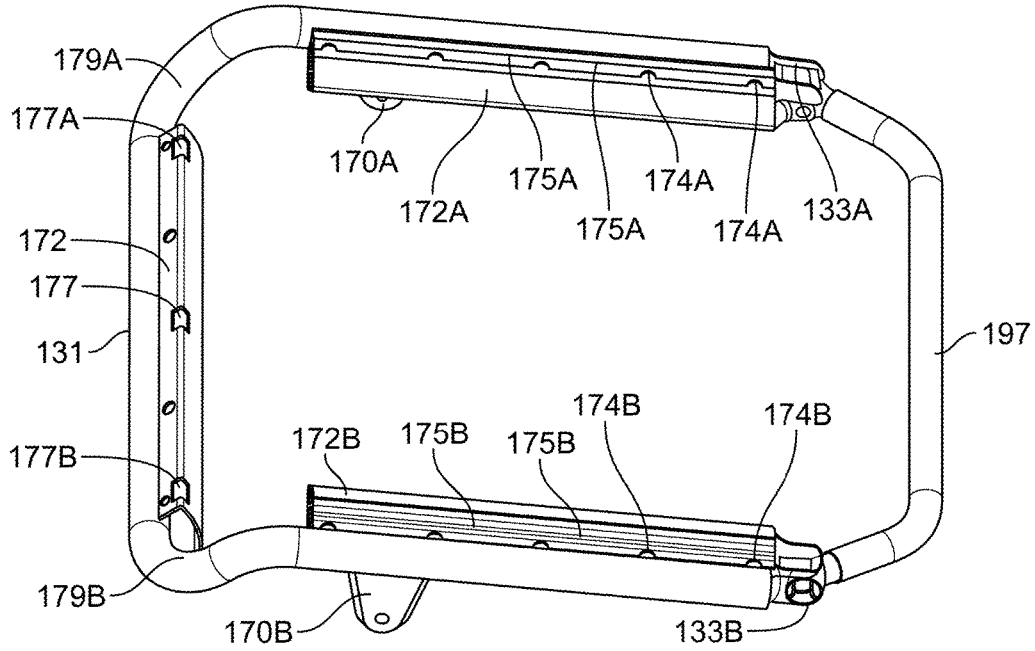

According to a first embodiment of the seat/seat frame engagement and as shown in FIG. 4B, carrying handle 172 may include front attachment hole 177B on a first side of carrying handle 172 (e.g., left side of carrying handle 172), front attachment hole 177A on a second side of carrying handle 172 (e.g., right side of carrying handle 172), and front attachment hole 177 on a third side of carrying handle 172 (e.g., center of carrying handle 172). As will be described in further detail below, front attachment holes 177, 177A, and 177B may be respectively configured to engage with front attachment clips 187, 187A, and 187B of seat 130.

Furthermore, seat frame 131 may also include seat attachment rail 172B. Seat attachment rail 172B may be positioned on an inner face of a side portion of seat frame 131 proximate to arm rest 150B, front leg 112B, and the like. Seat attachment rail 172B may be made of the same material as that of seat frame 131 (e.g., aluminum, titanium, stainless steel, scandium, metal alloys, carbon fiber, and/or bamboo). As such, seat attachment rail 172B may be manufactured as a continuous piece of seat frame 131. Thus, in instances in which aluminum, titanium, stainless steel, scandium, and/or metal alloys are used in the fabrication of seat frame 131 and seat attachment rail 172B, the material may be hydroformed and vacuum casted and into seat frame 131 and seat attachment rail 172B and may be treated through anodizing, plating, painting, powder coating, and/or the application of enamel in order to prevent corrosion induced by environmental conditions such as salt spray. Additionally, the metals used in the fabrication of seat frame 131 and seat attachment rail 172B may be treated through annealing, case hardening, precipitation strengthening, tempering, normalizing, and/or quenching in order to increase hardness, toughness, and tensile and shear strength.

Alternatively, seat attachment rail 172B may not form a continuous piece with seat frame 131 and, as such, may be a separate component. In such instances, seat attachment rail 172B may be made of either the same material as that of seat frame 131, or may be made of a different material. In either event, seat attachment rail 172B may be attached to seat frame 131 via adhesion, welding, mechanical fastening (e.g., nut and bolt), and the like.

Seat attachment rail 172B may include rib engagement channels and a plurality of side attachment holes. For example, as shown in FIG. 4B, seat attachment rail 172B may include rib engagement channels 175B and side attachment holes 174B. Rib engagement channels 175B may run along the entirety of the length of seat attachment rail 172B. Rib engagement channels 175B may be configured to support side ribs 185B and flanges 191B of seat 130. A plurality of side attachment holes 174B may be positioned on the rib engagement channels 175B. Each of the side attachment holes 174B may be configured to receive a side attachment screw interface 184B of seat 130. While five side attachment holes 174B are depicted in FIG. 4B, a fewer number (e.g., one, two, three, or four) or a greater number (six, ten, etc.) of side attachment holes 174B may be included.

Seat frame 131 may also include seat attachment rail 172A. Seat attachment rail 172A may be positioned on an inner face of a side portion of seat frame 131 proximate to arm rest 150A, front leg 112A, and the like. Seat attachment rail 172A may be made of the same material as that of seat frame 131 (e.g., aluminum, titanium, stainless steel, scandium, metal alloys, carbon fiber, and/or bamboo). As such, seat attachment rail 172A may be manufactured as a continuous piece of seat frame 131. Thus, in instances in which aluminum, titanium, stainless steel, scandium, and/or metal alloys are used in the fabrication of seat frame 131 and seat attachment rail 172A, the material may be hydroformed and vacuum casted and into seat frame 131 and seat attachment rail 172A and may be treated through anodizing, plating, painting, powder coating, and/or the application of enamel in order to prevent corrosion induced by environmental conditions such as salt spray. Additionally, the metals used in the fabrication of seat frame 131 and seat attachment rail 172A may be treated through annealing, case hardening, precipitation strengthening, tempering, normalizing, and/or quenching in order to increase hardness, toughness, and tensile and shear strength.

Alternatively, seat attachment rail 172A may not form a continuous piece with seat frame 131 and, as such, may be a separate component. In such instances, seat attachment rail 172A may be made of either the same material as that of seat frame 131, or may be made of a different material. In either event, seat attachment rail 172A may be attached to seat frame 131 via adhesion, welding, mechanical fastening (e.g., nut and bolt), and the like.

Seat attachment rail 172A may include rib engagement channels and a plurality of side attachment holes. For example, as shown in FIG. 4B, seat attachment rail 172A may include rib engagement channels 175A and side attachment holes 174A. Rib engagement channels 175A may run along the entirety of the length of seat attachment rail 172A. Rib engagement channels 175A may be configured to support side ribs 185A and flanges 191A of seat 130. A plurality of side attachment holes 174A may be positioned on the rib engagement channels 175A. Each of the side attachment holes 174A may be configured to receive a side attachment screw interface 184A of seat 130. While five side attachment holes 174A are depicted in FIG. 4B, a fewer number (e.g., one, two, three, or four) or a greater number (six, ten, etc.) of side attachment holes 174A may be included.

Referring to FIG. 4A, seat 130 may be composed of any of a number of materials including, but not limited to, armored fabric cloth, sail fabric, awning fabric, Kevlar, tarp canvas, vinyl coated polyester, nylon mesh, neoprene, aluminized nylon, and/or cotton canvas. In some embodiments, the material may be treated to provide increased UV stabilization and weathering resistance, fire-resistance, abrasion and tear resistance, and waterproofing.

The material used in the fabrication of seat 130 may be manufactured in a highly-permeable, weave-type and/or mesh-like construction and, as such, may provide for increased load capacity and user comfort. The perimeter of the weave-type and/or mesh-like fabric construction of seat 130 may be configured to interface with seat frame border 183, which may be a rigid thermoplastic over-mold. In forming the interface between seat 130 and seat frame border 183, seat frame border 183 may be over-molded onto seat 130 through a method of local injection molding. The process may form a thermoplastic feature (e.g., seat frame border 183 and components included therein) through the fabric weave along the perimeter of seat 130. After the method of local injection molding is completed, the weave-type and/or mesh-like fabric construction of seat 130 may be taut and the seat frame border 183 may be rigidly attached to seat 130. Such an attachment method may eliminate stitching in the seat fabric and, by extension, offer advantages including repeatability, durability, dimensional accuracy, frame attachment flexibility and improved aesthetics.

Seat frame border 183 may include a plurality of protrusions of various types configured to aide and/or facilitate the engagement between seat 130 and seat frame 131. In particular, seat frame border 183 may include front attachment clips 187, 187A, and 187B, seat frame corner engagement faces 189A and 189B, side attachment screw interfaces 184A and 184B, side ribs 185A and 185B, flanges 191A and 191B, and back bar groove 196.

Seat 130 may be configured to be removably attached and/or engaged with seat frame 131. In forming the removable attachment and/or engagement, the various protrusions of seat frame border 183 of seat 130 may be configured to removably connect, insert, and/or interface with specific aspects of front handle 172 and seat attachment rails 172A and 172B. For example, front attachment clips 187, 187A, and 187B and side attachment screw interfaces 184A and 184B of seat frame border 183 may be respectively configured to be removably connected, inserted, and/or interfaced with front attachment holes 177, 177A, and 177B of carrying handle 172 and side attachment holes 174A and 174B of seat attachment rails 172A and 172B. Additionally, seat frame corner engagement faces 189A and 189B and back bar groove 196 of seat frame border 183 of seat 130 may be respectively configured to removably interface with seat frame corners 179A and 179B of seat frame 131 and back bar 197.

Further, side ribs 185A and 185B and flanges 191A and 191B of seat frame border 183 of seat 130 may be configured to removably interface with rib engagement channels 175A and 175B of seat attachment rails 172A and 172B. Side ribs 185A, 185B may be load carrying ribs and may be configured to interface with rib engagement channels 175A, 175B of seat attachment rails 172A, 172B. The side ribs 185A, 185B may extend from a bottom surface of a right and left side of the seat frame border 183 and flanges 191A, 191B may be located on each side of the seat frame border 183. The series of flanges 191A, 191B can extend perpendicular to a bottom surface of the seat frame border 183 and an outer face of the side ribs 175A, 175B. The side ribs 185A, 185B and the series of flanges 191A, 191B can prevent the side ribs from twisting when the seat is loaded. As such, the side ribs 185A, 185B and the flanges 191A, 191B may relieve structural loading from the side attachment screw interfaces 184A, 184B when seat 130 and seat frame 131 are in either of an attached or detached state and may also provide a complimentary force to that provided by side attachment screw interfaces 184A, 184B in a state in which seat 130 is attached to seat frame 131. In an attached stated, the side ribs 185A, 185B may traverse the length of seat attachment rails 172A, 172B and the flanges 191A, 191B may span the horizontal area of the seat attachment rails 172A, 172B. The number of flanges 191A, 191B can be selected based on the desired threshold loading of the chair, the thickness of each flange, and the weight distribution of the chair.

Figure 4C:
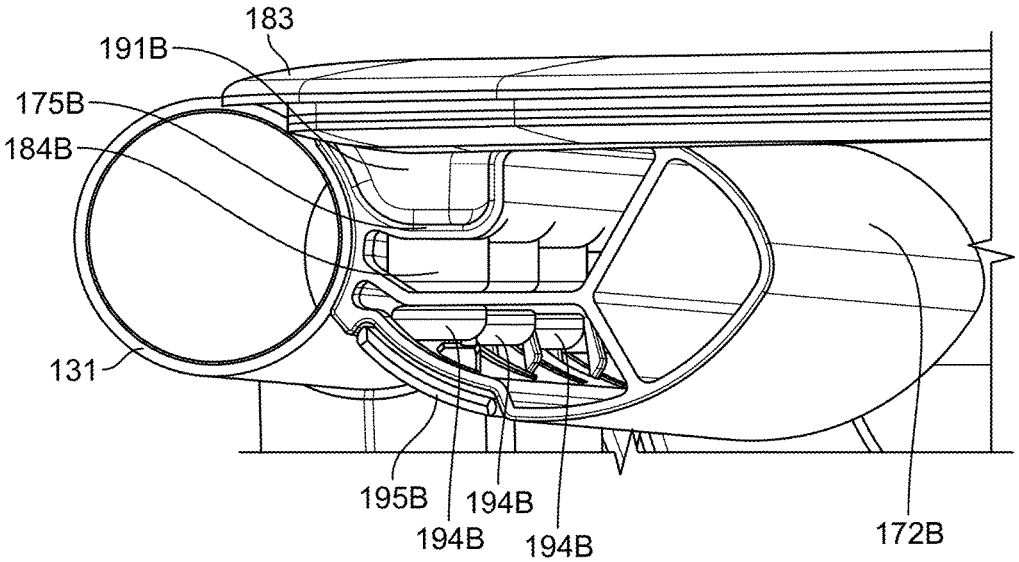
Figure 4D:
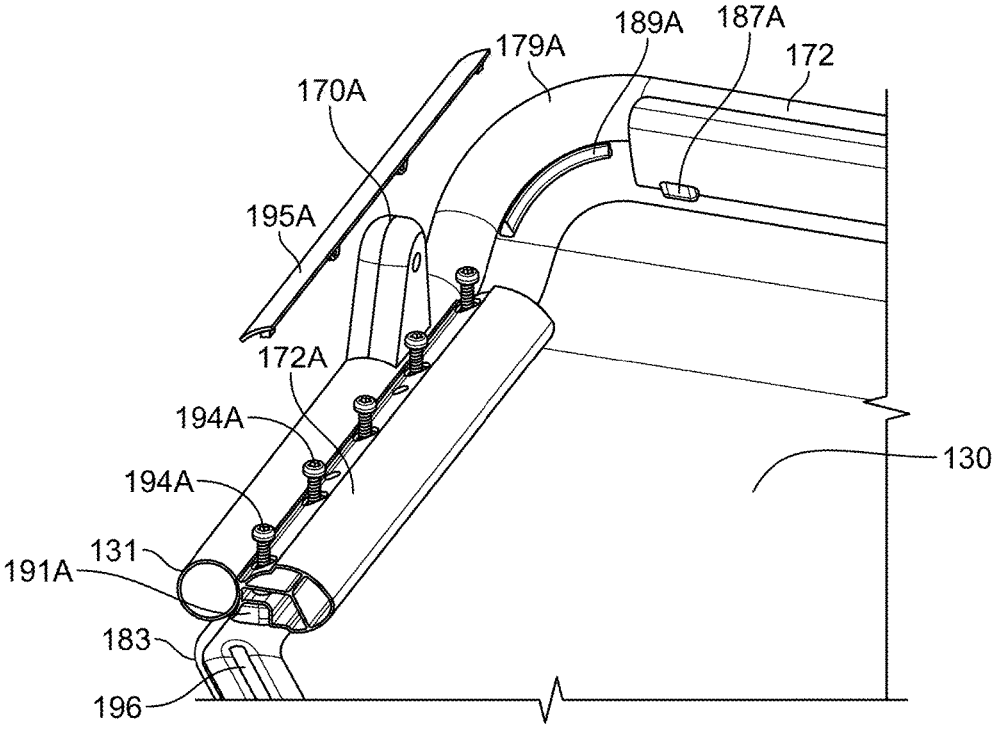

Referring in greater detail to FIGS. 4C and 4D, side attachment screw interface 184B may be configured to be inserted through side attachment hole 174B during the formation of the removable attachment between seat 130 and seat frame 131. Side attachment screw interface 184B may be configured to receive screw 194B in order to fasten seat 130 to seat frame 131. For instance, side attachment screw interface 184B may be inserted through side attachment hole 174B. Screw access panel 195B may be removed from side rail 172B to expose side attachment screw interface 184B. After removal of screw access panel 195B, screw 194B may be rotatably inserted into side attachment screw interface 184B. Similarly, screws 194B may be rotatably inserted into each of the side attachment screw interfaces 184B. After each of the screws 194B have been inserted into the side attachment screw interfaces 184B, the screw access panel 195B may be reattached to side attachment rail 172B. A similar process may be performed for side attachment screw interfaces 184A, side attachment holes 178A, screw access panel 195A, and screws 195A.

In the manner described above, seat 130, by way of seat frame border 183 and the plurality of protrusions formed thereto, may be configured to engage with the side attachment rails 172A and 172B and carrying handle 172 of seat frame 131. In some instances, the seat frame border 183 may be secured to seat frame 131 by locating a first end (e.g., front portion) of seat frame border 183 into a first end (e.g., front portion) of the seat frame 131 and rolling and/or flexing the seat frame border 183 from the first end of the seat frame 131 to a second end (e.g., back portion) of the seat frame 131. The rolling and/or flexing of the seat frame border 183 from the first end of the seat frame 131 to the second end may cause the plurality of protrusions of the seat frame border 183 to align with the plurality of slots in the seat attachment rails and to removably attach the seat frame border 183 on the seat frame 131.

Alternatively, seat frame border 183 may be secured to seat frame 131 by inserting the rearmost side attachment screw interface 184B on the left side of the seat frame border 183 into the rearmost side attachment hole 174B of the left side attachment rail 172B and inserting the rearmost side attachment screw interface 184A on the right side of the seat frame border 183 into the rearmost side attachment hole 174A of the right side attachment rail 172A. Next, the first, second, and third middle side attachment screw interfaces 184B on the left side of the seat frame border 183 may be inserted into the first, second, and third middle side attachment holes 174B of the left side attachment rail 172B. Similarly, the first, second, and third middle side attachment screw interfaces 184A on the right side of the seat frame border 183 may be inserted into the first, second, and third middle side attachment holes 174A of the right side attachment rail 172A. Subsequently, the frontmost side attachment screw interface 184B on the left side of the seat frame border 183 may be inserted into the frontmost side attachment hole 174B of the left side attachment rail 172B and the frontmost side attachment screw interface 184A on the right side of the seat frame border 183 may be inserted into the frontmost side attachment hole 174A of the right side attachment rail 172A. Then, the seat 130, by way of the seat frame border 183, may be rolled and/or flexed at a front portion of the seat 130 in a downward direction to align and insert the front attachment clips 187, 187A, and 187B of the seat frame border 183 with the front attachment holes 177, 177A, and 177B of the carrying handle 172 and the front attachment clip on the right side of the seat frame border 183 with the front attachment hole on the right end portion of the carrying handle 172. Next, the screw access panels 195A and 195B may be removed from the side attachment rails 172A and 172B, and each of the screws 194A and 194B may be threaded into the respective side attachment screw interfaces 184A and 184B. After insertion, the screw access panels 195A and 195B may be reattached to side attachment rails 172A and 172B.

During the assembly of the seat frame border 183 to the seat frame 131, the seat frame border 183 can be rolled from a rear end to a front end. While such steps are described in a specific order from rear to front, the steps need not be performed in such an order and may be performed in any specific order.

Furthermore, in the state in which seat 130 is attached to seat frame 131, as shown in FIG. 4C, seat frame border 183 may interface with an outer portion of seat frame 131. In some instances, seat frame border 183 may be machined after the injection molding process described above in order to allow for cosmetic control of the seat frame border-seat frame interface.

Second Embodiment of Seat/Seat Frame Engagement

Figure 5A:
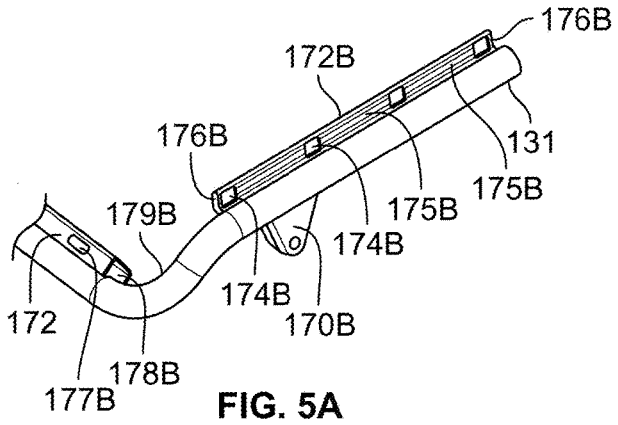
FIGS. 5A, 5B, 5C, 5D, and 5E respectively illustrate a front perspective view of a second example seat frame, a front perspective view of a second example seat, an underside perspective view of the second example seat, a sectional view of the second example seat engaged with the second example seat frame, and a front perspective view of the second example seat engaged with the second example seat frame of the example portable chair of FIG. 1 according to one or more aspects described herein.
Figure 5B:
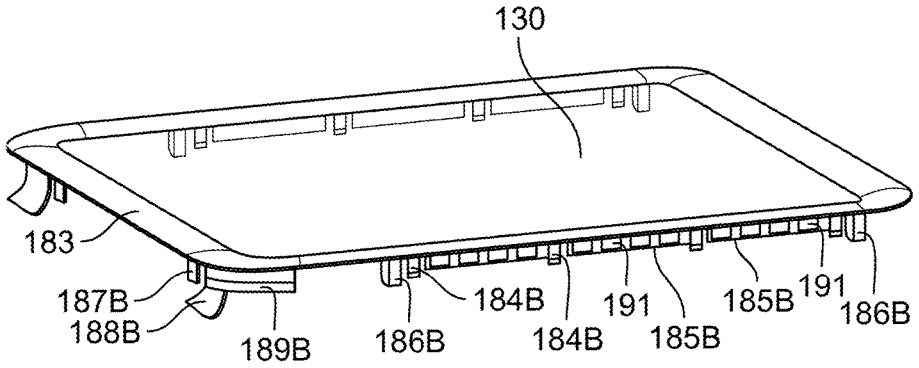
Figure 5C:
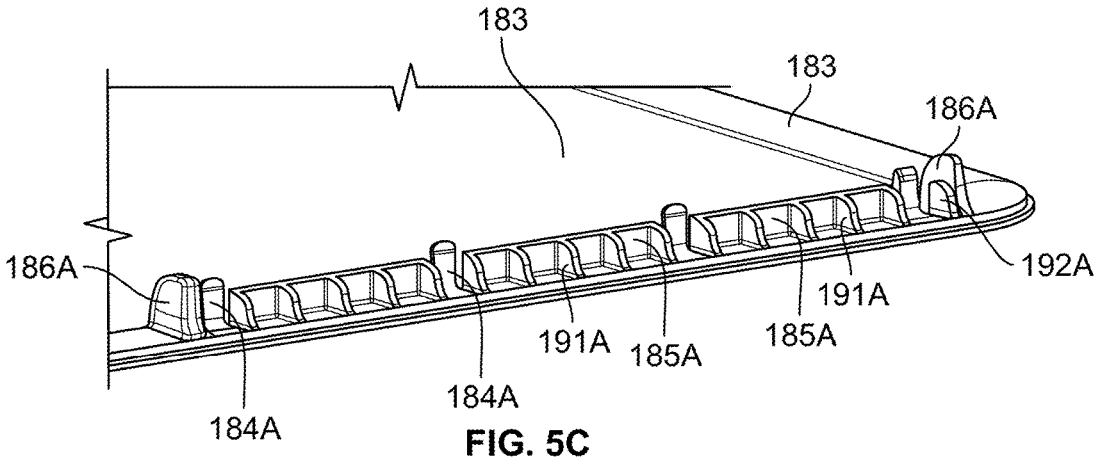

According to a second embodiment of the seat/seat frame engagement and as shown in FIG. 5A, carrying handle 172 may include front attachment hole 177B and side opening 178B on a first side of carrying handle 172 (e.g., left side of carrying handle 172), front attachment hole 177A and side opening 178A on a second side of carrying handle 172 (e.g., right side of carrying handle 172), and front attachment hole 177 on a third side of carrying handle 172 (e.g., center of carrying handle 172). As will be described in further detail below, front attachment hole 177B and side opening 178B may be configured to engage with front attachment clip 187B and carrying handle side cover 188B, respectively, of seat 130 as shown in FIG. 5B. As noted above, the components (e.g., carrying handle 172) of chair 100 which extend from the left side to the right side of chair 100 may be of a symmetric construction. Thus, carrying handle 172 may further include a front seat attachment hole and side opening on a second side of carrying handle 172 (e.g., right side of carrying handle 172) of an orientation and construction similar to that of front seat attachment hole 177B and side opening 178B.

Returning to FIG. 5A, seat frame 131 may also include seat attachment rail 172B. Seat attachment rail 172B may be positioned on an inner face of a side portion of seat frame 131 proximate to arm rest 150B, front leg 112B, and the like. Seat attachment rail 172B may be made of the same material as that of seat frame 131 (e.g., aluminum, titanium, stainless steel, scandium, metal alloys, carbon fiber, and/or bamboo). As such, seat attachment rail 172B may be manufactured as a continuous piece of seat frame 131. Thus, in instances in which aluminum, titanium, stainless steel, scandium, and/or metal alloys are used in the fabrication of seat frame 131 and seat attachment rail 172B, the material may be hydroformed and vacuum casted and into seat frame 131 and seat attachment rail 172B and may be treated through anodizing, plating, painting, powder coating, and/or the application of enamel in order to prevent corrosion induced by environmental conditions such as salt spray. Additionally, the metals used in the fabrication of seat frame 13 land seat attachment rail 172B may be treated through annealing, case hardening, precipitation strengthening, tempering, normalizing, and/or quenching in order to increase hardness, toughness, and tensile and shear strength.

Alternatively, seat attachment rail 172B may not form a continuous piece with seat frame 131 and, as such, may be a separate component. In such instances, seat attachment rail 172B may be made of either the same material as that of seat frame 131, or may be made of a different material. In either event, seat attachment rail 172B may be attached to seat frame 131 via adhesion, welding, mechanical fastening (e.g., nut and bolt), and the like.

Seat attachment rail 172B may include side openings, rib engagement channels, and a plurality of side attachment holes. For example, as shown in FIG. 5A, seat attachment rail 172B may include side openings 176B (e.g., distal and proximal side openings), rib engagement channels 175B, and side attachment holes 174B. Side openings 176B may provide openings through which the interior and/or internal portion of seat attachment rail 172B may be accessed. The side openings 176B may be configured to be covered by seat attachment rail side covers 186B of seat 130. The rail side covers 186 may be provided with integral ribs 192 to provide additional support of the seat frame border. Rib engagement channels 175B may run along the entirety of the length of seat attachment rail 172B from the first side opening 176B (e.g., distal side opening furthest from back 140) to the second side opening 176B (e.g., proximal side opening closest to back 140) along a line parallel to the face of seat frame 131 on which seat attachment rail 172B is attached. Rib engagement channels 175B may be configured to support side ribs 185B of seat 130. A plurality of side attachment holes 174B may be positioned on the rib engagement channels 175B. Each of the side attachment holes 174B may be configured to receive a side attachment clip 184B of seat 130. While four side attachment holes 174B are depicted in FIG. 4B, a fewer number (e.g., one, two, or three) or a greater number (five, six, ten, etc.) of side attachment holes 174B may be included. Seat frame 131 may further include an additional seat attachment rail that is positioned on the opposite inner face of the opposite side portion of seat frame 131 to that of seat attachment rail 172B. The additional seat attachment rail may be similar to that of seat attachment rail 172B.

Referring to FIG. 5B, seat frame border 183 may include a plurality of protrusions of various types configured to aide and/or facilitate the engagement between seat 130 and seat frame 131. In particular, seat frame border 183 may include front attachment clip 187B, carrying handle side cover 188B, seat frame corner engagement face 189B, seat attachment rail side covers 186B, side attachment clips 184B, and side ribs 185B. Each of such protrusions may be positioned on the left side of seat 130 and may be proximate to front leg 112B, arm rest 150B, and the like in a state in which seat 130 is engaged with seat frame 131. Furthermore, seat 130 may additionally include a front attachment clip, carrying handle side cover, seat frame corner engagement faces, seat attachment rail side covers, side attachment clips, and side ribs on the right side of seat 130. Such protrusions may be similar to those on the left side of seat 130 (e.g., front attachment clip 187B, carrying handle side cover 188B, seat frame corner engagement face 189B, etc.) but at a mirrored orientation on the right side of seat 130. As such, in a state in which seat 130 is engaged with seat frame 131, such protrusions on the right side of seat 130 may be proximate to front leg 112A, arm rest 150A, and the like.

Seat 130 may be configured to be removably attached and/or engaged with seat frame 131. In forming the removable attachment and/or engagement, the various protrusions of seat frame border 183 of seat 130 may be configured to removably connect and/or interface with specific aspects of front handle 172 and seat attachment rail 172B. For example, front attachment clip 187B and side attachment clips 184B of seat frame border 183 may be configured, respectively, to be removably connected and/or interfaced with front attachment hole 177B of carrying handle 172 and side attachment holes 174B of seat attachment rail 172B of seat frame 131. Further, carrying handle side cover 188B and seat attachment rail side covers 186B of seat frame border 183 of seat 130 may be configured, respectively, to removably interface with side openings 178B of carrying handle 172 and side openings 176B of seat attachment rail 172B of seat frame 131. Additionally, seat frame corner engagement face 189B and side ribs 185B of seat frame border 183 of seat 130 may be configured, respectively, to removably interface with seat frame corner 179B of seat frame 131 and rib engagement channel 175B of seat attachment rail 172B. The aforementioned connections and/or interfacings may occur on the left side of chair 100. In a state in which seat 130 is removably attached and/or engaged with seat frame 131, such connections and/or interfacings may be proximate to front leg 112B, arm rest 150B, and the like.

Similarly, the front attachment clip, carrying handle side cover, seat frame corner engagement face, seat attachment rail side covers, side attachment clips, and side ribs on the right side of the seat frame border 183 of seat 130 may be configured to removably connect and/or interface with the front seat attachment hole and side opening on the right side of carrying handle 172, the seat frame corner on the right side of seat frame 131, and the side openings, rib engagement channel, and plurality of side attachment holes of the seat attachment rail on the right side of seat frame 131 in the manner described above.

Figure 5D:
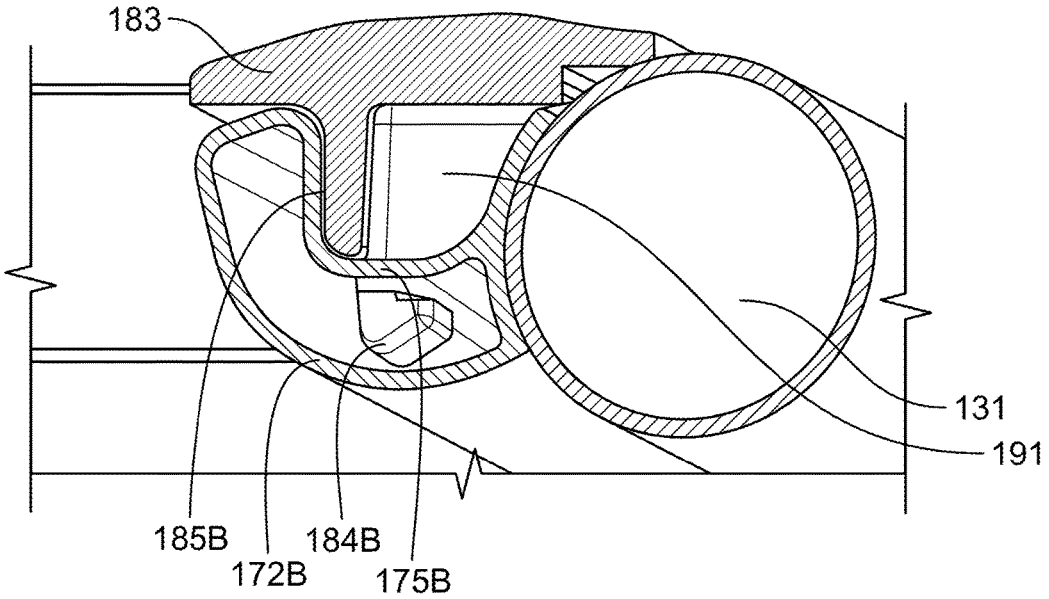
Figure 5E:
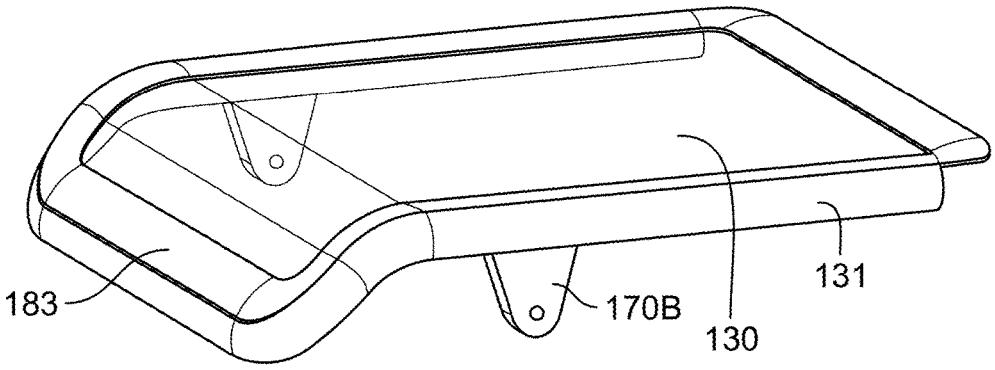

Referring in greater detail to FIG. 5D, side attachment clip 184B may be configured to be inserted through side attachment hole 174B during the formation of the removable attachment between seat 130 and seat frame 131. Side attachment clip 184B may have an extended rectangular construct with a half-arrow shaped distal end, which may allow for rotational pliability during insertion and removal, as well as for vertical force distribution during engagement. For instance, during insertion into side attachment hole 174B, a rotational force may be applied to the outer face of the half-arrow terminal end of side attachment clip 184B. In response to the rotational force, side attachment clip 184B may be configured to rotatably displace and allow for the insertion of side attachment clip 184B into side attachment hole 174B. After insertion has been completed and the rotational force has been removed, the side attachment clip 184B may be configured to return to a static position and an upper and/or overhang face of the half-arrow portion of side attachment clip 184B may be configured to interface with a bottommost face of rib engagement channel 175B of seat attachment rail 172B. Such an interface provided by side attachment clip 184B, in combination with the other side and front attachment clips, may provide for the removable attachment of seat 130 to seat 131.

Side ribs 185A, 185B may be load carrying ribs and may be configured to interface with rib engagement channels 175A, 175B of seat attachment rails 172A, 172B. The side ribs 185A, 185B may extend from a bottom surface of a right and left side of the seat frame border 183 and a series of flanges 191 may be located on each side of the seat frame border 183. The series of flanges 191 can extend perpendicular to a bottom surface of the seat frame border 183. The series of flanges 191 and the bottom surface of the seat frame border 183 can prevent the side ribs from twisting when the seat is loaded. As such, the side ribs 185A, 185B and the flanges 191 may relieve structural loading from the side attachment clips 184A, 184B and the other side attachment clips during use when seat 130 and seat frame 131 are in either of an attached or detached state and may also provide a complimentary force to that provided by side attachment clips 184A, 184B in a state in which seat 130 is attached to seat frame 131. The number of side ribs 185 can be selected based on the desired threshold loading of the chair, the thickness of each side rib, and the weight distribution of the chair. Additionally, it is also contemplated that the side ribs can be formed of an integral extending rib running the length of the channel of the attachment rails 175A, 175B.

In the manner described above, seat 130, by way of seat frame border 183 and the plurality of protrusions formed thereto, may be configured to engage with the side attachment rails and carrying handle 172 of seat frame 131. In particular, the seat frame border 183 may be secured to seat frame 131 by locating a first end (e.g., front portion) of seat frame border 183 into a first end (e.g., front portion) of the seat frame 131 and rolling and/or flexing the seat frame border 183 from the first end of the seat frame 131 to a second end (e.g., back portion) of the seat frame 131. The rolling and/or flexing of the seat frame border 183 from the first end of the seat frame 131 to the second end may cause the plurality of protrusions of the seat frame border 183 to align with the plurality of slots in the seat attachment rails and to removably attach the seat frame border 183 on the seat frame 131.

Alternatively, seat frame border 183 may be secured to seat frame 131 by inserting the rearmost side attachment clip 186B on the left side of the seat frame border 183 into the rearmost side attachment hole 176B of the left side attachment rail 172B and inserting the rearmost side attachment clip on the right side of the seat frame border 183 into the rearmost side attachment hole of the right side attachment rail. Next, the first middle side attachment clip 186B and the second middle side attachment clip 186B on the left side of the seat frame border 183 may be inserted into the first middle side attachment hole 176B and the second middle side attachment hole 176B of the left side attachment rail 172B and the first middle side attachment clip and the second middle side attachment clip on the right side of the seat frame border 183 may be inserted into the first middle side attachment hole and the second middle side attachment hole of the right side attachment rail. Subsequently, the frontmost side attachment clip 186B on the left side of the seat frame border 183 may be inserted into the frontmost side attachment hole 176B of the left side attachment rail 176B and the frontmost side attachment clip on the right side of the seat frame border 183 may be inserted into the frontmost side attachment hole of the right side attachment rail. Then, the seat 130, by way of the seat frame border 183, may be rolled and/or flexed at a front portion of the seat 130 in a downward direction to align the front attachment clip 187B on the left side of the seat frame border 183 with the front attachment hole 177B on the left end portion of the carrying handle 172 and the front attachment clip on the right side of the seat frame border 183 with the front attachment hole on the right end portion of the carrying handle 183. Next, the front attachment clip 187B on the left side of the seat frame border 183 may be inserted into the front attachment hole 177B on the left end portion of the carrying handle 172 and the front attachment clip on the right side of the seat frame border 183 may be inserted into the front attachment hole on the right end portion of the carrying handle 172.

During the assembly of the seat frame border 183 with the seat frame 131, the seat frame border 183 can be rolled from a rear end to a front end. While such steps are described in a specific order from rear to front, the steps need not be performed in such an order and may be performed in any specific order.

Back and Back Frame

In conjunction with seat 130, portable chair 100 may include back 140, which may be removably attached to back frame 141. Back frame 141 may be a cylindrical rod, tube, shaft, and/or extrusion I-beam and may be made of aluminum, titanium, stainless steel, scandium, metal alloys, carbon fiber, and/or bamboo. In instances in which aluminum, titanium, stainless steel, scandium, and/or metal alloys are used in the fabrication of back frame 141, the material may be hydroformed and vacuum casted and may be treated through anodizing, plating, painting, powder coating, and/or the application of enamel in order to prevent corrosion induced by environmental conditions such as salt spray. Additionally, the metals used in the fabrication of back frame 141 may be treated through annealing, case hardening, precipitation strengthening, tempering, normalizing, and/or quenching in order to increase hardness, toughness, and tensile and shear strength.

Back frame 141 may include arm rest attachment portions, which may be configured to facilitate the rotatable attachment of back frame 141 to arm rests 150A and 150B by way of pins including pin 157B. Additionally, back frame 141 may intersect with back joinery interfaces 143A and 143B. In particular, back joinery interfaces 143A and 143B may include tubular terminations onto which back frame 141 may be configured to be inserted. Before, during, or after insertion, a binding agent and/or structural adhesive may be applied to the tubular terminations of back joinery interfaces 143A and 143B and/or terminal ends of back frame 141 to secure the back frame 141 to the back joinery interfaces 143A and 143B.

In a manner similar to that described above in regard to seat frame 131, back frame 141 may include a carrying handle and one or more back attachment rails. For example, as shown in FIG. 6B, carrying handle 272 may include top attachment hole 277B on a first side of carrying handle 272 (e.g., left side of carrying handle 272), top attachment hole 277A on a second side of carrying handle 272 (e.g., right side of carrying handle 172), and top attachment hole 277 on a third side of carrying handle 272 (e.g., center of carrying handle 272). As will be described in further detail below, top attachment holes 277, 277A, and 277B may be respectively configured to engage with top attachment clips 287, 287A, and 287B of back 140.

Furthermore, back frame 141 may also include back attachment rail 272B. Back attachment rail 272B may be positioned on an inner face of a side portion of back frame 141 proximate to arm rest 150B, front leg 112B, and the like. Back attachment rail 272B may be made of the same material as that of back frame 141 (e.g., aluminum, titanium, stainless steel, scandium, metal alloys, carbon fiber, and/or bamboo). As such, back attachment rail 272B may be manufactured as a continuous piece of back frame 141. Thus, in instances in which aluminum, titanium, stainless steel, scandium, and/or metal alloys are used in the fabrication of back frame 141 and back attachment rail 272B, the material may be hydroformed and vacuum casted and into back frame 141 and back attachment rail 272B and may be treated through anodizing, plating, painting, powder coating, and/or the application of enamel in order to prevent corrosion induced by environmental conditions such as salt spray. Additionally, the metals used in the fabrication of back frame 141 and back attachment rail 272B may be treated through annealing, case hardening, precipitation strengthening, tempering, normalizing, and/or quenching in order to increase hardness, toughness, and tensile and shear strength.

Alternatively, back attachment rail 272B may not form a continuous piece with back frame 141 and, as such, may be a separate component. In such instances, back attachment rail 272B may be made of either the same material as that of back frame 141, or may be made of a different material. In either event, back attachment rail 272B may be attached to back frame 141 via adhesion, welding, mechanical fastening (e.g., nut and bolt), and the like.

Back attachment rail 272B may include rib engagement channels and a plurality of side attachment holes. For example, as shown in FIG. 6B, back attachment rail 272B may include rib engagement channels 275B and side attachment holes 274B. Rib engagement channels 275B may run along the entirety of the length of back attachment rail 272B. Rib engagement channels 275B may be configured to support side ribs 285B and flanges 291B of back 140. A plurality of side attachment holes 274B may be positioned on the rib engagement channels 275B. Each of the side attachment holes 274B may be configured to receive a side attachment screw interface 284B of back 140. While five side attachment holes 274B are depicted in FIG. 6B, a fewer number (e.g., one, two, three, or four) or a greater number (six, ten, etc.) of side attachment holes 274B may be included.

Back frame 141 may also include back attachment rail 272A. Back attachment rail 272A may be positioned on an inner face of a side portion of back frame 141 proximate to arm rest 150A, front leg 112A, and the like. Back attachment rail 272A may be made of the same material as that of back frame 141 (e.g., aluminum, titanium, stainless steel, scandium, metal alloys, carbon fiber, and/or bamboo). As such, back attachment rail 272A may be manufactured as a continuous piece of back frame 141. Thus, in instances in which aluminum, titanium, stainless steel, scandium, and/or metal alloys are used in the fabrication of back frame 141 and back attachment rail 272A, the material may be hydroformed and vacuum casted and into back frame 141 and back attachment rail 272A and may be treated through anodizing, plating, painting, powder coating, and/or the application of enamel in order to prevent corrosion induced by environmental conditions such as salt spray. Additionally, the metals used in the fabrication of back frame 141 and back attachment rail 272A may be treated through annealing, case hardening, precipitation strengthening, tempering, normalizing, and/or quenching in order to increase hardness, toughness, and tensile and shear strength.

Alternatively, back attachment rail 272A may not form a continuous piece with back frame 141 and, as such, may be a separate component. In such instances, back attachment rail 272A may be made of either the same material as that of back frame 141, or may be made of a different material. In either event, back attachment rail 272A may be attached to back frame 141 via adhesion, welding, mechanical fastening (e.g., nut and bolt), and the like.

Back attachment rail 272A may include rib engagement channels and a plurality of side attachment holes. For example, as shown in FIG. 6B, back attachment rail 272A may include rib engagement channels 275A and side attachment holes 274A. Rib engagement channels 275A may run along the entirety of the length of back attachment rail 272A. Rib engagement channels 275A may be configured to support side ribs 285A and flanges 291A of back 140. A plurality of side attachment holes 274A may be positioned on the rib engagement channels 275A. Each of the side attachment holes 274A may be configured to receive a side attachment screw interface 284A of back 140. While five side attachment holes 274A are depicted in FIG. 6B, a fewer number (e.g., one, two, three, or four) or a greater number (six, ten, etc.) of side attachment holes 274A may be included.

Figure 6A:
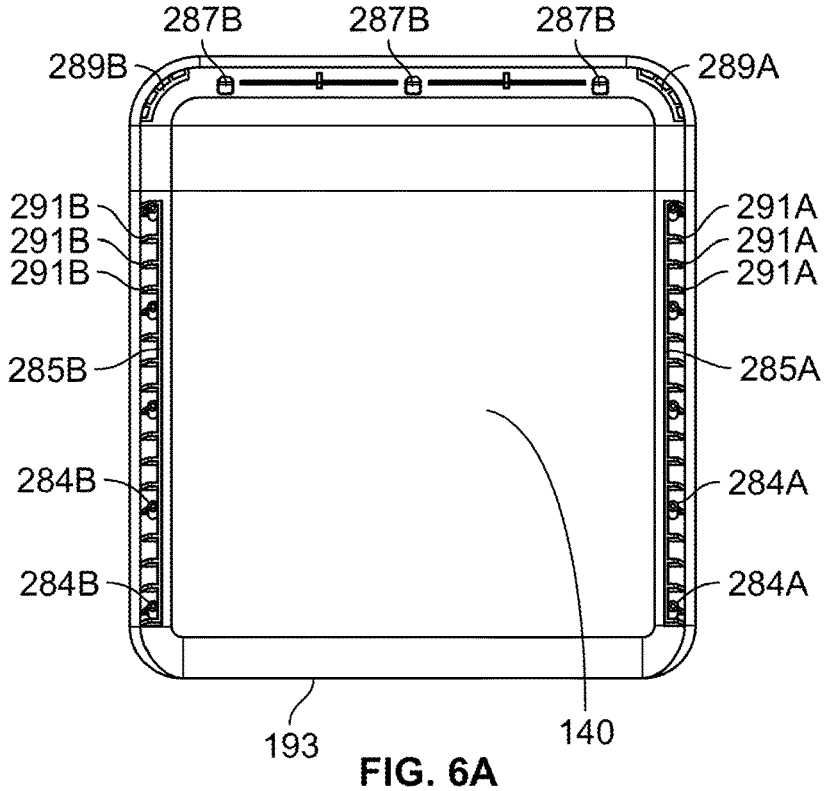
FIGS. 6A, 6B, and 6C respectively illustrate a rear view of an example back, a front view of an example back frame, and a sectional view of the example back engaged with the example back frame of the example portable chair of FIG. 1 according to one or more aspects described herein.
Figure 6B:
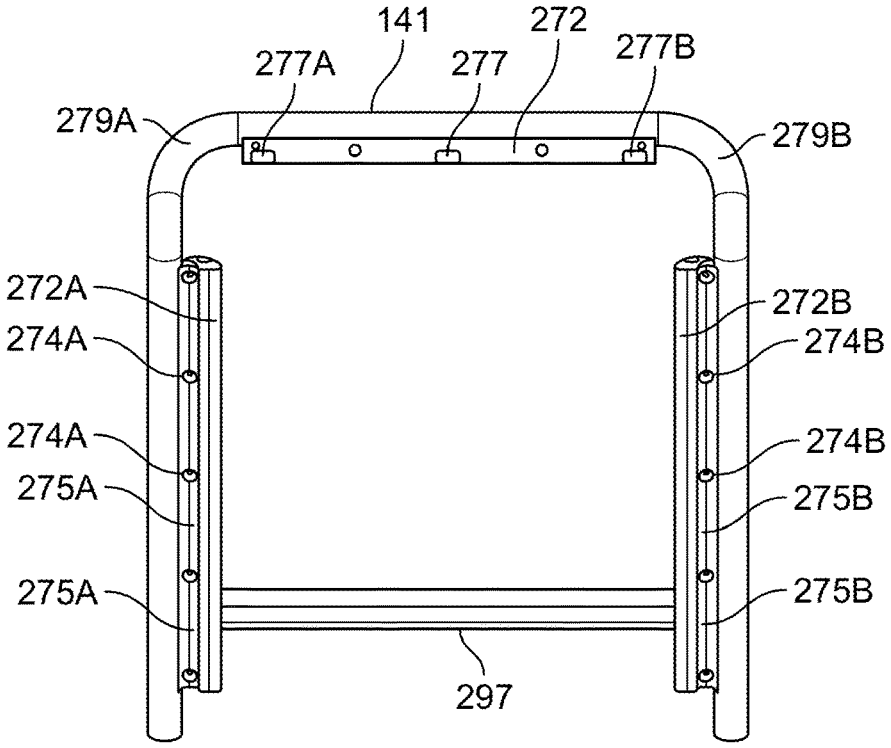

Referring to FIG. 6A, back 140 may be composed of any of a number of materials including, but not limited to, armored fabric cloth, sail fabric, awning fabric, Kevlar, tarp canvas, vinyl coated polyester, nylon mesh, neoprene, aluminized nylon, and/or cotton canvas. In some embodiments, the material may be treated to provide increased UV stabilization and weathering resistance, fire resistance, abrasion and tear resistance, and waterproofing.

In certain instances, back 140 may be composed of a similar material to that of seat 130. However, in some cases, the material used in the manufacture of back 140 may be different than that used in the manufacture of seat 130. For example, back 140 may be made of a first material and/or combination of materials, and seat 130 may be made of a second material and/or combination of materials different than the first material and/or combination of materials.

The material used in the fabrication of back 140 may be manufactured in a highly-permeable, weave-type and/or mesh-like construction and, as such, may provide for increased load capacity and user comfort. The perimeter of the weave-type and/or mesh-like fabric construction of back 140 may be configured to interface with back frame border 193, which may be a rigid thermoplastic over-mold. In forming the interface between back 140 and back frame border 193, back frame border 193 may be over-molded onto back 140 through a method of local injection molding. The process may form a thermoplastic feature (e.g., back frame border 193 and components included therein) through the fabric weave along the perimeter of back 140. After the method of local injection molding is completed, the weave-type and/or mesh-like fabric construction of back 140 may be taut and the back frame border 193 may be rigidly attached to back 140. Such an attachment method may eliminate stitching in the seat fabric and, by extension, offer advantages including repeatability, durability, dimensional accuracy, frame attachment flexibility and improved aesthetics.

Back frame border 193 may include a plurality of protrusions of various types configured to aide and/or facilitate the engagement between back 140 and back frame 141. In particular, back frame border 193 may include top attachment clips 287, 287A, and 287B, back frame corner engagement faces 289A and 289B, side attachment screw interfaces 284A and 284B, side ribs 285A and 285B, and flanges 291A and 291B.

Back 140 may be configured to be removably attached and/or engaged with seat frame 141. In forming the removable attachment and/or engagement, the various protrusions of back frame border 193 of back 140 may be configured to removably connect, insert, and/or interface with specific aspects of top handle 272 and back attachment rails 272A and 272B. For example, top attachment clips 287, 287A, and 287B and side attachment screw interfaces 284A and 284B of back at frame border 193 may be respectively configured to be removably connected, inserted, and/or interfaced with top attachment holes 277, 277A, and 277B of carrying handle 272 and side attachment holes 274A and 274B of back attachment rails 272A and 272B. Additionally, back frame corner engagement faces 289A and 289B of back frame border 283 of back 140 may be respectively configured to removably interface with back frame corners 279A and 279B of back frame 141.

Further, side ribs 285A and 285B and flanges 291A and 291B of back frame border 193 of back 140 may be configured to removably interface with rib engagement channels 275A and 275B of back attachment rails 272A and 272B. Side ribs 285A, 285B may be load carrying ribs and may be configured to interface with rib engagement channels 275A, 275B of back attachment rails 272A, 272B. The side ribs 285A, 285B may extend from a bottom surface of a right and left side of the back frame border 193 and flanges 291A, 291B may be located on each side of the back frame border 193. The series of flanges 291A, 291B can extend perpendicular to a bottom surface of the back frame border 193 and an outer face of the side ribs 275A, 275B. The side ribs 285A, 285B and the series of flanges 291A, 291B can prevent the side ribs from twisting when the back is loaded. As such, the side ribs 285A, 285B and the flanges 291A, 291B may relieve structural loading from the side attachment screw interfaces 284A, 284B when back 140 and back frame 141 are in either of an attached or detached state and may also provide a complimentary force to that provided by side attachment screw interfaces 284A, 284B in a state in which back 140 is attached to back frame 141. In an attached stated, the side ribs 285A, 285B may traverse the length of back attachment rails 272A, 272B and the flanges 291A, 291B may span the horizontal area of the back attachment rails 272A, 272B. The number of flanges 291A, 291B can be selected based on the desired threshold loading of the chair, the thickness of each flange, and the weight distribution of the chair.

Figure 6C:
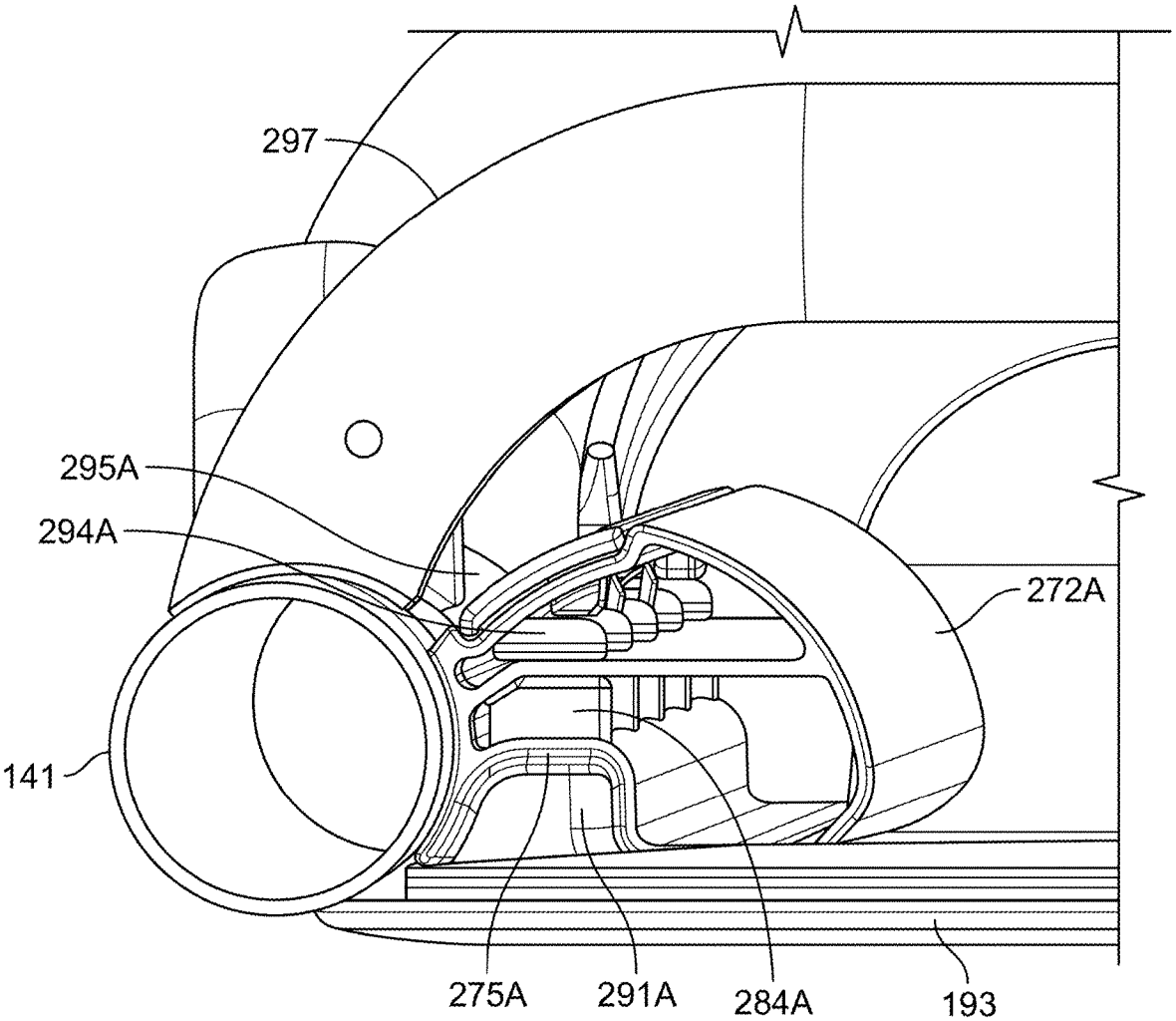

Referring to FIG. 6C, side attachment screw interface 284A may be configured to be inserted through side attachment hole 274A during the formation of the removable attachment between back 140 and back frame 141. Side attachment screw interface 284A may be configured to receive screw 294A in order to fasten back 140 to back frame 141. For instance, side attachment screw interface 284A may be inserted through side attachment hole 274A. Screw access panel 295A may be removed from side rail 272A to expose side attachment screw interface 284A. After removal of screw access panel 295A, screw 294A may be rotatably inserted into side attachment screw interface 284A. Similarly, screws 294A may be rotatably inserted into each of the side attachment screw interfaces 284A. After each of the screws 294A have been inserted into the side attachment screw interfaces 284A, the screw access panel 295A may be reattached to side attachment rail 272A. A similar process may be performed for side attachment screw interfaces 284B, side attachment holes 278B, screw access panel 295B, and screws 295B.

In the manner described above, back 140, by way of back frame border 193 and the plurality of protrusions formed thereto, may be configured to engage with the side attachment rails 272A and 272B and carrying handle 272 of back frame 141. In some instances, the back frame border 183 may be secured to back frame 141 by locating a first end (e.g., top portion) of back frame border 193 into a first end (e.g., top portion) of the back frame 141 and rolling and/or flexing the back frame border 193 from the first end of the back frame 141 to a second end (e.g., bottom portion) of the back frame 141. The rolling and/or flexing of the back frame border 193 from the first end of the back frame 141 to the second end may cause the plurality of protrusions of the back frame border 193 to align with the plurality of slots in the back attachment rails and to removably attach the back frame border 193 on the back frame 141.

Alternatively, back frame border 193 may be secured to back frame 141 by inserting the bottommost side attachment screw interface 284B on the left side of the back frame border 193 into the bottommost side attachment hole 274B of the left side attachment rail 272B and inserting the bottommost side attachment screw interface 284A on the right side of the back frame border 193 into the bottommost side attachment hole 274A of the right side attachment rail 272A. Next, the first, second, and third middle side attachment screw interfaces 284B on the left side of the back frame border 193 may be inserted into the first, second, and third middle side attachment holes 274B of the left side attachment rail 272B. Similarly, the first, second, and third middle side attachment screw interfaces 284A on the right side of the back frame border 193 may be inserted into the first, second, and third middle side attachment holes 274A of the right side attachment rail 272A. Subsequently, the topmost side attachment screw interface 284B on the left side of the back frame border 193 may be inserted into the topmost side attachment hole 274B of the left side attachment rail 272B and the topmost side attachment screw interface 284A on the right side of the back frame border 193 may be inserted into the topmost side attachment hole 274A of the right side attachment rail 272A. Then, the back 140, by way of the back frame border 193, may be rolled and/or flexed at a top portion of the back 140 in a backward direction to align and insert the top attachment clips 287, 287A, and 287B of the back frame border 193 with the top attachment holes 277, 277A, and 277B of the carrying handle 272 and the top attachment clip on the right side of the back frame border 193 with the top attachment hole on the right end portion of the carrying handle 272. Next, the screw access panels 295A and 295B may be removed from the side attachment rails 272A and 272B, and each of the screws 294A and 294B may be threaded into the respective side attachment screw interfaces 284A and 284B. After insertion, the screw access panels 295A and 295B may be reattached to side attachment rails 272A and 272B.

In some instances, back frame border 193 may have a plurality of back attachment clips in the manner described above in regard to seat frame border 183 as opposed to the back attachment screw interfaces 284A. In such instances, the side attachment clip may be configured to be inserted through side attachment hole 274B during the formation of the removable attachment between back 140 and back frame 141. The side attachment clip may have an extended rectangular construct with a half-arrow shaped distal end, which may allow for rotational pliability during insertion and removal, as well as for vertical force distribution during engagement. For instance, during insertion into side attachment hole 274B, a rotational force may be applied to the outer face of the half-arrow terminal end of the side attachment clip. In response to the rotational force, the side attachment clip may be configured to rotatably displace and allow for the insertion of side attachment clip into side attachment hole 274B. After insertion has been completed and the rotational force has been removed, the side attachment clip may be configured to return to a static position and an upper and/or overhang face of the half-arrow portion of side attachment clip may be configured to interface with a bottommost face of rib engagement channel 275B of back attachment rail 272B. Such an interface provided by side attachment clip, in combination with the other side and top attachment clips, may provide for the removable attachment of back 140 to back 141.

In either instance, during the assembly of the back frame border 193 to the back frame 141, the back frame border 193 can be rolled from a bottom end to a top end. While such steps are described in a specific order from bottom to top, the steps need not be performed in such an order and may be performed in any specific order. Furthermore, in the state in which back 140 is attached to back frame 141, as shown in FIG. 6C, back frame border 193 may interface with an outer portion of back frame 141. In some instances, back frame border 193 may be machined after the injection molding process described above in order to allow for cosmetic control of the back frame border-back frame interface.

Arm Rests

Referring back to FIG. 1, portable chair 100 may also include arm rests 150A and 150B. The arm rests 150A and 150B may be pivotably attached to the arm rest attachment portions of back frame 141 via one or more pins including pin 157B. Arm rests 150A and 150B may be further configured to be attached, respectively, to front joinery interface 116A and back joinery interface 126A via pin 128A and front joinery interface 116B and back joinery interface 126B via pin 128B.

Arm rests 150A and 150B may be made of plastic, rubber, metal, carbon fiber, and the like and may be configured to support up to a 500 lb load in one example. In some instances arm rests 150A and 150B may serve as buoyancy aides in preventing the submersion of portable chair 100. Similarly, in one example, arm rests 150A and 150B may be fabricated through a gas-assisted injection molding process to create a hollow cavity in the interior of the arm rests. Such a hollow cavity may serve as a buoyancy aide for chair 100.

Foldability

Figure 7A:
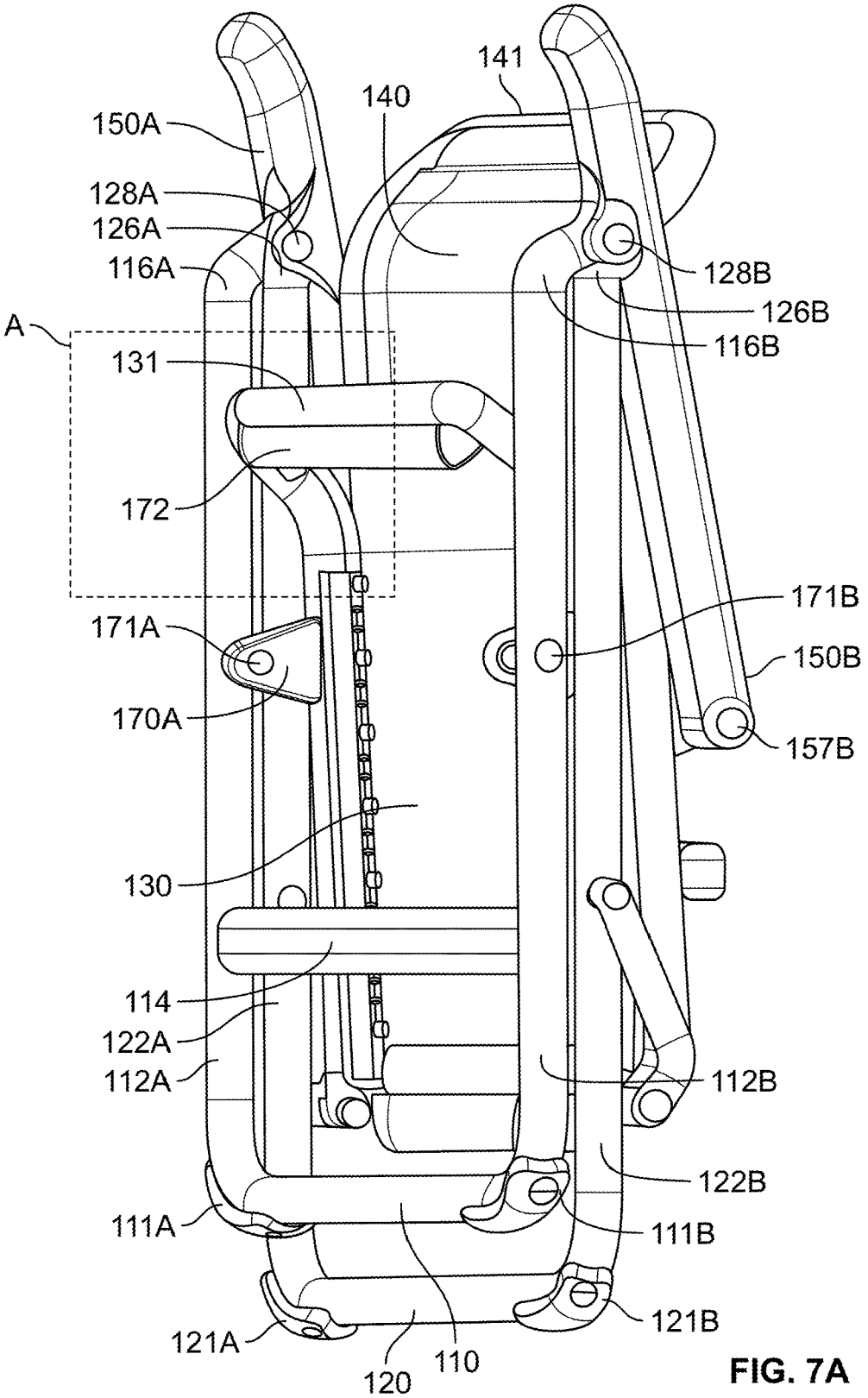
FIGS. 7A and 7B respectively illustrate a front perspective view and a section of the example portable chair of FIG. 1 in a folded configuration according to one or more aspects described herein.
Figure 7B:
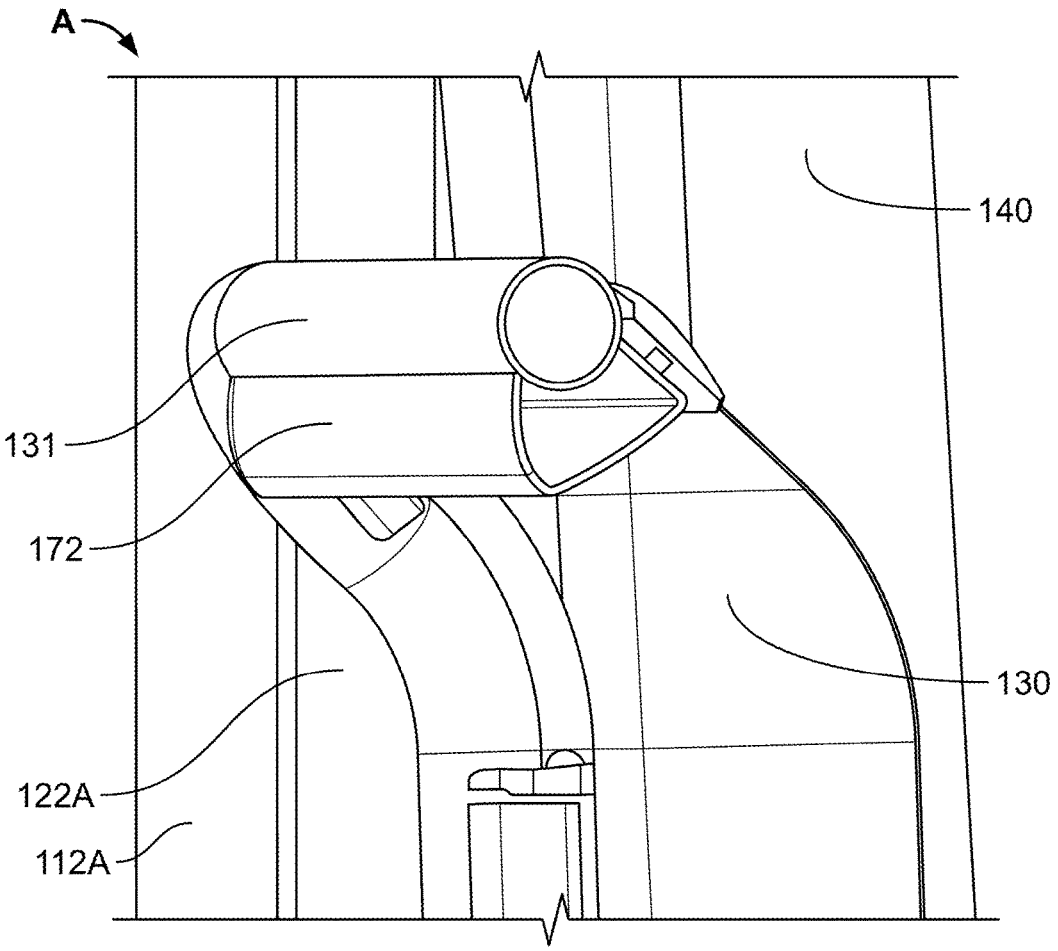

Referring to FIG. 7A, portable chair 100 may be a foldable and portable chair. Through actuation of the rotational and pivotable interfaces, portable chair 100 may be able to be folded into a portable arrangement and unfolded into a seating arrangement. While in the folded portable arrangement, the chair 100 may be locked and/or sustained in the folded portable arrangement by one or more detents. The one or more detents may provide resistance against the opening of the chair 100 from the folded portable arrangement into the unfolded seating arrangement. While in the unfolded seating arrangement, the one or more detents may additionally provide resistance against the closing of the chair 100 from the unfolded seating arrangement into the folded portable arrangement.

For further example, chair 100 may be configured to open from a folded portable arrangement into an unfolded seating arrangement. In the folded portable arrangement, the front legs 112A and 112B may be substantially parallel to back legs 122A and 122B and seat 130 may be substantially parallel to back 140. One or more detents may be included in the attachment interfaces between the seat joinery interfaces 133A and 133B of seat frame 131. Additionally, and/or alternatively, the one or more detents may be included in the attachment interface between front leg attachment portions 170A and 170B and front legs 112A and 112B via pins 171A and 171B.

The one or more detents may provide resistance against the opening displacement of the front legs 112A and 112B and seat 130 away from back legs 122A and 122B and back 140 and, as such, may function to lock and/or maintain the chair in the folded portable arrangement. In addition to the resistance, the one or more detents may also provide intentional audible feedback to a user of chair 100 indicating that the chair 100 is in a locked position when an attempt is made to open the chair 100 from the folded portable arrangement to the unfolded seating arrangement.

While in the folded portable arrangement, when an opening force is applied to the chair 100 that is greater than the locking force and/or resistance provided by the one or more detents, chair 100 may become openable and the front legs 112A and 112B and seat 130 may rotatably displace from back legs 122A and 122B and back 140. At such a point, the chair 100 may be in an unlocked and transitory state between the folded portable arrangement and the unfolded seating arrangement. Upon the continued application of the opening force, the chair 100 may achieve a maximum opening displacement and arrive at the unfolded seating arrangement. At the unfolded seating arrangement, the front legs 112A and 112B and seat 130 may be angled relative to back legs 122A and 122B and back 140.

Additionally, the one or more detents included in the attachment interface between front leg attachment portions 170A and 170B and front legs 112A and 112B via pins 171A and 171B may provide resistance against the closing displacement of the front legs 112A and 112B and seat 130 towards back legs 122A and 122B and back 140. As such, the one or more detents may function to lock and/or maintain the chair 100 in the unfolded seating arrangement. In addition to the resistance, the one or more detents may also provide intentional audible feedback to a user of chair 100 indicating that the chair 100 is in a locked position when an attempt is made to close the chair 100 from the unfolded seating arrangement to the folded portable arrangement. While in the unfolded seating arrangement, when a closing force is applied to the chair 100 that is greater than the locking force and/or resistance provided by the one or more detents, the chair 100 may become closeable and the front legs 112A and 112B and seat 130 may rotatably displace towards back legs 122A and 122B and back 140.

Cup Holders

Figure 8A:
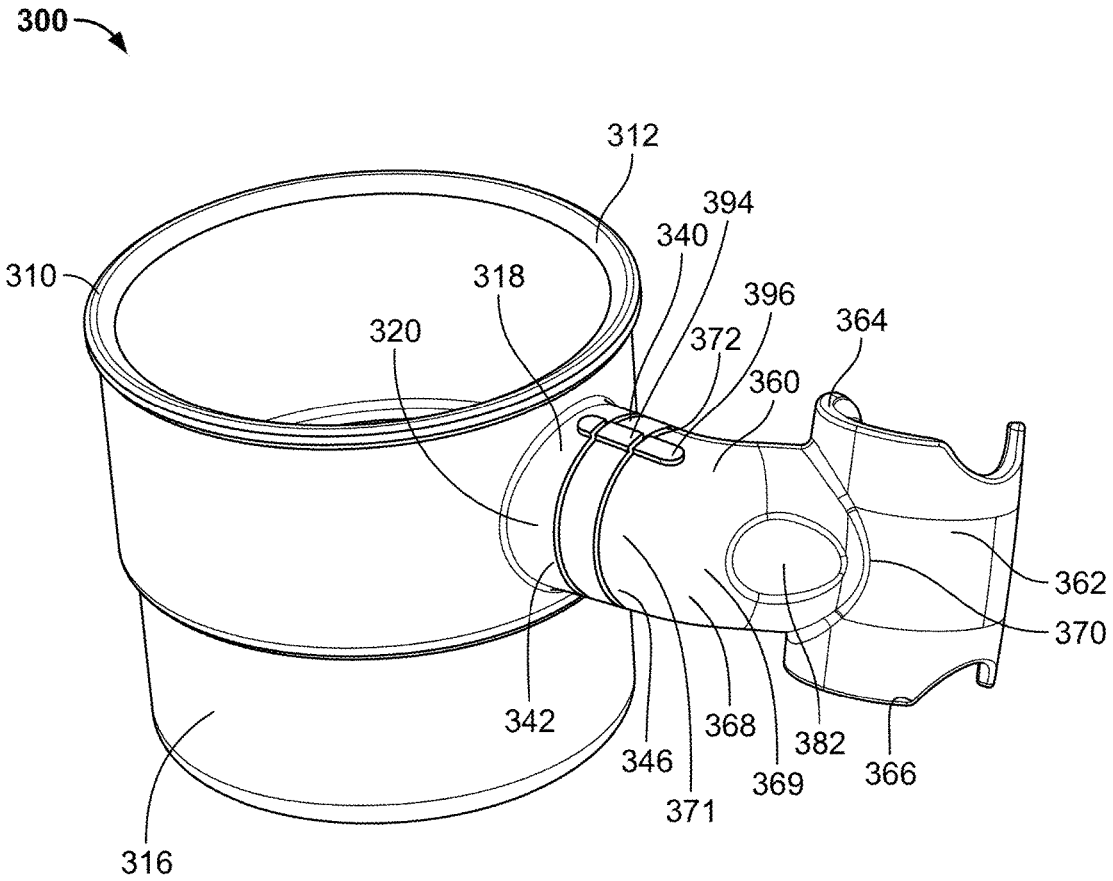
FIG. 8A illustrates an isometric view of an embodiment of the cup holder assembly as described herein.
Figure 8B:
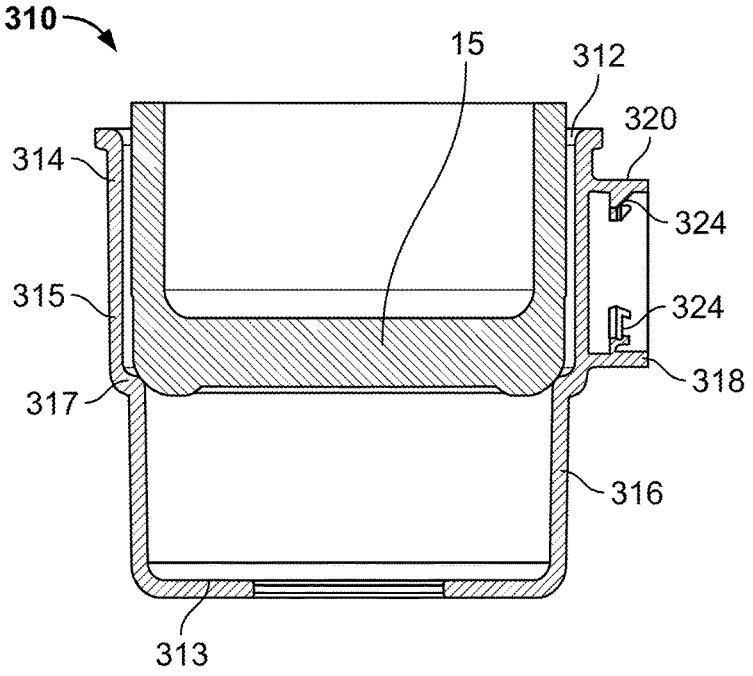
FIGS. 8B and 8C illustrate cross-sectional views of the cup holder securing a beverage container as described herein.
Figure 8C:
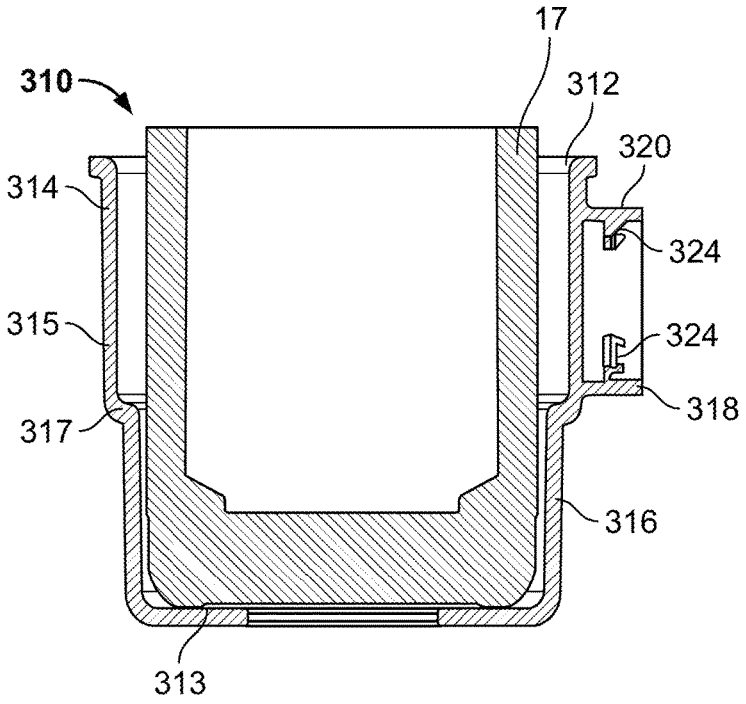
Figure 9A:
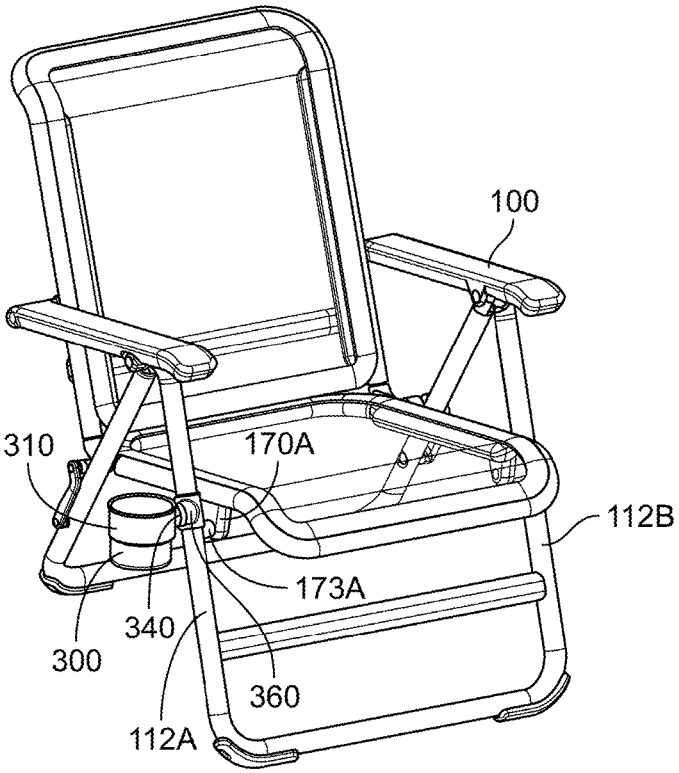
FIGS. 9A and 9B illustrate isometric views of the cup holder assembly as installed on the example portable chair of FIG. 1 as described herein.
Figure 9B:
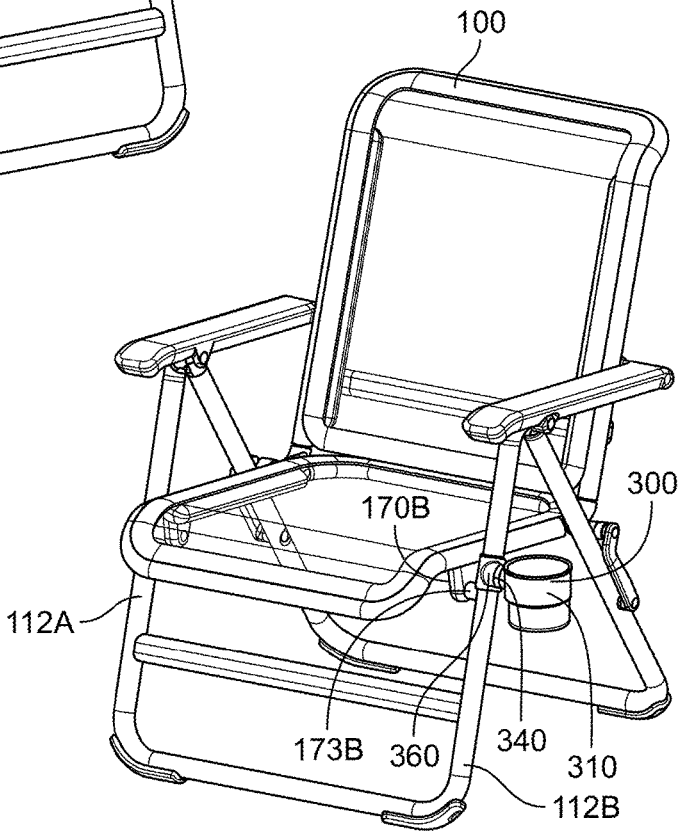

FIGS. 8-21 illustrate embodiments of an exemplary cup holder assembly 300 that may attach to the portable chair 100. The cup holder assembly 300 may comprise a cup holder 310, a collar 340, and a clamp member 360. The cup holder 310 may be rotatably engaged with the clamp member 360 such that the cup holder 310 may rotate relative to the clamp member 360. The clamp member 360 may releasably engage with either of the front legs 112A and 112B of the chair 100 as shown in FIGS. 9A and 9B. For example, the cup holder assembly 300 may attach to the front leg 112A proximate the intersection with the front leg attachment portion 170A of the seat frame 131, or alternatively, the cup holder assembly 300 may attach to the front leg 112B proximate the intersection with the front leg attachment portion 170B of the seat frame 131. The cup holder assembly 300 may typically be oriented in an outboard position, or user accessible position, such that the cup holder 310 is positioned outside of the profile of the front legs 112A, 112B. In some examples, the cup holder assembly 300 may be rigidly attached to either of the front legs 112A, 112B, or as in the exemplary embodiment shown the cup holder assembly 300 may be detachably attached.

In either instance (e.g., rigidly attached or detachably attachable) the cup holder assembly 300 may be configured to secure a cup, bottle, thermos, glass, can, mug, or drink container of any of a plurality of sizes. For example, the cup holder 310 may secure different sizes of the YETI® Rambler, such as the 10 oz., 20 oz., 30 oz., 18 oz., and 26 oz., the YETI® Colster for either 12 oz. or 16 oz. cans, YETI® bottles, or even solo cups. The embodiment of the cup holder 310 illustrated in FIGS. 8A-21 may have a single wall construction without any integrated insulation.

Alternatively, the cup holder 310 may be a vacuum insulated cup holder, an aerogel cup holder, or may include one or more vacuum insulated panels and may be configured to maintain a temperature lower or higher than that of the ambient surrounding environment. The cup holder 310 may be configured to cool an inserted drink container and/or maintain and prolong a period of below-ambient temperature of an inserted drink container. Additionally, and/or alternatively, the cup holder may be configured to receive an ice pack and/or natural ice insert in order to aide in cooling of an inserted drink container and/or prolong a period of below-ambient temperature.

The cup holder 310 may comprise a lip 312, an interior bottom surface 313, and a substantially cylindrical wall 314 positioned between the lip 312 and the bottom surface 313. The substantially cylindrical wall 314 may have a smooth surface having the same diameter the entire height or may have an exterior shape comprising two tiers, an upper tier 315, a lower tier 316, with a step or substantially horizontal connecting wall 317 between the upper tier 315 and lower tier 316 such as the example embodiment shown in FIG. 8A-8C. The upper tier 315 may have a larger diameter than the diameter of the lower tier 316. The two-tiered shape of the cup holder 310 may allow the cup holder 310 to support and secure different sized containers. For example, as shown in FIG. 8B, the 10 oz YETI® Rambler 15 rests on the step or connecting wall 317 of the cup holder 310, while in FIG. 8C, a 12 oz. can 17 touches the interior bottom surface 313 of the cup holder 310. The cup holder 310 may have an engaging member 318 that releasably connects to the collar 340 as described in more detail below. The engaging member 318 may be integrally formed or molded to the cup holder 310.

Figure 10A:
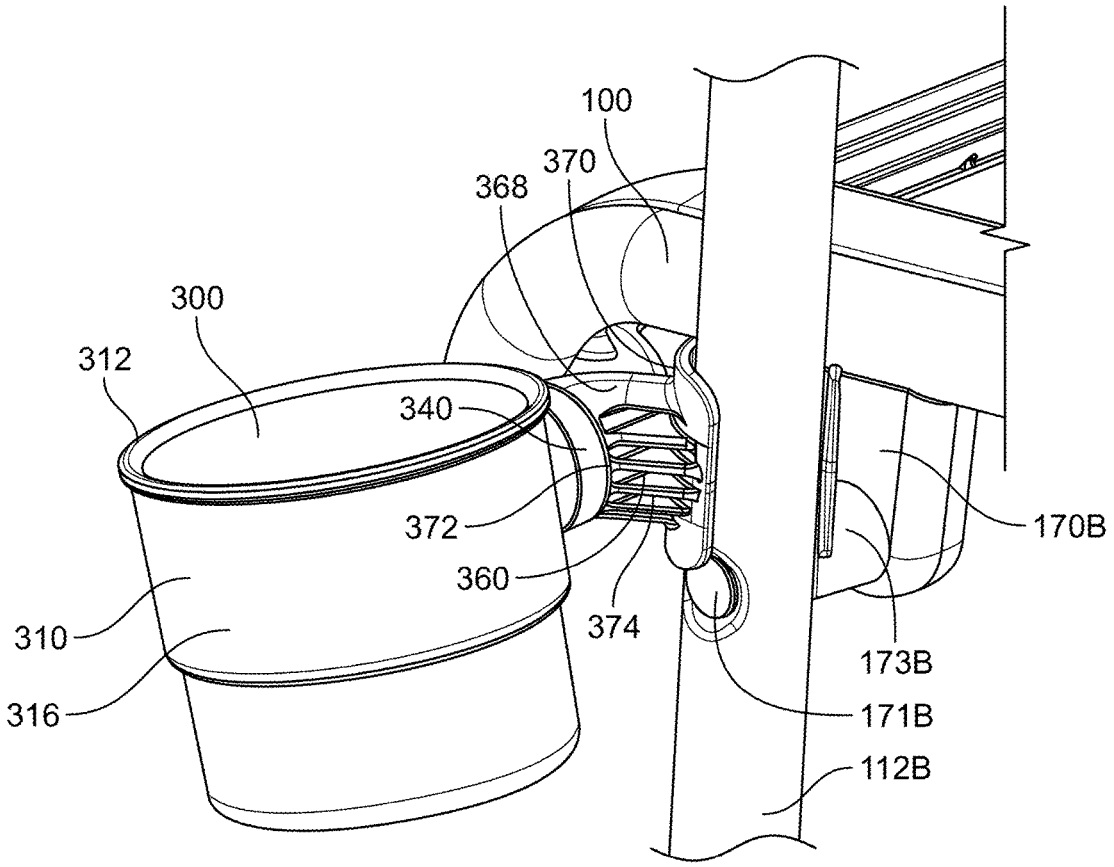
FIGS. 10A and 10B illustrate detailed views of the cup holder assembly installed on the example portable chair as shown in FIG. 9B as described herein.
Figure 10B:
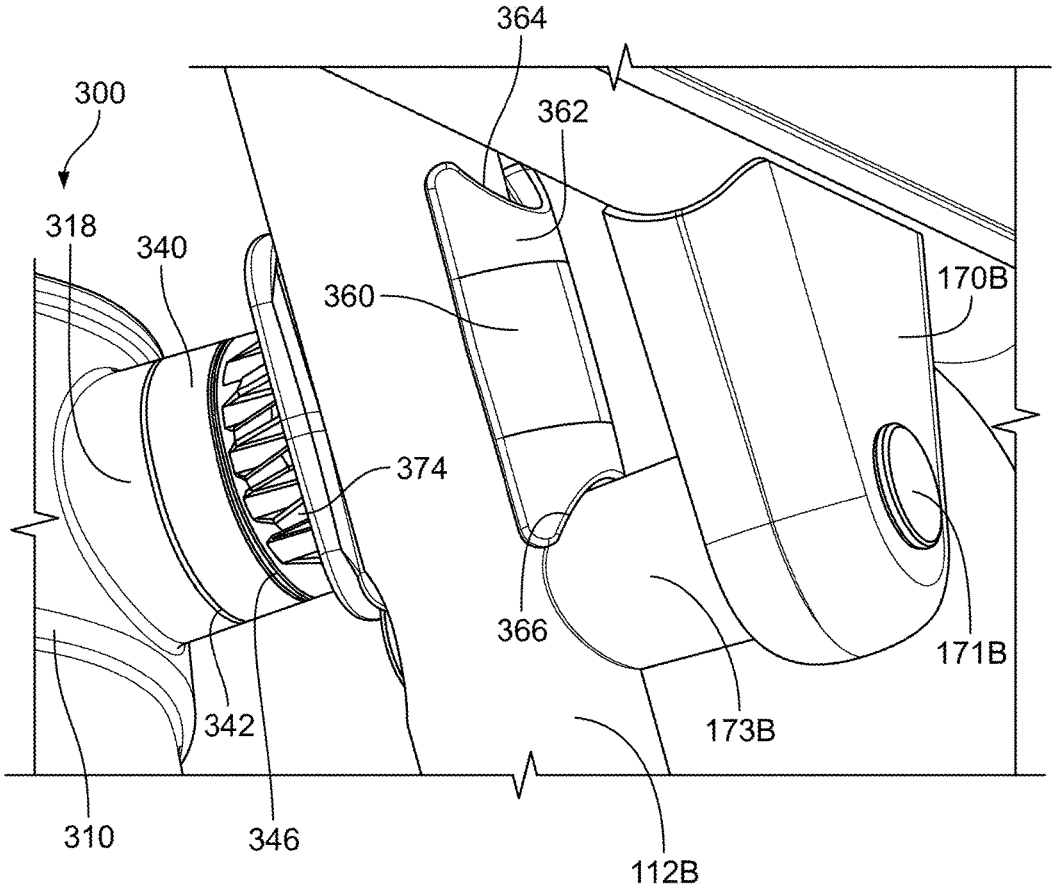

As shown in FIGS. 9A and 9B, the clamp member 360 of the cup holder assembly 300 may engage the front leg 112A proximate to the intersection with the front leg attachment portion 170A of seat frame 131 or alternatively, the cup holder assembly 300 may be attached to the front leg 112B proximate the intersection with the front leg attachment portion 170B of the seat frame 131. As shown in FIGS. 8A, 10A, and 10B, the clamp member 360 may have a C-shaped member 362 having an upper surface 364 and a lower surface 366. Each of the upper surface 364 and the lower surface 366 may have a portion with a rounded surface to engage either of the bushings 173A or 173B. The rounded surfaces may have diameters similar to the diameter of bushings 173A and 173B. By engaging the bushings 173A, 173B, the cup holder assembly 300 may have increased support when in an outboard position, or user accessible position.

Figure 11:
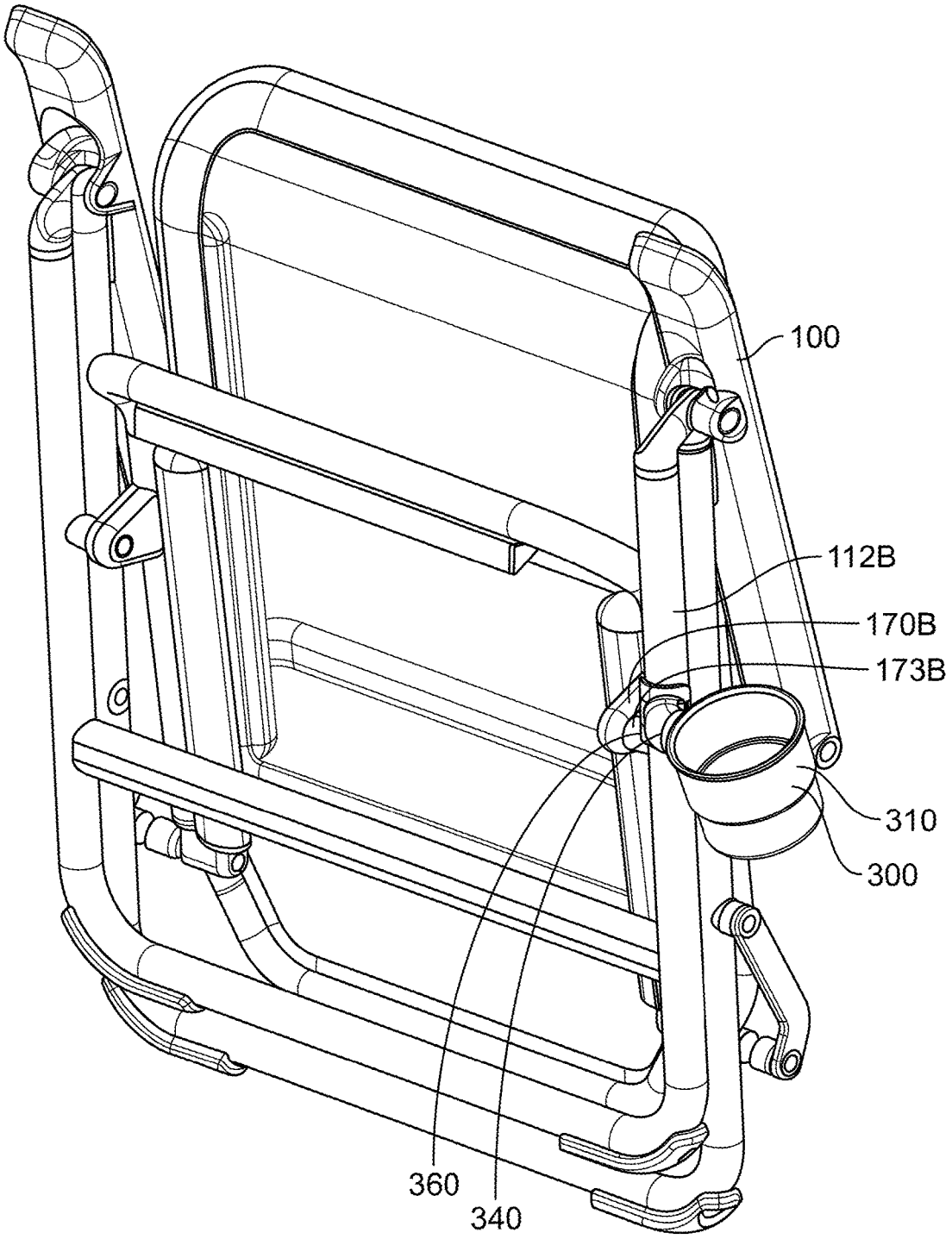
FIG. 11 illustrates a front perspective view of the cup holder assembly as installed on the example portable chair of FIG. 1 in a folded configuration according to one or more aspects described herein.
Figure 12:
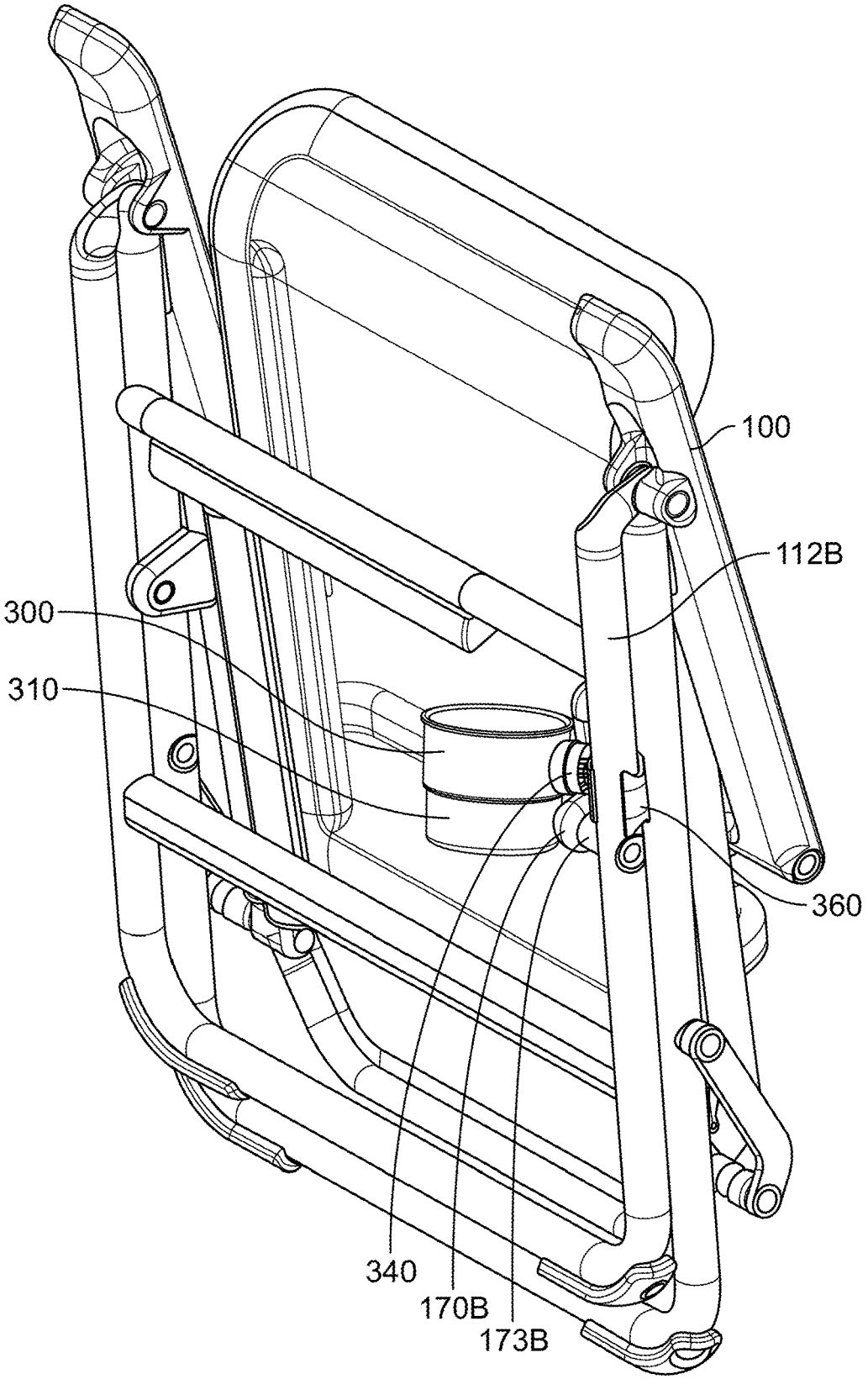
FIG. 12 illustrates a front perspective view of the cup holder assembly as installed on the example portable chair of FIG. 1 in a folded configuration according to one or more aspects described herein.
Figure 17:
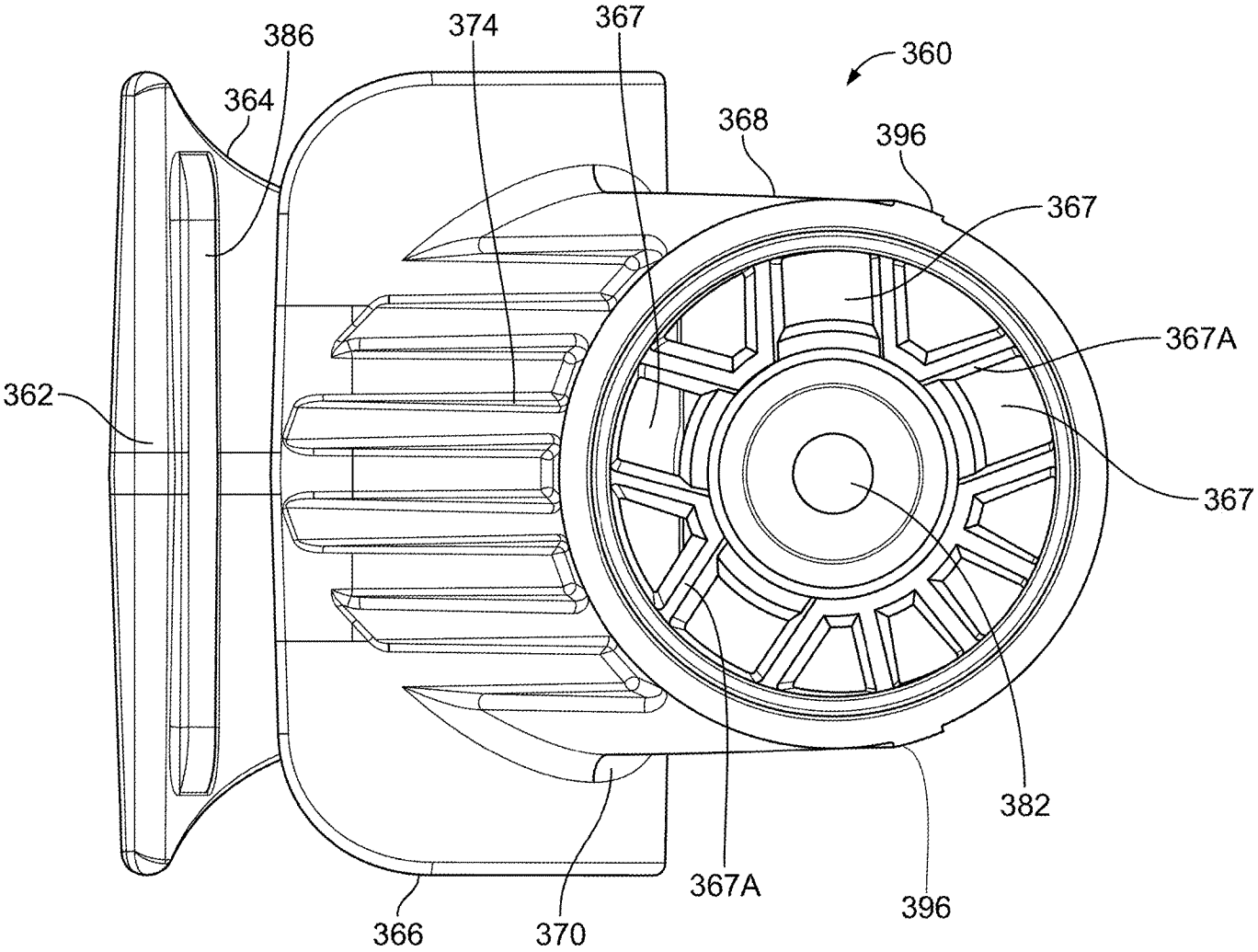
FIG. 17 illustrates a front view of the clamp member of the cup holder assembly according to one of more aspects described herein.

To connect the clamp member 360 to the collar 340, an engaging member 368 may extend from the C-shaped member 362 at a first end 370 and have a second end 372 to engage the collar 340. The engaging member 368 may have a portion that is a curved member 369 and a portion that is a straight member 371. Additionally, the first end 370 and the second end 372 may be positioned at an angle to each other. The exterior surface of the engaging member 368 may form a rounded shape or partially cylindrical shape. As shown in FIGS. 10A and 17, the interior portion of the curved member 369 may have a plurality of ribs 374 connecting from the first end 370 or C-shaped member 362 to the straight member 371. The ribs 374 may run parallel to the direction of the longitudinal axis 376 of the engaging member 368, although other orientations and combinations of orientations are possible. The plurality of ribs 374 may increase the strength of the clamp member 360 to withstand the forces administered from repeated attachment and removal. The exterior shape of the clamp member 360 may be symmetrical about a horizontal plane extending through the longitudinal axis 376 of the engaging member 368. FIGS. 11 and 12 illustrate another feature of the cup holder assembly 300 to make carrying the portable chair 100 easier when the portable chair 100 is in the folded configuration. When attached to the portable chair 100, the cup holder assembly 300 may rotate from an outboard position with the cup holder 310 positioned outside of the profile of the front legs 112A, 112B, shown in FIG. 11, to an inboard position with the cup holder 310 positioned inside the profile of the front legs 112A, 112B, shown in FIG. 12. The cup holder assembly 300 may be rotated from the outboard position to the inboard position while still connected with one of the front legs 112A, 112B of the portable chair 100.

Figure 13A:
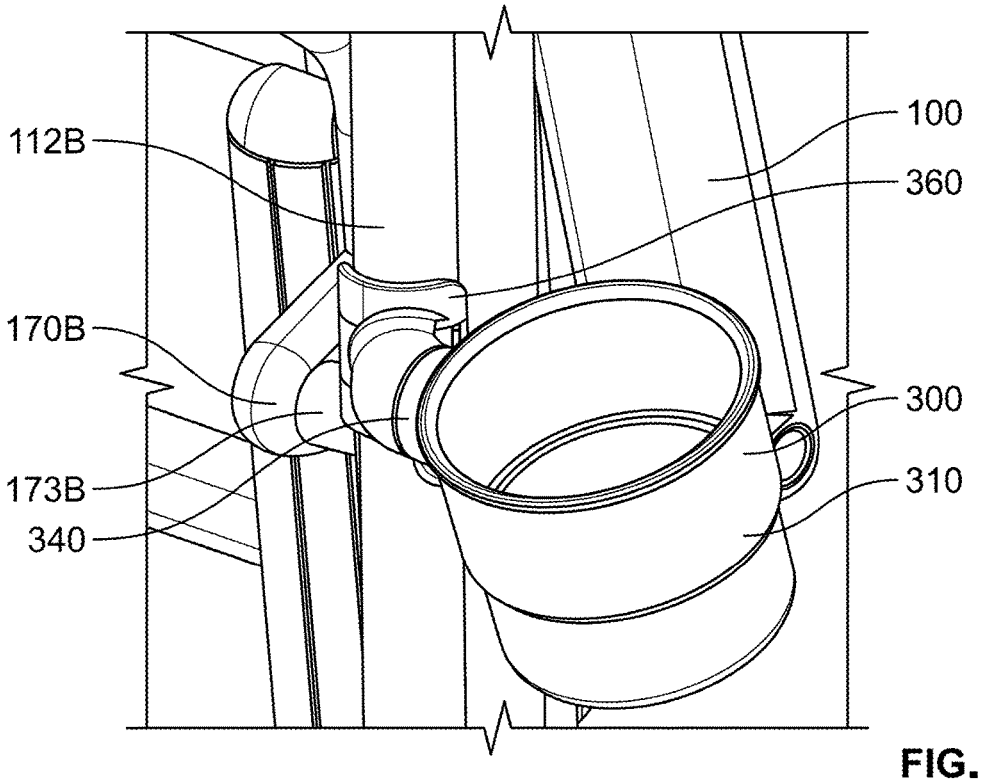
FIGS. 13A-C illustrate detailed views of the cup holder assembly rotating from an outward position to an inward position according to one or more aspects described herein.
Figure 13B:
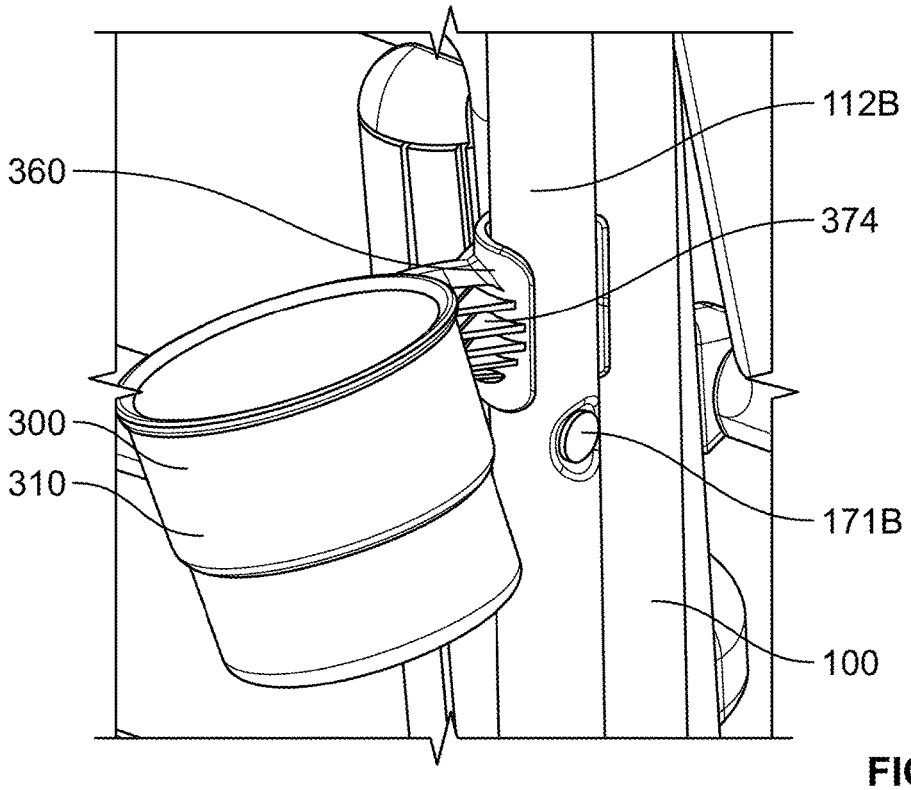
Figure 13C:
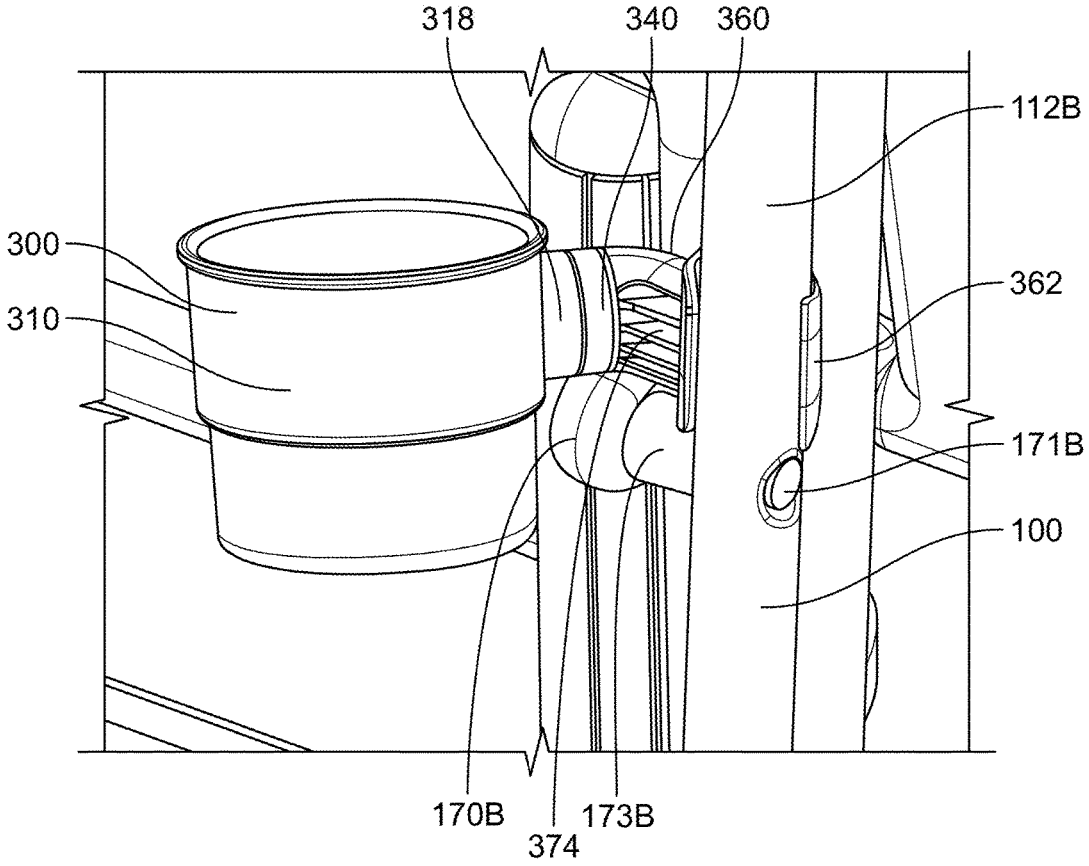

FIGS. 13A-13C illustrate the method to rotate the cup holder assembly 300 from an outboard position to an inboard position when the portable chair 100 is in the folded configuration. As shown in FIG. 13A, the cup holder assembly 300 is in an outboard position. During the next step as shown in FIG. 13B, a user may slide the C-shaped member 362 of the clamp member 360 along whichever front leg 112A, 112B the cup holder assembly 300 is attached away from the respective bushing 173A or 173B. Once the lower surface 366 is above the respective bushing 173A or 173B, the user then may rotate the C-shaped member around the front leg 112A, 112B while the clamp member 360 is still attached. Lastly, as shown in FIG. 13C, the user completes the rotation of the cup holder assembly 300 to an inboard position with the cup holder 310 positioned inside the profile of the front legs 112A, 112B.

Figure 14A:
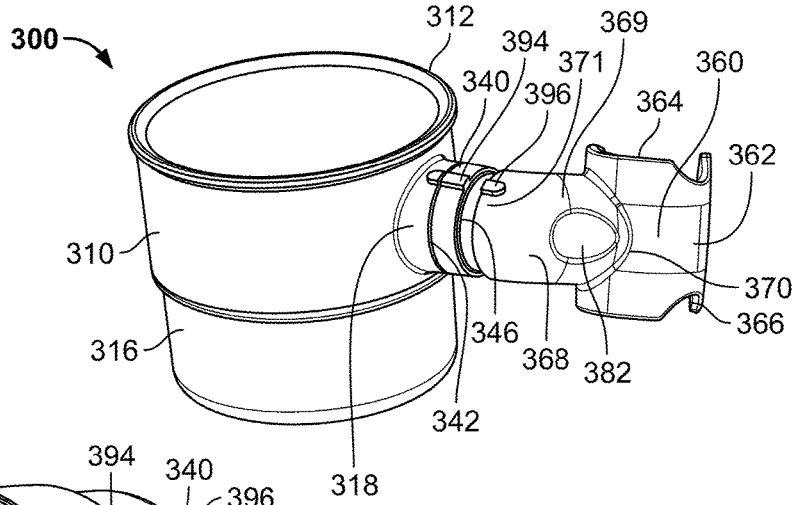
FIGS. 14A-C illustrate perspective views of the cup holder rotating relative to the clamp member according to one or more aspects described herein.
Figure 14B:
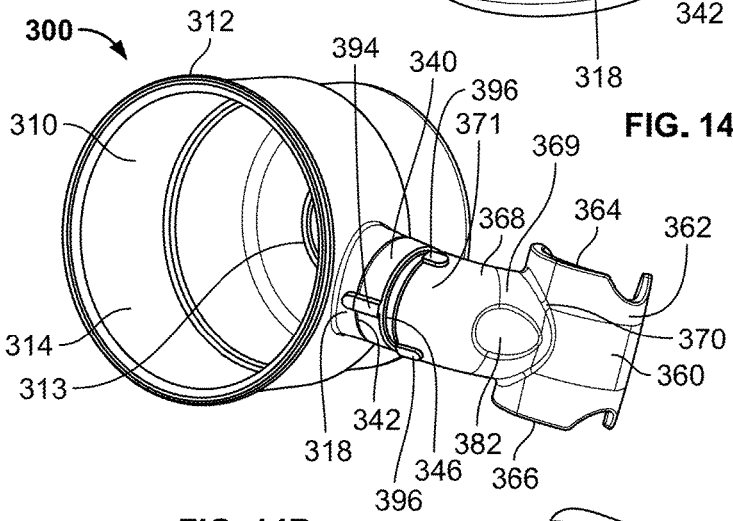
Figure 14C:
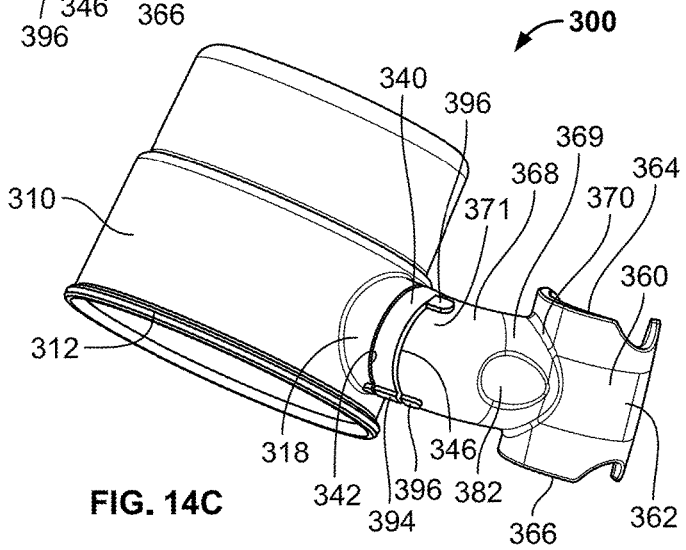

As described above, the cup holder assembly 300 may releasably connect to either of the front legs 112A, 112B. In order to move the cup holder assembly 300 from one side of the portable chair 100 to the other side, the cup holder 310 may be rotated relative to the clamp member 360 as shown in FIGS. 14A-14C to ensure the cup holder 310 is in the proper drink holding orientation for the user. In at least the exemplary embodiment, the longitudinal axis of the C-shaped member 362 is not parallel or perpendicular to the longitudinal axis of the cylindrical wall 314 of the cup holder 310, such that the two axes are positioned at an angle to each other. To rotate the cup holder 310 relative to the clamp member 360, the user may pull the cup holder 310 and collar 340 outward from the clamp member 360. The collar 340 and cup holder 310 may then slide a predetermined distance along the longitudinal axis 376 of the engaging member 368 to disengage a set of rotationally inhibiting features 341, 367 on the collar 340 and engaging member 368, respectively, shown in FIGS. 16B, 17, and 18A-18B. Once the cup holder 310 and collar 340 have moved the predetermined distance, both the collar 340 and cup holder 310 may be rotated to the desired position for use on the opposite side of the chair 100. For example, as shown in FIGS. 14A-14C, the cup holder 310 may rotate degrees relative to the clamp member 360 or rotate until the rotational inhibiting features 341, 367 engage each other as the collar 340 is slid back towards the clamp member 360, shown in FIG. 14C, from its initial position, shown in FIG. 14A. The cup holder 310 may rotate from a first position to a second position where the first position and the second position are approximately 144 degrees apart. Alternatively, the first position and the second position may be within a range of 130 degrees to 150 degrees apart, or within a range of 120 degrees to 160 degrees apart, or within a range of 110 degrees to 170 degrees apart. As another option, the first position and the second position may be spaced within a range of 5 degrees to 15 degrees apart, or within a range of 15 degrees to 30 degrees apart, or within a range of 30 to 90 degrees apart. The rotational inhibiting features 341, 367 may be set to secure the collar 340 and cup holder 310 to the clamp member 360 at predetermined positions that allow the bottom of the cup holder 310 to be parallel to the ground when attached on either the left hand side or right hand side of the chair 100. While the exemplary embodiment illustrates two predetermined positions for the cup holder 310 relative to the clamp member 360, the number of predetermined positions may be any number such as 3, 4, or 5 or more. Optionally, a user may rotate the cup holder 310 relative to the clamp member 360 to any location within the predetermined range of motion. Alternatively, the cup holder 310 may be free to rotate the full 360 degrees relative to the collar 340.

To assist the user in aligning the cup holder 310 and collar 340 in the proper position, each of the cup holder 310, the collar 340, and the clamp member 360 may have an alignment indicator 394, 396. Alignment indicator 394 may comprise having a portion positioned on each of the engaging member 318 of the cup holder 310 and the exterior surface of the collar 340. The alignment indicator 394 may align with one of two corresponding alignment indicators 396 positioned on the clamp member 360. When the alignment indicators 394, 396 are collinear, the collar 340 and the clamp member 360 are properly aligned for the cup holder assembly 300 to be one of the predetermined optimal operating positions. The alignment indicators 394, 396 may be raised surfaces, indentions, or other contrasting features to allow a user to easily identify the predetermined optimal operating positions of the cup holder assembly 300.

Figure 16A:
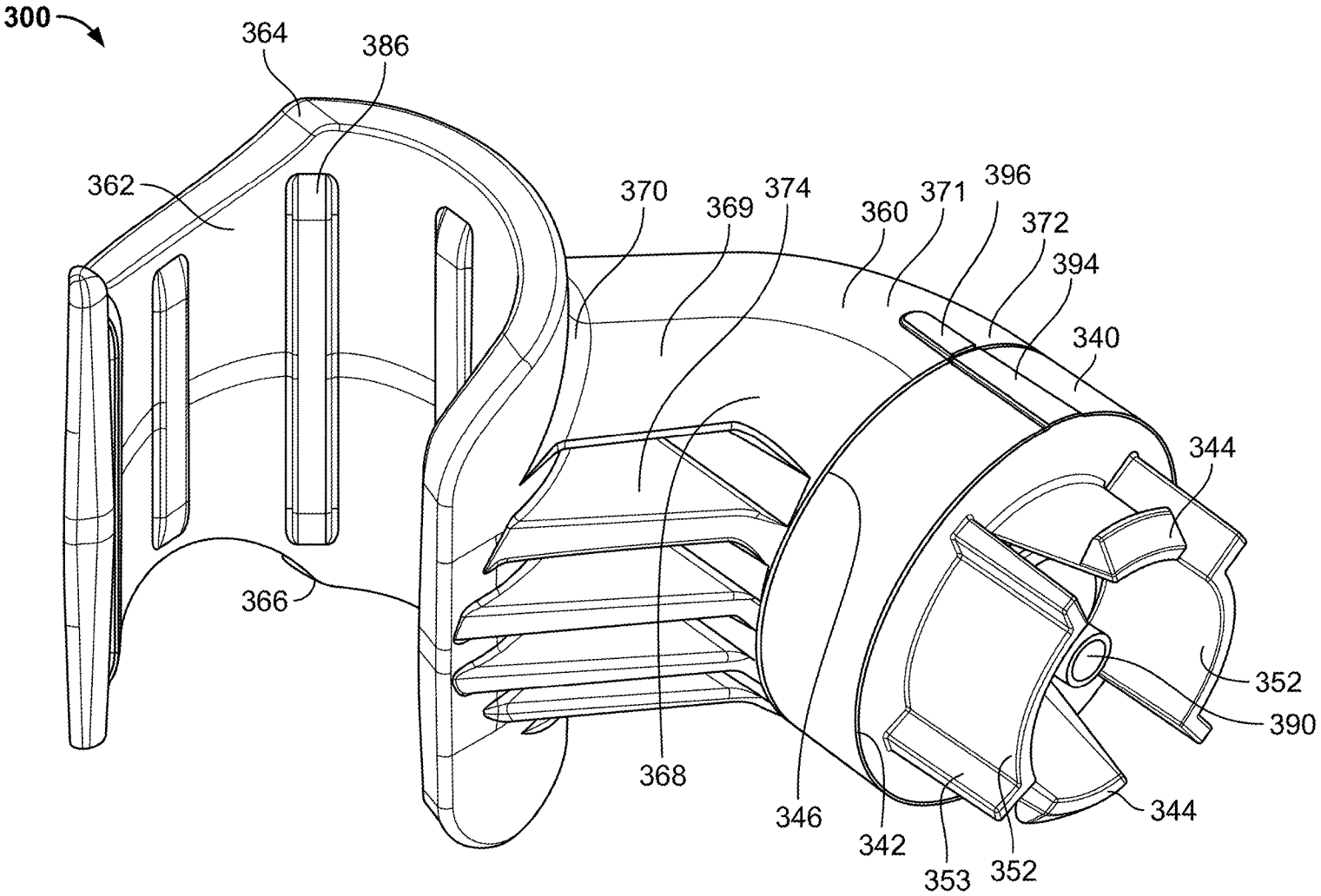
FIG. 16A illustrates a perspective view of the cup holder assembly with the cup holder removed for clarity according to one or more aspects described herein.
Figure 16B:
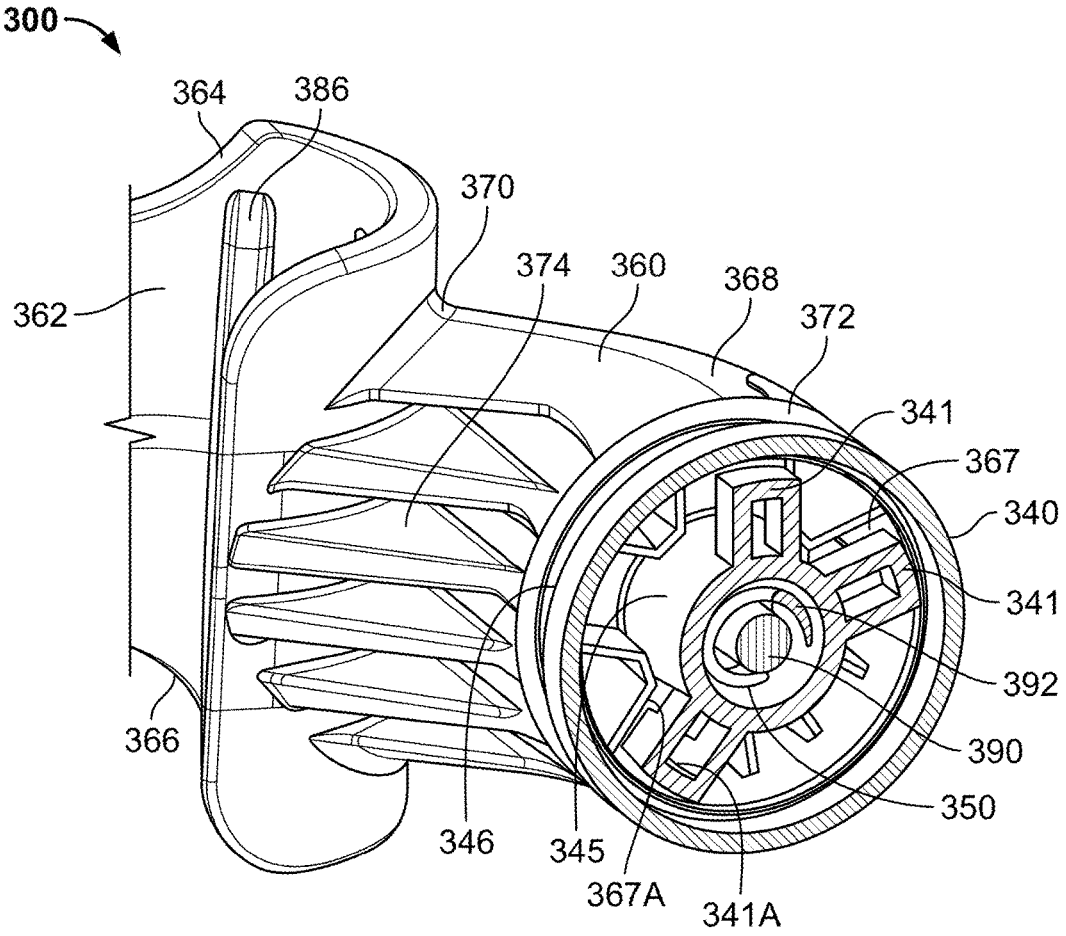
FIG. 16B illustrates a perspective view of a cross-sectional view of the cup holder assembly through the collar component according to one or more aspects described herein.
Figure 18A:
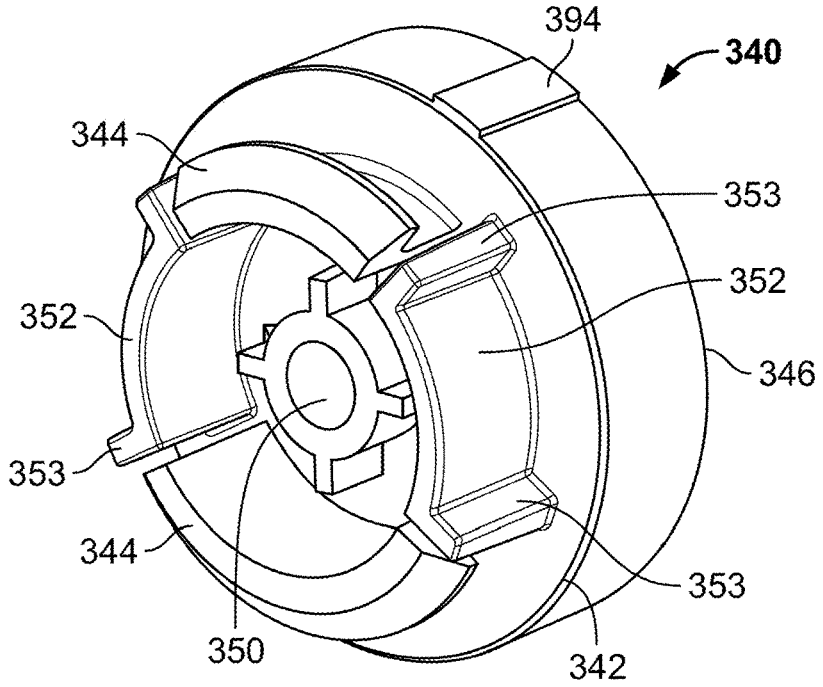
FIGS. 18A and 18B illustrate front and rear perspective views of the collar component of the cup holder assembly according to one or more aspects described herein.
Figure 18B:
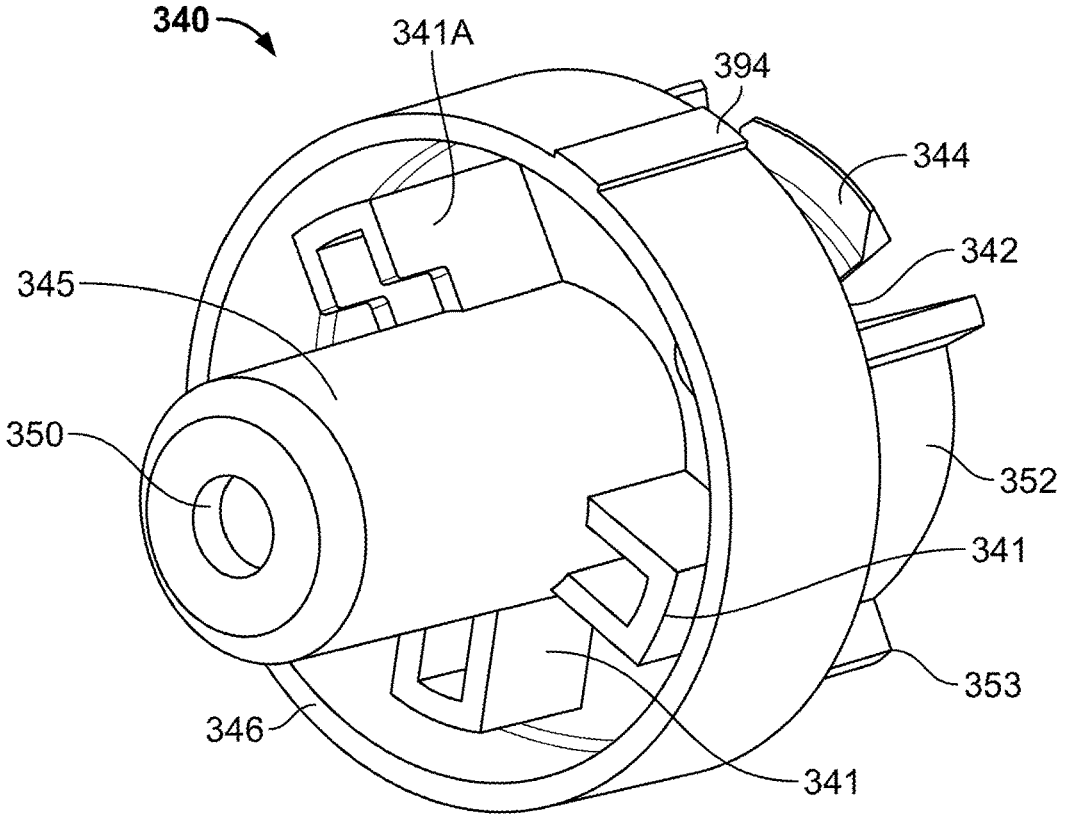
Figure 19:
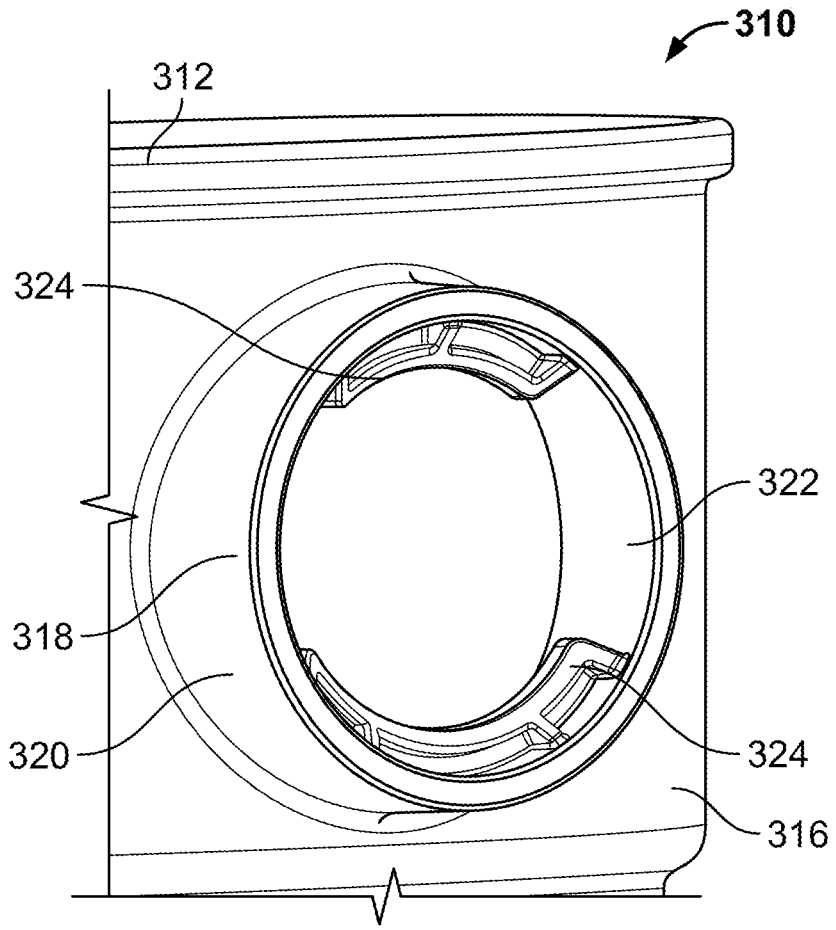
FIG. 19 illustrates a detailed view of the cup holder component of the cup holder assembly according to one or more aspects described herein.

As shown in FIGS. 16B, 18A, and 18B, the plurality of rotation inhibiting features 341 on the collar 340 may comprise a plurality of bosses 341 that are rotationally spaced around a central axis of the collar 340. Each of the plurality of bosses 341 may engage a corresponding rotation-inhibiting feature 367 of the clamp member 360 shown in FIGS. 16B and 17. The plurality of rotation inhibiting features 367 on the clamp member 360 may comprise a plurality of pockets sized to receive the bosses 341 of the collar 340. Each of the plurality of bosses 341 and plurality of pockets 367 may have a substantially rectangular shape. The pockets 367 may only comprise side walls and may not have a rear surface to be able to receive bosses having multiple lengths. The number of pockets 367 on the clamp member 360 may be greater than the number of bosses 341 on the collar 340 to allow multiple rotational orientations of the collar 340 to the clamp member 360. For example, as shown in the exemplary embodiment in FIGS. 16B, 17, 18A, and 18B, the number of bosses 341 is three, while the number of pockets is four. This configuration allows the collar to be rotated relative to the clamp member 360 and still have at least three rotation inhibiting features engaged to the clamp member 360 when the cup holder 310 is in a working position.

In addition, to determine the range of rotation of the collar 340 to the clamp member 360, at least one of the rotation inhibiting features on the collar may limit the maximum allowable rotation. For instance, one of the plurality of bosses 341, boss 341A may have a side surface with a longer length than the other bosses 341 such that when the user pulls the collar 340 from the clamp member 360 the predetermined distance to disengage the plurality of bosses 341 from the plurality of pockets 367, the longer length of boss 341A may prevent the collar 340 from rotating beyond a maximum allowable rotation. The collar 340 may be rotated until boss 341A confronts one of two side surfaces 367A that form a portion of at least two of the plurality of pockets 367 on the clamp member 360. The surfaces 367A may also have a longer length and extend closer to the second end 372 of the engaging member 368 than the other side pocket surfaces. Side surfaces 367A may create a stop for the boss 341A to limit the amount of rotation of the collar 340 relative to the clamp member 360 and effectively set the optimal operating positions of the cup holder 310 relative to the clamp member 360. In the exemplary embodiment, the maximum allowable rotation may be approximately 144 degrees, but may be any predetermined angle.

Once the cup holder 310 is rotated to the new position, the user may detach the C-shaped member 362 of the cup holder assembly 300 from a first front leg 112A, 112B and reattach the C-shaped member 362 to a second front leg 112B, 112A. The C-shaped member 362 may have a plurality of ridges 386 that may increase the gripping force of the C-shaped member 362 on the front legs 112A, 112B. The plurality of ridges 386 may extend longitudinally within the C-shaped member 362 between the upper and lower surfaces, 364, 366. Further, the plurality of ridges 386 may be evenly spaced apart within the C-shaped member 362. Alternatively, the plurality of ridges 386 may be unevenly spaced with more ridges 386 near the open ends of the C-shaped member 362. The plurality of ridges 386 may be integrally formed with C-shape member 362. Optionally, or alternatively, the plurality of ridges 386 may have a coating to improve their gripping force. The C-shaped member 362 may require a force of 25 to 40 newtons (N) applied towards the closed end of the C-shaped member to engage the clamp member 360 to the front legs 112A, 112B.

Figure 15A:
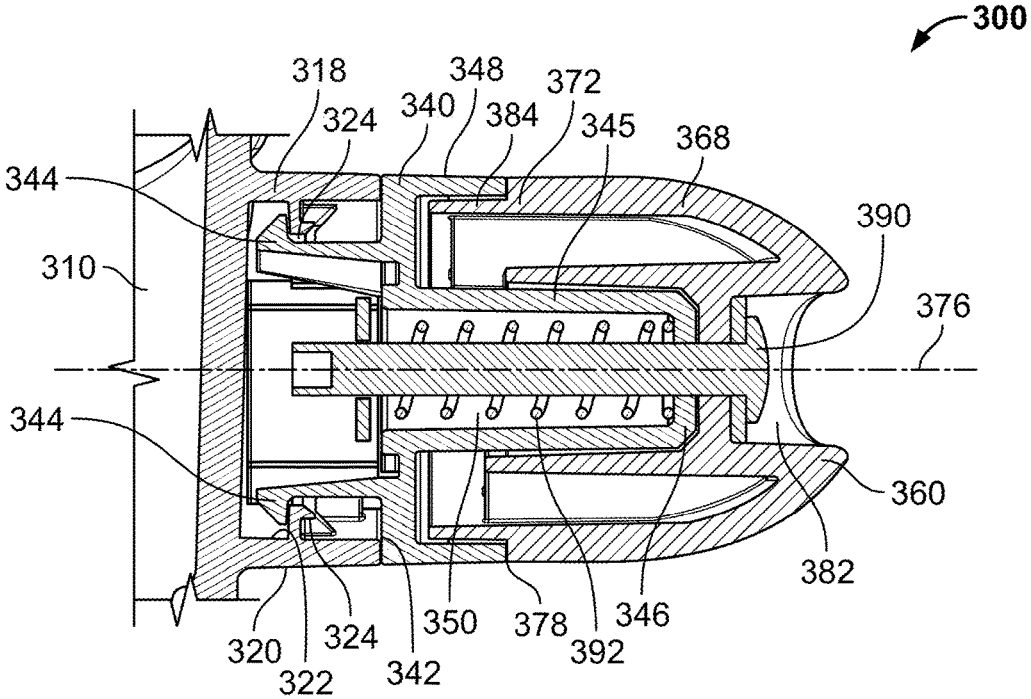
FIGS. 15A and 15B respectively illustrate cross-sectional views of cup holder assembly with the collar in an engaged position and a disengaged position according to one or more aspects described herein.
Figure 15B:
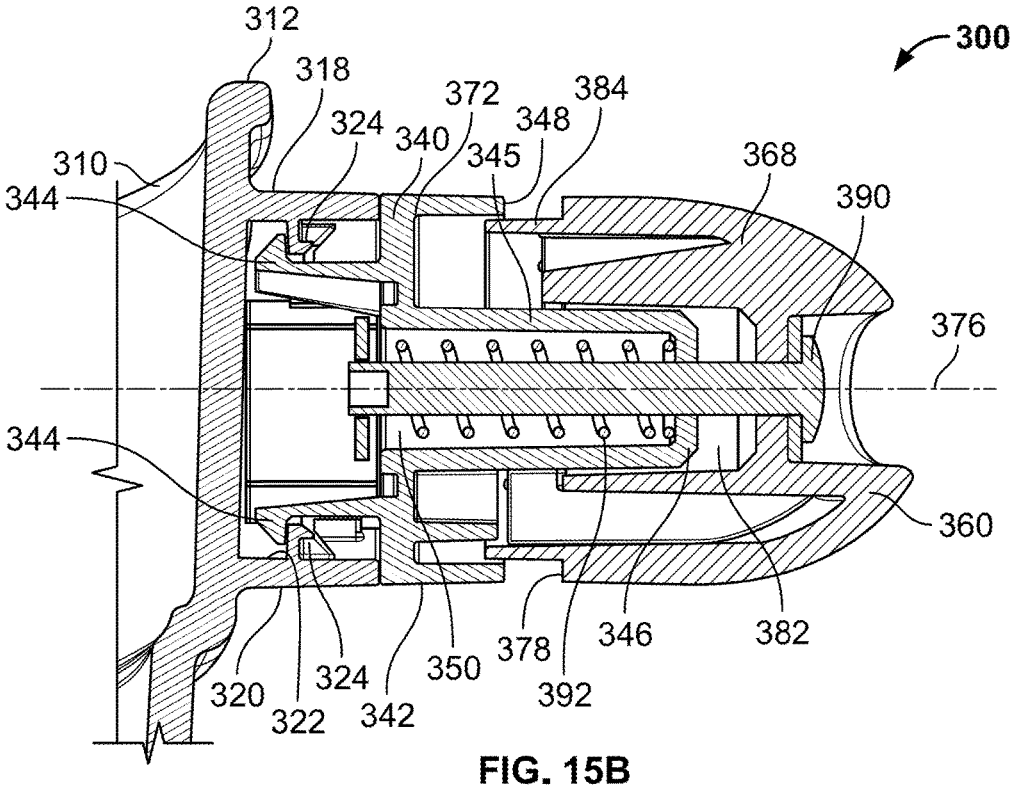

FIGS. 15A and 15B illustrate cross-sectional views of the connection between the engaging member 368 of the clamp member 360, the collar 340, and the cup holder 310 along the longitudinal axis 376. The engaging member 318 may have an exterior surface 320 and an inner cavity 322 that generally follows the shape of the exterior surface 320. For example, the exemplary embodiment as shown in FIGS. 8A and 18 has a substantially cylindrical shaped exterior surface 320, although the exterior surface could have any shape. Within the inner cavity 322, a plurality of flex fingers 324 may extend inwardly from the interior surface 326. Each flex finger 324 may have a tapered member 328. The plurality of flex fingers 324 may be spaced apart from each other and may have different sizes.

As shown in FIGS. 15-19, the collar 340 may have a first end 342 having a corresponding plurality of flex fingers 344 that engage the flex fingers 324 of the cup holder 310 creating a snap fit engagement to secure the collar 340 to the cup holder 310. The plurality of flex fingers 344 on the collar 340 may have a portion that extends along the longitudinal axis and a portion having a taper. The flex fingers 344 may be spaced apart from each other similarly to the flex fingers 324 on the cup holder 310. The collar 340 may also include a plurality of alignment members 352 positioned between the flex fingers 344 as shown in FIGS. 16 and 17. Each alignment member 352 may provide a pair of radially extending flanges 353, which may contact at least one of the ends of the flex fingers 324 on the cup holder 310 to prevent rotation of the cup holder 310 relative to the collar 340 and ensure that the cup holder 310 secures to the collar 340 properly. Thus, the cup holder 310 may be secured to the collar 340 in only one orientation to prevent misassembling the components. The plurality of flex fingers 324, 344 may each comprise two flex fingers 324, 344, but may comprise more than two. For example, the flex fingers 324, 344 may comprise an upper flex finger positioned in the upper portion of the engaging member 318 and upper portion of the collar 340 respectively and a lower flex finger positioned in the lower portion of the engaging member 318 and lower portion of the collar 340 respectively. The flex fingers 324, 344 may have different sizes such that one flex finger is larger than the other. For instance, as shown in the exemplary embodiments, a lower flex finger is larger than the upper flex finger as the lower flex finger extends around a greater portion of the diameter of the collar 340 than the upper flex finger.

By adjusting the stiffness of the flex fingers 344, the connection of the cup holder 310 to the collar 340 may support the cup holder 310 under normal use of inserting and removing bottles or other devices in and out of the cup holder 310, but the flex fingers 324 on the cup holder 310 and the flex fingers 344 may be tuned that if a large force exceeding those seen during normal use is applied to the cup holder 310, the flex fingers 324, 344 may disengage from each other to allow the cup holder 310 to unsnap from the collar 340. For example, if a force exceeding 100 newtons (N) is exerted in a vertical direction on the cup holder 310, the cup holder 310 will release from the collar 340, or alternatively, if a force exceeding 115 newtons (N), or exceeding 130 newtons (N), or even exceeding 145 newtons (N), is exerted on the cup holder 310, the cup holder 310 will release from the collar 340. Since this break-away force is applied in a vertical direction, the force creates a moment around the C-shaped member 362. However, since the break-away force and moment are oriented in a different direction to the clamp-on force, the clamp member 360 may stay secured to the chair 100. The unsnapping of the cup holder 310 from the collar 340 may keep the collar 340 and clamp member 360 from breaking or suffering any permanent damage. Therefore, the cup holder 310 may be reattached to the collar 340 and ready for use again.

As discussed above, a feature of the cup holder assembly 300 is the ability of the collar 340 and cup holder 310 to rotate relative to the clamp member 360. To allow this rotation, the collar 340 may be both slidably and rotationally engaged with the clamp member 360 at a second end 346 that connects to the second end 372 of the engaging member 368 of the clamp member 360. In order to rotate the collar 340 relative to the clamp member 360, the user may apply a force to pull the collar 340 away from the clamp member 360, as shown in FIG. 15B. Pulling the collar 340 away from the clamp member 360 disengages a set of rotation inhibiting features 341, 367 on the collar 340 and the clamp member 360 to allow the collar 340 along with the cup holder 310 to rotate relative to the clamp member 360. The rotation inhibiting features 341, 367 prevent any unwanted or inadvertent rotation between the collar 340 and the clamp member 360 when the cup holder 310 is in a predetermined position. As discussed above, in one embodiment, the cup holder 310 may rotate from a first position to a second position where the first position and the second position are approximately 144 degrees apart.

The collar 340 may be permanently secured to the clamp member 360. The collar 340 may have a central protrusion 345 extending opposite the first end 342 of the collar 340. The central protrusion 345 may extend into the opening 382 of the clamp member 360. The collar 340 may then be secured to the clamp member 360 using a securing member 390 that extends through the opening 382 of the clamp member 360 and through the opening 350 that extends through the collar 340 from the first end 342 through the second end 346. The openings 350, 382 may respectively extend through the center of the collar 340 and the center of the engaging member 368 of the clamp member 360. In addition, the collar 340 may be secured to the clamp member 360 with a spring 392 positioned within the opening 350 of the protrusion 345 that is secured to the clamp member 360 by the securing member 390. The spring 392 applies a force to collar 340 to keep the interface surface 348 in contact with the mounting surface 378 of the clamp member 360 until a user applies a counter force large enough to overcome the spring force and slide the collar 340 away from the clamp member 360 along the securing member 390 disengaging the rotation inhibiting features 341, 367. Even while the rotation inhibiting features 341, 367 are disengaged, the protrusion 345 may still have a portion extending into the opening 382. The collar 340 may slidably move a predetermined distance, which may be controlled by the length of the securing member 390. The engaging member 368 may also have a shelf 384 extending around a perimeter of the second end 372. The securing member 390 may be a mechanical fastener such as a rivet where the rivet joins the collar 340 to the clamp member 360, or alternatively, the securing member 390 may be a screw that may be secured with a nut securing the collar 340 and clamp member 360.

Figure 20A:
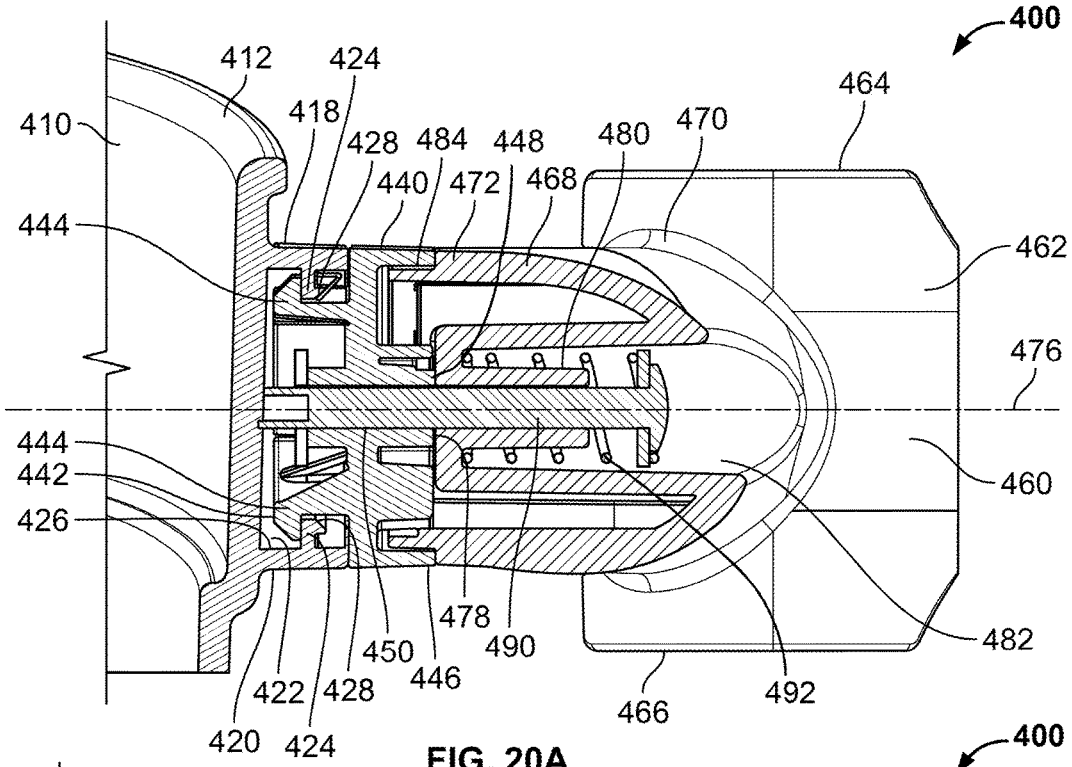
FIGS. 20A and 20B respectively illustrate cross-sectional views of an alternate embodiment of the cup holder assembly with the collar in an engaged position and a disengaged position according to one or more aspects described herein.
Figure 20B:
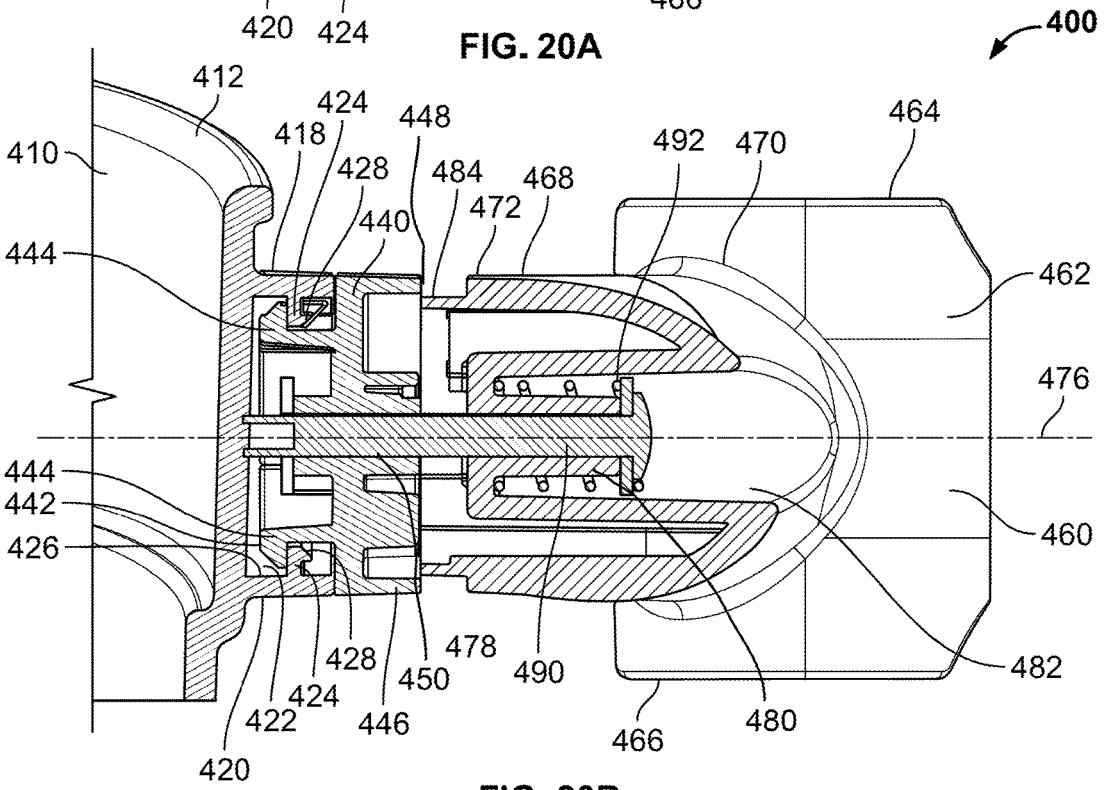

FIGS. 20A and 20B illustrate an alternate embodiment of the collar 340 and clamp member 360 of the embodiment of FIGS. 8-19. For embodiment of FIGS. 20A and 20B, the features are referred to using similar reference numerals under the "4xx" series of reference numerals, rather than "3xx" as used in the embodiment of FIGS. 8-19. Accordingly, certain features of the cup holder 400 that were already described above with respect to cup holder 300 of FIGS. 8-19 may be described in lesser detail, or may not be described at all. Specifically, FIGS. 20A and 20B illustrate an alternate connection between the collar 440 and the clamp member 460, where FIG. 20A shows the collar 440 in an engaged position and FIG. 20B shows the collar 440 in a disengaged position. The alternative embodiment of collar 440 and clamp member 460 are similar to the embodiment shown in FIGS. 15A and 15B, the collar 340 may be permanently secured to the clamp member 360. The alternate embodiment shown in FIGS. 20A and 20B, may have all of the features of the embodiment shown in FIGS. 15A and 15BA, except the collar 440 and clamp member 460 are arranged such that the collar 440 lacks the protrusion 345 of collar 340 that extends into the clamp member 360. In addition, clamp member 460 may have a sleeve or spring guide surface 480 extending inward from the second end 472 of the engaging member 468. As shown in FIGS. 20A and 20B, a securing member 490 may secure the collar 440 to the clamp member 460 where the securing member 490 extends through the opening 482 of the clamp member 460 and through the opening 450 that extends through the collar 440 from the first end 442 through the second end 446. The openings 450, 482 may respectively extend through the center of the collar 440 and the center of the engaging member 468 of the clamp member 460. In addition, the collar 440 may be secured to the clamp member 460 with a spring 492 positioned within the opening 482 that is secured to the clamp member 460 by the securing member 490. The spring 492 applies a force to collar 440 to keep the interface surface 448 in contact with the mounting surface 478 of the clamp member 460 until a user applies a counter force large enough to overcome the spring force and slide the collar 440 away from the clamp member 460 along the securing member 490 to disengage the rotation inhibiting features 441, 467.

Figure 21:
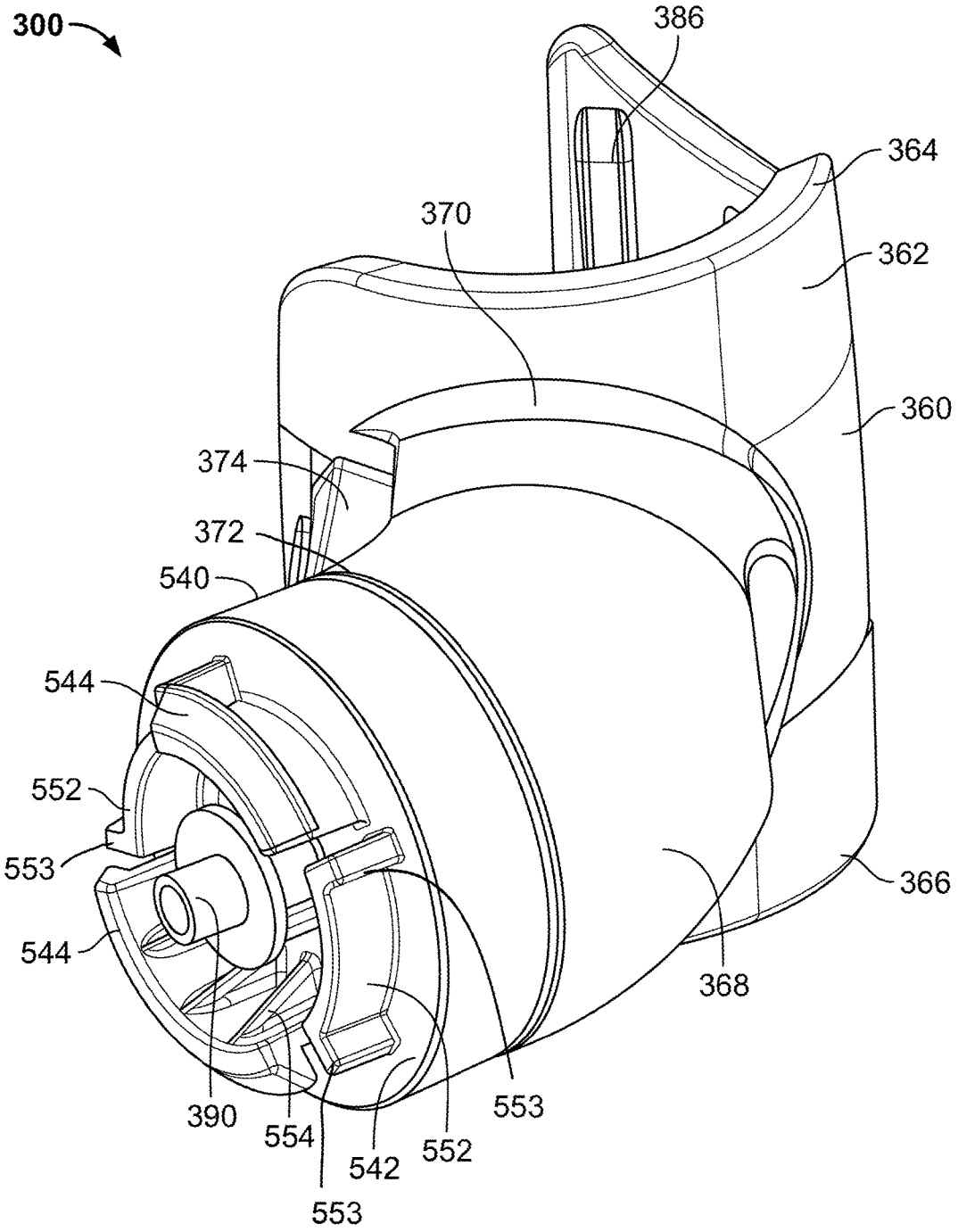
FIG. 21 illustrates a perspective view of an alternate embodiment of the cup holder assembly with the cup holder removed for clarity according to one or more aspects described herein.

FIG. 21 illustrates an alternate embodiment of the collar 540. As an alternative embodiment of the collar 340 of the embodiments of FIGS. 8-20B. For embodiment of FIG. 21, the features of the collar 340 are referred to using similar reference numerals under the "5xx" series of reference numerals, rather than "3xx" as used in the embodiment of FIGS. 8-19. Accordingly, certain features of the collar 540 that were already described above with respect to collar 340, 440 of FIGS. 8-20B may be described in lesser detail, or may not be described at all. Specifically, the collar 540 may have either interface shown in describing collar 340 and 440 as either relates to its corresponding clamp member 360 or 460. FIG. 21 specifically shows an embodiment of the collar 540 where the flex fingers 544 have gussets 554 to support and adjust the stiffness or tune the stiffness of the flex fingers 544 to the correct stiffness to enable the flex fingers 544 to disengage from the flex fingers 324 of the cup holder 310 if a force exceeding the normal use is applied to the cup holder 310 to allow the cup holder 310 to unsnap from the collar 540.

Each of the primary components, such as the cup holder 310, the collar 340, and the clamp member 360, of cup holder assembly 300 may be formed from a metallic material, such as an aluminum alloy or nonmetallic material, such as a polymer. The polymer may be fiber-reinforced, such as carbon-fiber or glass-fiber polymer. Alternatively, the polymer may be unfilled. For instance, the cup holder 310 may be formed from a nylon or polyamide type material, while the clamp member 360 and collar 340 may be made from a polyoxymethylene (POM) or other similar material. Further, the components may be formed from an injection molding process, machining, or additive manufacturing process.

In another example, on the front leg 112A proximate to the intersection with the front leg attachment portion 170A of seat frame 131, chair 100 may include an accessory attachment interface (not shown). The accessory attachment interface may be fabricated into front leg 112A and may be configured to receive YETI® Tundra accessories including YETI® Beverage Holder, YETI® Rod Holster, YETI® Molle Zinger, and the like. Additionally, the accessory attachment interface may be configured to receive a waterproof storage compartment, anti-varmint device, fish finder, and the like.

Additionally, and/or alternatively, on the front leg 112B proximate to the intersection with the front leg attachment portion 170B of seat frame 131, chair 100 may include a rigidly attached cup holder, a detachably attachable cup holder accessory, and/or an accessory attachment interface configured to receive YETI® Tundra accessories and additional accessories as stated above.

The present invention is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

We claim:

1. A cup holder assembly comprising:

a cup holder comprising a bottom interior surface, a lip, a substantially cylindrical wall positioned between the bottom interior surface and the lip, and an engaging member extending from the substantially cylindrical wall; and a collar having a first side that releasably secures to the engaging member of the cup holder and a second side secured to a clamp member comprising a substantially C-shaped member, wherein the collar can rotate relative to the clamp member, wherein the collar rotates relative to the clamp member in two positions.

2. The cup holder assembly of claim 1, wherein the collar has a plurality of flex fingers that engage a corresponding plurality of flex fingers on the engaging member of the cup holder to releasably secure the cup holder to the collar.

3. The cup holder assembly of claim 2, wherein the plurality of flex fingers on the collar comprises an upper flex finger positioned on a top portion of the collar and a lower flex finger positioned on a bottom portion of the collar.

4. The cup holder assembly of claim 3, wherein the upper flex finger and the lower flex finger are spaced from each other.

5. The cup holder assembly of claim 3, wherein the collar further comprises an alignment member positioned between the upper flex finger and the lower flex finger.

6. The cup holder assembly of claim 5, wherein the alignment member has a radially extending flange that contacts a portion of at least one of the plurality of flex fingers on the engaging member of the cup holder to prevent rotation of the cup holder relative to the collar.

7. The cup holder assembly of claim 3, wherein the lower flex finger is larger than the upper flex finger.

8. A portable chair and cup holder system comprising:

a portable chair comprising:

a first front leg and a second front leg connected by a front sled;

a first back leg and a second back leg connected by a back sled;

a seat comprising a weave-type construction, and a cup holder assembly comprising:

a cup holder having a bottom interior surface, a lip, and a substantially cylindrical wall positioned between the bottom interior surface and the lip, and an engaging member extending from the substantially cylindrical wall of the cup holder, wherein the engaging member releasably connects to a collar that is secured to a clamp member having a substantially C-shaped member, wherein the C-shaped member releasably connects to either the first front leg or the second front leg and wherein the cup holder can rotate from an outboard position to an inboard position while still being connected to the portable chair, and wherein the engaging member on the cup holder includes a plurality of flex fingers that engage a plurality of flex fingers on the collar.

9. The portable chair and cup holder system of claim 8, wherein the C-shaped member has a portion of an upper surface and a portion of a lower surface having a rounded edge such that the rounded edge contacts a bushing extending inwardly from either the first front leg or the second front leg of the portable chair.

10. The portable chair and cup holder system of claim 8, wherein the cup holder can rotate relative to the clamp member.

11. The portable chair and cup holder system of claim 8, wherein the collar is slidably connected to an engaging member extending from the C-shaped member of the clamp member, and wherein each of the collar and the engaging member of the clamp member each have rotation inhibiting features.

12. A cup holder assembly comprising:

a cup holder comprising a bottom surface, a lip, a substantially cylindrical wall positioned between the bottom surface and the lip, and an engaging member extending from the substantially cylindrical wall; and a collar having a first side that releasably secures to the engaging member and a second side secured to a clamp member comprising a substantially C-shaped member, wherein the collar is slidably engaged with the clamp member, wherein the collar further comprises a plurality of rotation inhibiting features that engage a plurality of rotation inhibiting features on the clamp member that prevent inadvertent rotation of the collar relative to the clamp member.

13. The cup holder assembly of claim 12, wherein if a force exceeding 100 newtons is applied to the cup holder, the cup holder will release from the collar.

14. The cup holder assembly of claim 12, wherein the collar can rotate relative to the clamp member, when the plurality of rotation inhibiting features on both the collar and the clamp member are disengaged by slidably moving the collar away from the clamp member.

15. The cup holder assembly of claim 14, wherein the plurality of rotation inhibiting features on the collar comprise a plurality of bosses that are rotationally spaced apart.

16. The cup holder assembly of claim 15, wherein one of the plurality of bosses has a first length that is greater than a second length of a remainder of the bosses.

17. The cup holder assembly of claim 14, wherein the plurality of rotation inhibiting features on the clamp member comprises a plurality of pockets.

* * * * *